US011920360B2

(12) United States Patent
Whittemore

(10) Patent No.: US 11,920,360 B2
(45) Date of Patent: Mar. 5, 2024

(54) ZIPPER PULL SYSTEM AND METHODS OF USE

(71) Applicant: Zipwall, LLC., Arlington, MA (US)

(72) Inventor: Jeffrey P. Whittemore, Arlington, MA (US)

(73) Assignee: ZIPWALL, LLC., Arlington, MA (US)

( * ) Notice: Subject to any disclaimer, the term of this patent is extended or adjusted under 35 U.S.C. 154(b) by 0 days.

(21) Appl. No.: 17/881,829

(22) Filed: Aug. 5, 2022

(65) Prior Publication Data

US 2023/0067682 A1 Mar. 2, 2023

Related U.S. Application Data

(63) Continuation of application No. 17/603,756, filed as application No. PCT/US2020/031284 on May 4, 2020, now Pat. No. 11,441,323.

(60) Provisional application No. 62/873,834, filed on Jul. 12, 2019, provisional application No. 62/847,874, filed on May 14, 2019, provisional application No. 62/845,786, filed on May 9, 2019, provisional application No. 62/842,490, filed on May 2, 2019.

(51) Int. Cl.
*E04G 21/24* (2006.01)
*E04G 21/30* (2006.01)

(52) U.S. Cl.
CPC ..... *E04G 21/243* (2013.01); *E04G 21/30* (2013.01)

(58) Field of Classification Search
CPC ..... E04G 21/24; E04G 21/241; E04G 21/242; E04G 21/243; E04G 21/26; E04G 21/30; E06B 3/80; E06B 5/025; E04H 15/32; E04H 15/58; Y10T 24/25; Y10T 24/2586; Y10S 160/18
See application file for complete search history.

(56) References Cited

U.S. PATENT DOCUMENTS 3,006,051 A * 10/1961 Maeder ..... A47G 25/902 294/3.6
3,323,530 A * 6/1967 Smith ..... A01M 31/025 135/901

(Continued)

FOREIGN PATENT DOCUMENTS

| | | |
|---|---|---|
| JP | 2006063589 | 3/2006 |
| WO | 2009017592 | 2/2009 |
| WO | 2017117042 | 7/2017 |

OTHER PUBLICATIONS

International Preliminary Report on Patentability dated Nov. 11, 2021 issued in corresponding International Application No. PCT/US2020/031284.

(Continued)

*Primary Examiner* — Ryan D Kwiecinski
(74) *Attorney, Agent, or Firm* — Onello & Mello, LLP.

(57) ABSTRACT

A system, comprises a first pulley and a first pulley mount constructed and arranged to couple the first pulley to a curtain including a zipper. The first pulley mount comprises a first portion and a second portion that are removably coupled to each other with a portion of the curtain between them when mounted to the curtain. A second pulley in included along with a second pulley mount constructed and arranged to couple the second pulley in position relative to the curtain. An elongated pull is coupled to the first pulley, the second pulley, and a zipper pull of the zipper.

20 Claims, 79 Drawing Sheets

(56) References Cited

U.S. PATENT DOCUMENTS 3,568,901 A * 3/1971 McNitt ..... A47G 25/902 223/111
4,197,897 A 4/1980 Correa
4,493,134 A 1/1985 Karr
4,962,782 A * 10/1990 Landrum ..... E04H 15/32 223/111
5,195,217 A * 3/1993 Arntzen ..... A01K 27/005 24/115 F
5,427,169 A * 6/1995 Saulters ..... E06B 9/0692 160/DIG. 18
5,481,888 A 1/1996 Perry
5,685,112 A * 11/1997 Fara ..... E04G 21/32 52/745.15
5,689,860 A * 11/1997 Matoba ..... F16G 11/101 24/115 F
5,819,474 A * 10/1998 Strom ..... E04H 15/34 52/63
5,924,469 A * 7/1999 Whittemore ..... E04G 21/30 248/200.1
5,940,941 A * 8/1999 Dishner ..... A44B 19/36 29/408
6,209,615 B1 4/2001 Whittemore
6,321,823 B1 11/2001 Whittemore
6,394,168 B1 * 5/2002 Zoboski ..... A47H 13/00 160/DIG. 18
6,508,295 B2 1/2003 Whittemore
6,564,512 B1 5/2003 Whittemore
6,942,004 B2 9/2005 Whittemore
6,953,076 B2 10/2005 Whittemore
6,962,188 B2 * 11/2005 Coenraets ..... A62C 2/10 160/237
7,073,758 B2 * 7/2006 Whittemore ..... E04G 21/30 248/230.4
7,108,040 B2 9/2006 Whittemore
7,261,140 B2 8/2007 Whittemore
7,503,373 B2 3/2009 Whittemore
7,533,712 B2 5/2009 Whittemore et al.
7,658,219 B2 2/2010 Whittemore
7,670,401 B2 3/2010 Whittemore
7,717,382 B2 5/2010 Whittemore et al.
7,743,512 B1 6/2010 Whittemore
7,810,771 B1 * 10/2010 Akers ..... E04G 21/243 248/200.1
7,905,938 B2 3/2011 Whittemore
8,066,051 B2 11/2011 Whittemore
8,069,546 B1 12/2011 Whittemore
8,113,475 B2 2/2012 Whittemore et al.
8,137,426 B2 3/2012 Whittemore
8,141,273 B2 3/2012 Stramare et al.
8,349,047 B2 1/2013 Whittemore
8,371,360 B2 2/2013 Whittemore
8,591,619 B2 11/2013 Whittemore
8,595,905 B1 12/2013 Kirk et al.
8,627,873 B2 1/2014 Whittemore
8,739,373 B1 * 6/2014 Berman ..... A43C 7/04 24/712.6
8,801,824 B2 8/2014 Whittemore
8,857,499 B2 10/2014 Whittemore
8,910,983 B1 * 12/2014 Neff ..... A47G 25/902 24/429
9,115,539 B2 * 8/2015 Whittemore ..... E06B 3/80
9,441,392 B2 * 9/2016 Whittemore ..... E04G 21/24
9,458,862 B2 10/2016 Whittemore
D777,901 S 1/2017 Whittemore
9,657,514 B1 * 5/2017 Whittemore ..... E04G 21/241
9,663,962 B1 5/2017 Whittemore
9,725,946 B1 * 8/2017 Vassilev ..... E06B 1/34
9,784,287 B2 10/2017 Whittemore
10,081,955 B2 9/2018 Whittemore
10,094,140 B2 * 10/2018 Chen ..... E05F 11/04
10,174,514 B2 1/2019 Whittemore
10,208,527 B1 * 2/2019 Aery ..... E06B 5/14
10,428,539 B2 10/2019 Whittemore
10,538,930 B2 1/2020 Whittemore
10,597,882 B2 3/2020 Whittemore
10,689,865 B2 6/2020 Whittemore
10,781,597 B2 * 9/2020 Whittemore ..... E04G 21/26
10,822,862 B2 * 11/2020 Header ..... E06B 3/26303
10,961,730 B2 3/2021 Whittemore
10,968,649 B1 4/2021 Whittemore
11,230,091 B2 * 1/2022 Whittemore ..... E06B 9/0692
11,441,323 B2 9/2022 Whittemore
11,447,968 B2 9/2022 Whittemore
2002/0011316 A1 1/2002 Whittemore
2003/0070773 A1 4/2003 Whittemore
2004/0031892 A1 2/2004 Whittemore et al.
2004/0065799 A1 4/2004 Whittemore et al.
2004/0168775 A1 9/2004 Coenraets
2004/0194418 A1 * 10/2004 Gouley ..... E04G 25/04 248/200.1
2004/0200585 A1 10/2004 Whittemore
2004/0209018 A1 * 10/2004 Lookholder ..... A61G 1/01 428/33
2005/0247414 A1 11/2005 Whittemore
2005/0284591 A1 12/2005 Whittemore
2006/0168925 A1 8/2006 Whittemore
2006/0272785 A1 12/2006 Whittemore
2007/0094947 A1 * 5/2007 Greenfeld ..... E04H 15/44 52/79.1
2007/0257170 A1 11/2007 Whittemore et al.
2008/0006374 A1 1/2008 Whittemore
2008/0017332 A1 * 1/2008 Daly ..... A47H 23/04 160/330
2008/0250618 A1 * 10/2008 Stramare ..... A43C 7/08 24/712.7
2009/0071614 A1 3/2009 Whittemore
2010/0108849 A1 5/2010 Whittemore
2010/0115898 A1 5/2010 Whittemore
2010/0186300 A1 * 7/2010 Trageser ..... E04G 21/241 49/506
2010/0237209 A1 9/2010 Whittemore et al.
2010/0276090 A1 * 11/2010 Zagone ..... E04G 21/243 160/368.1
2010/0301000 A1 12/2010 Whittemore
2011/0068025 A1 3/2011 Whittemore
2011/0126500 A1 6/2011 Whittemore
2011/0192522 A1 8/2011 Whittemore
2011/0308747 A1 * 12/2011 Starzomski ..... E04G 21/241 160/368.1
2012/0049034 A1 3/2012 Whittemore
2012/0148399 A1 6/2012 Whittemore
2012/0234705 A1 9/2012 Whittemore
2013/0118137 A1 5/2013 Whittemore
2013/0134279 A1 5/2013 Whittemore
2014/0047805 A1 2/2014 Whittemore
2014/0341725 A1 11/2014 Whittemore
2015/0052843 A1 2/2015 Whittemore
2016/0025110 A1 1/2016 Whittemore
2016/0356040 A1 12/2016 Whittemore
2017/0009473 A1 1/2017 Whittemore
2017/0009474 A1 1/2017 Whittemore
2017/0020322 A1 1/2017 Whittemore
2018/0106070 A1 4/2018 Chen
2018/0154293 A1 6/2018 Whittemore
2018/0291675 A1 10/2018 Whittemore
2019/0003193 A1 1/2019 Whittemore
2019/0186162 A1 6/2019 Whittemore
2020/0024858 A1 * 1/2020 Whittemore ..... E04G 25/08
2020/0080685 A1 3/2020 Whittemore
2020/0087935 A1 3/2020 Whittemore
2020/0109599 A1 * 4/2020 Whittemore ..... E04G 21/241
2021/0047850 A1 2/2021 Whittemore
2021/0404198 A1 12/2021 Whittemore
2022/0074523 A1 3/2022 Whittemore
2022/0081963 A1 3/2022 Whittemore
2022/0090398 A1 3/2022 Whittemore
2022/0162866 A1 5/2022 Whittemore

OTHER PUBLICATIONS

Affidavit of Jeffery P. Whittemore in connection with Information Disclosure Statement, Apr. 25, 2022.

(56) References Cited

OTHER PUBLICATIONS

International Search Report and Written Opinion dated Jul. 13, 2020 issued in corresponding International Application No. PCT/US2020/031284.

"Zipper Pull System and Methods of Use" Specification, Drawings, Claims and Prosecution History of U.S. Appl. No. 17/603,756, filed Oct. 14, 2021, by Jeffrey P. Whittemore, now issued U.S. Pat. No. 11,441,323, issued Sep. 13, 2022, which is stored in the United States Patent and Trademark Office (USPTO).

* cited by examiner

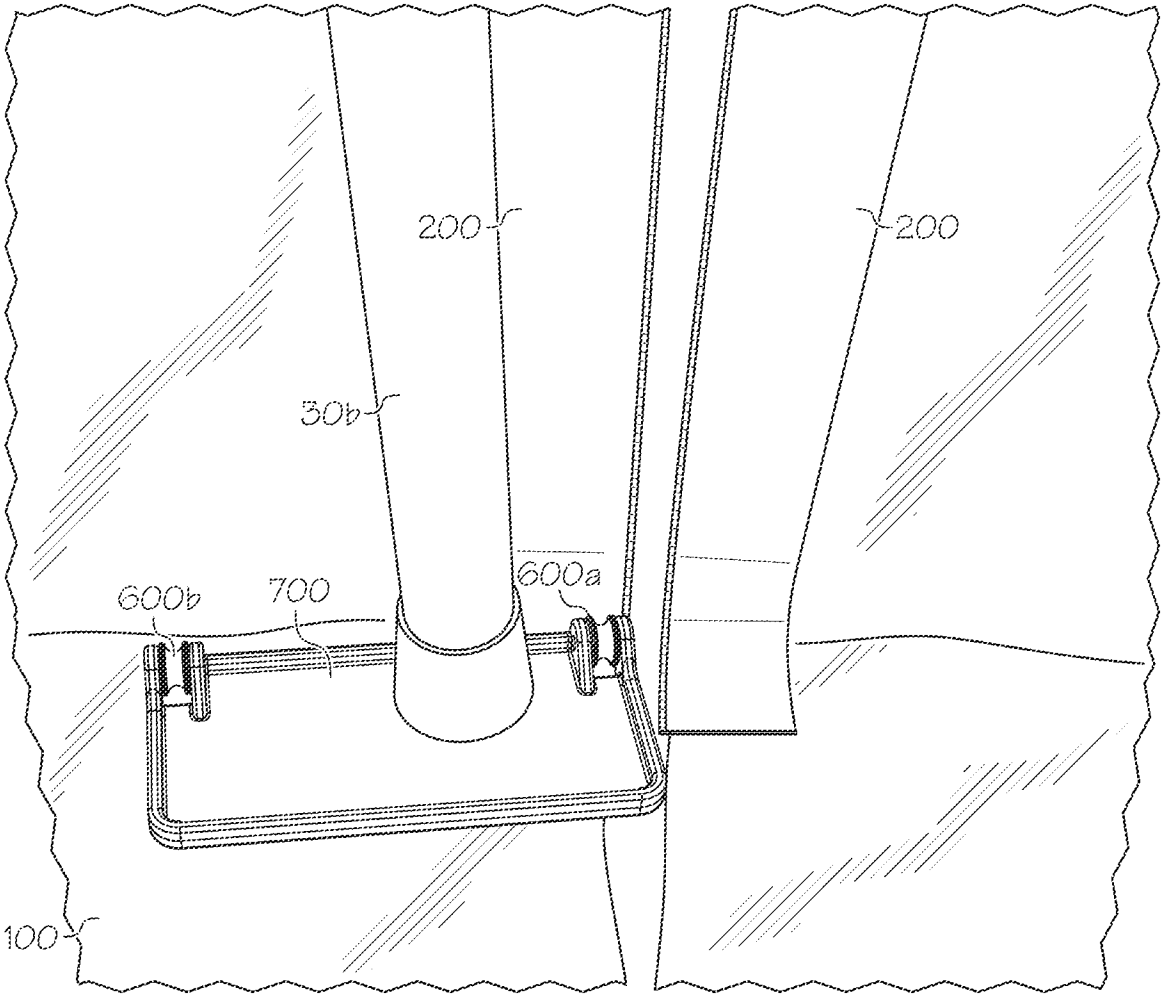
FIG. 1C1

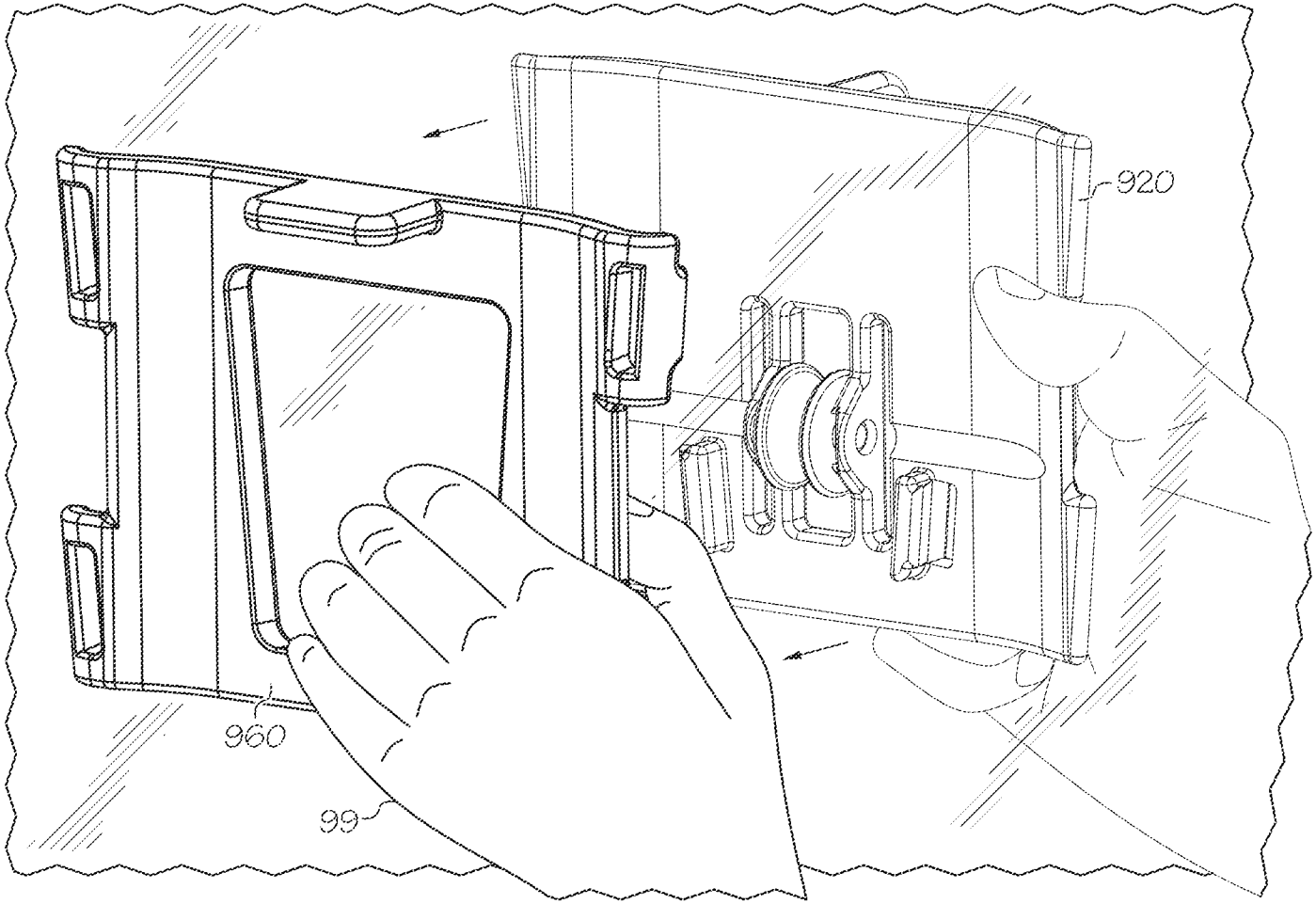
FIG. 1D1

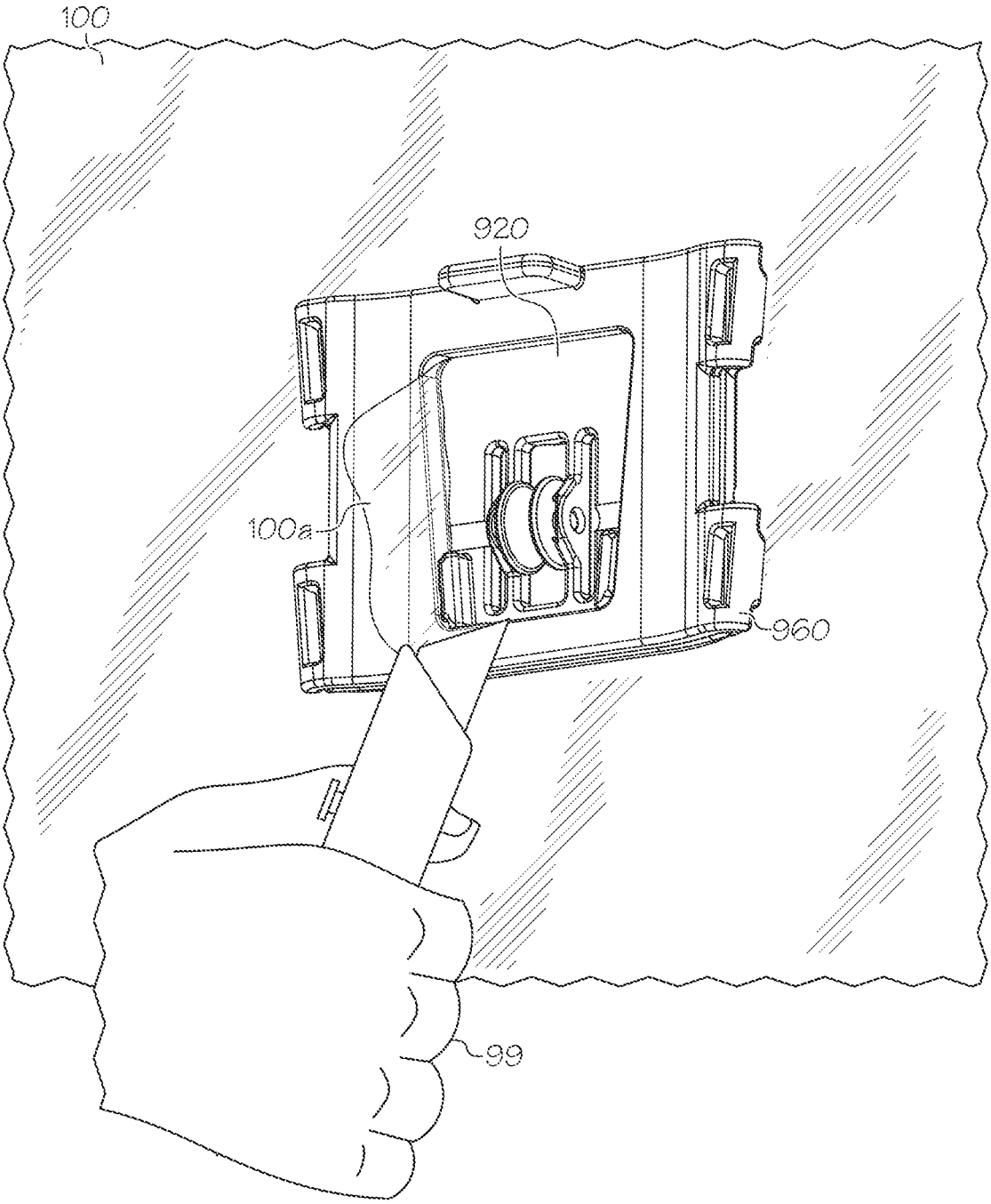
FIG. 1D2

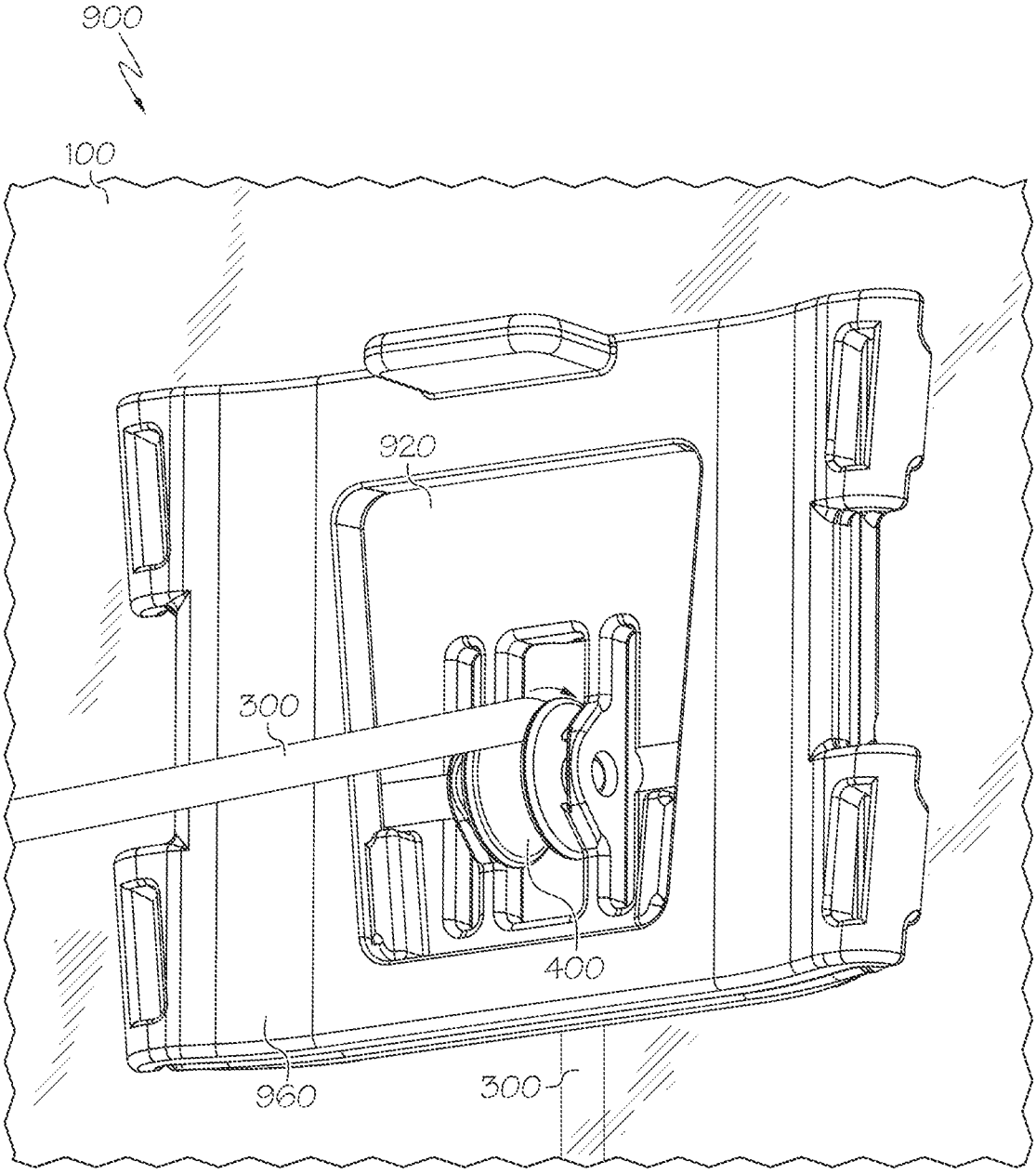
FIG. 1E1

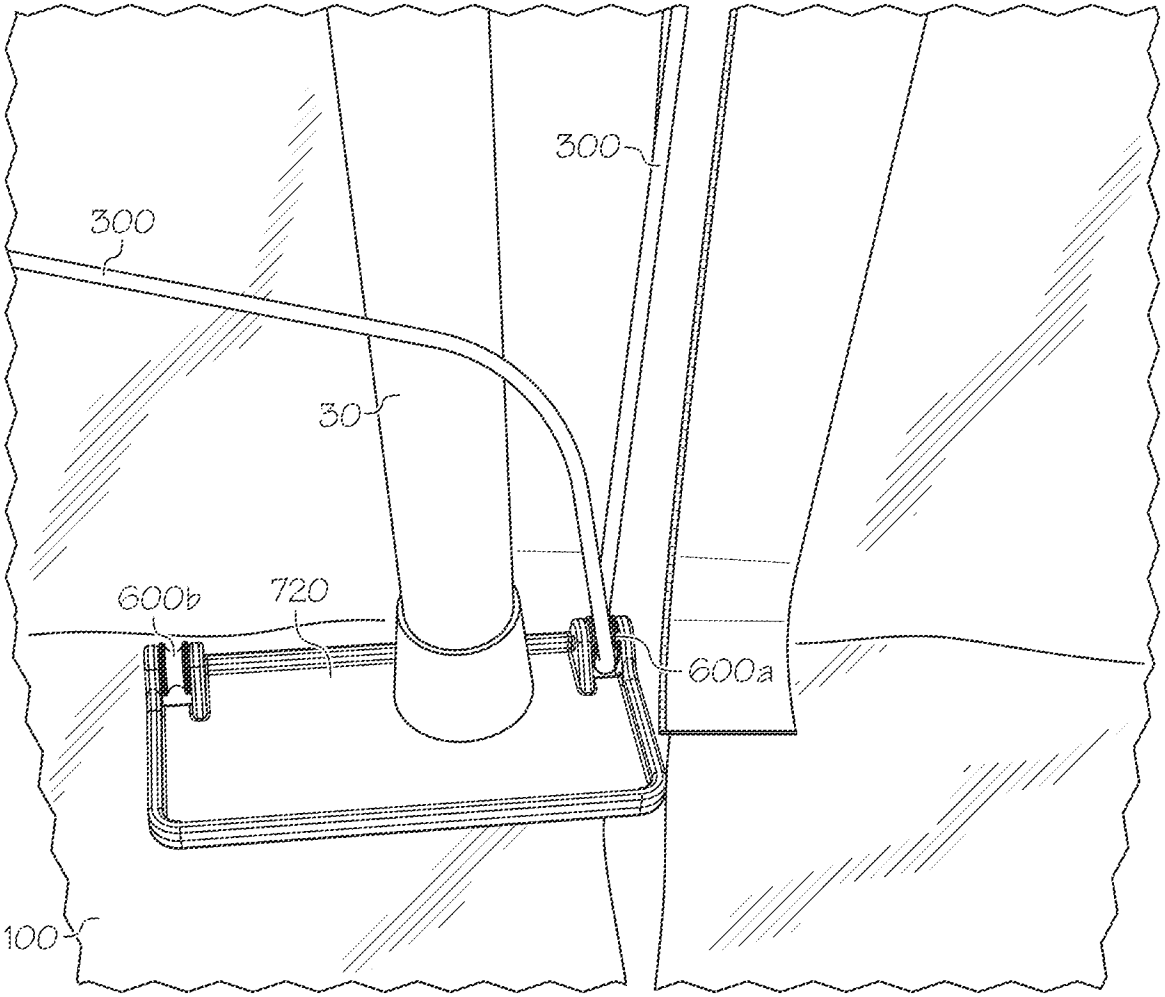
FIG. 1F1

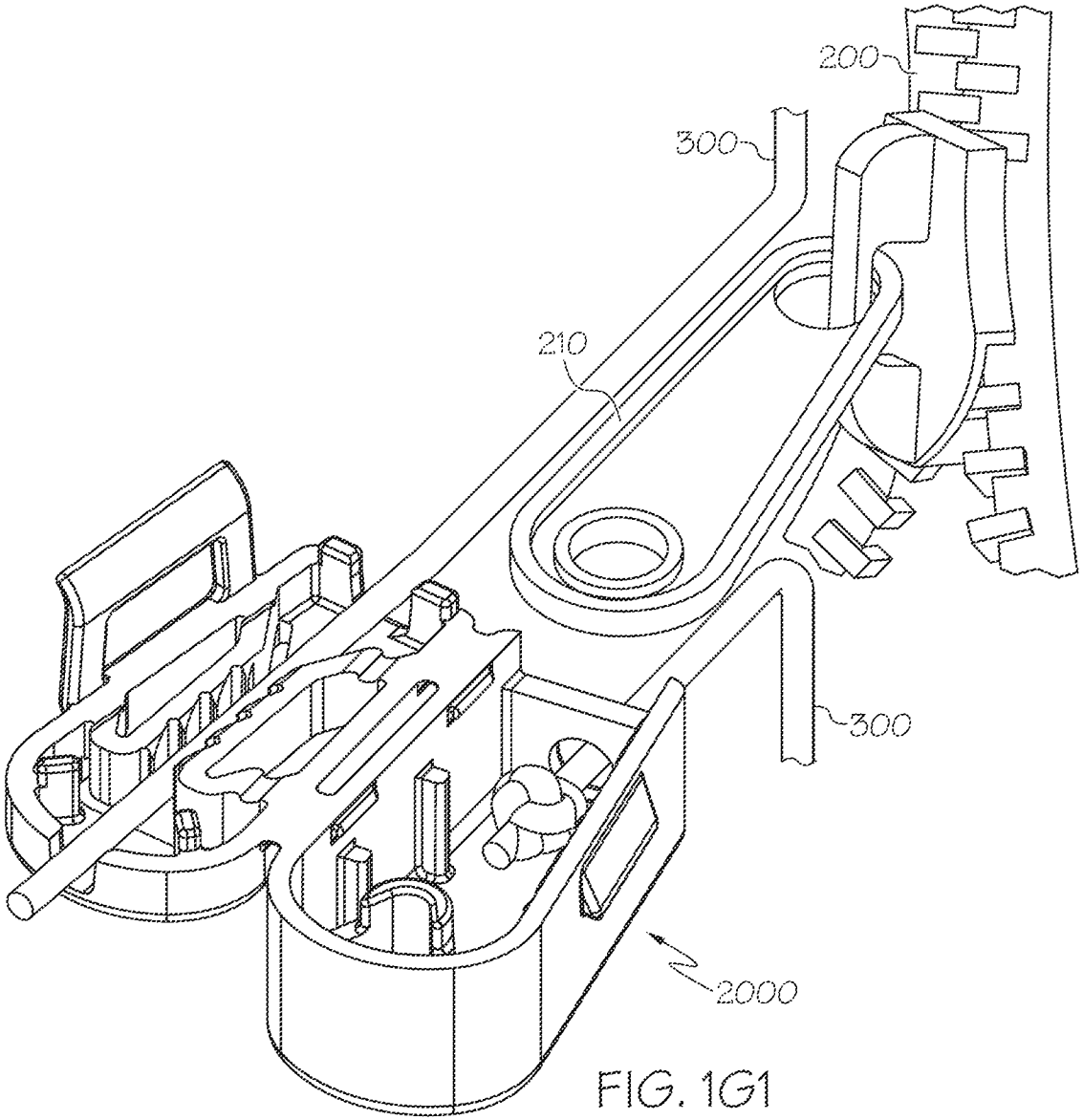
FIG. 1G1

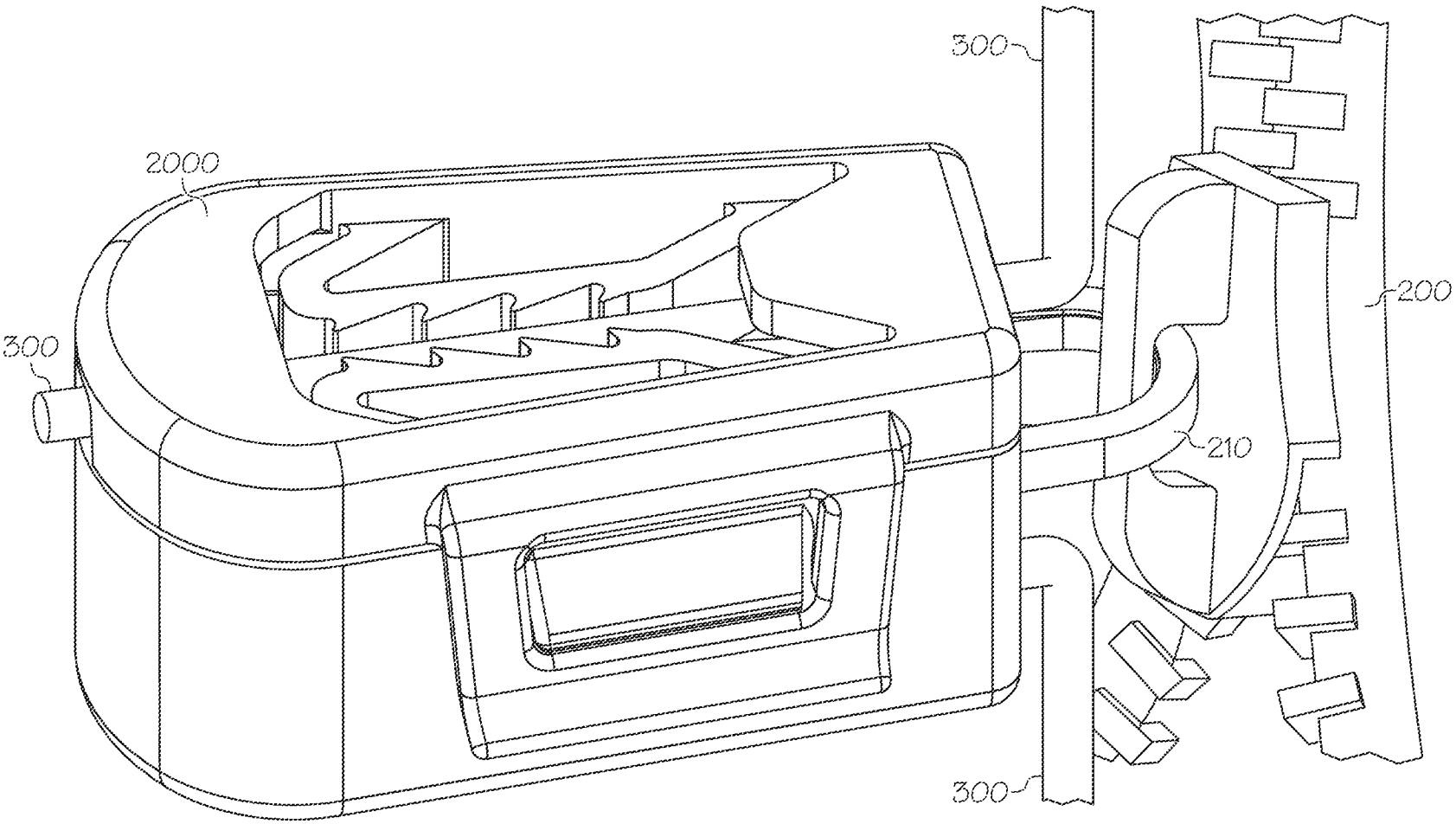
FIG. 1H1

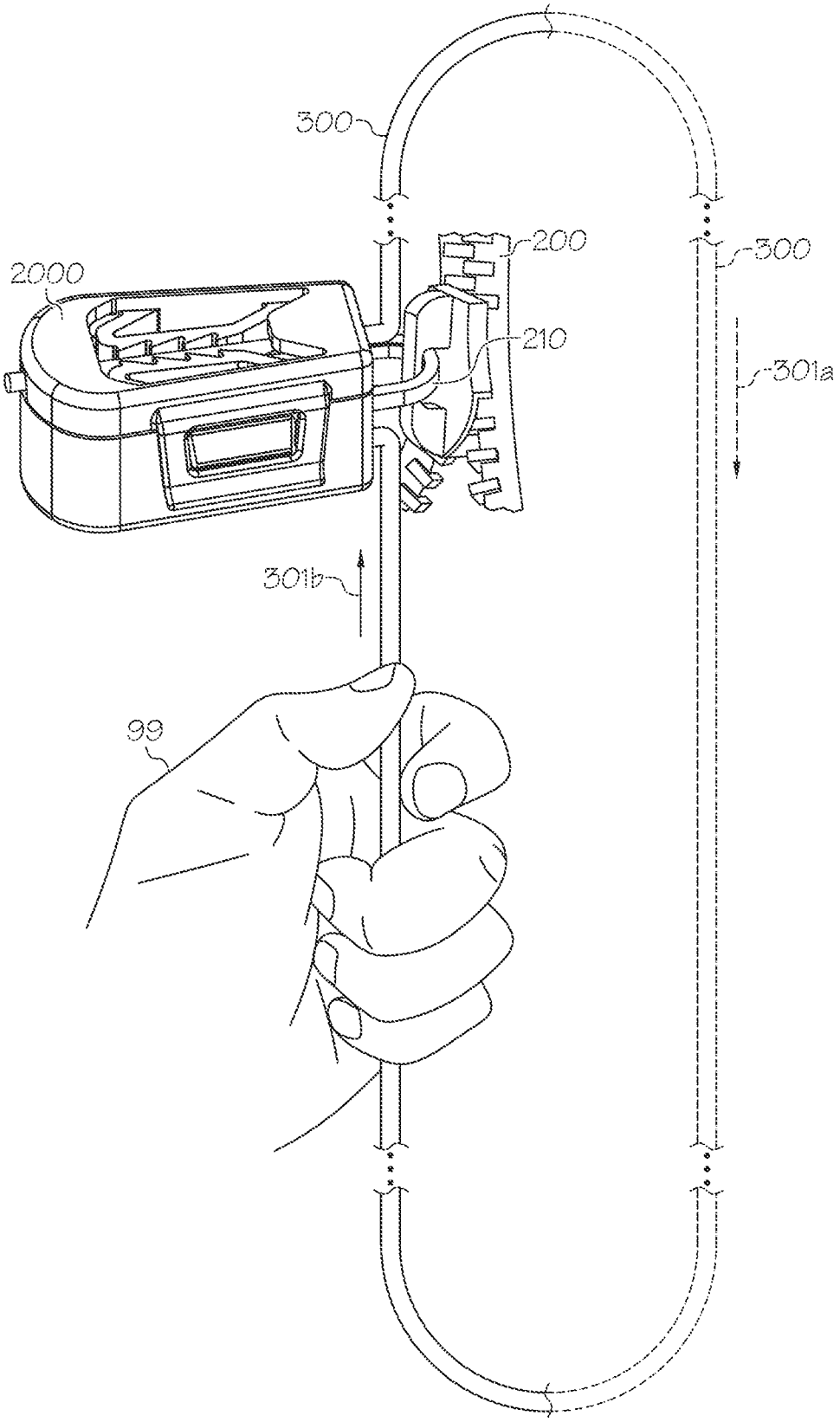
FIG. 1J1

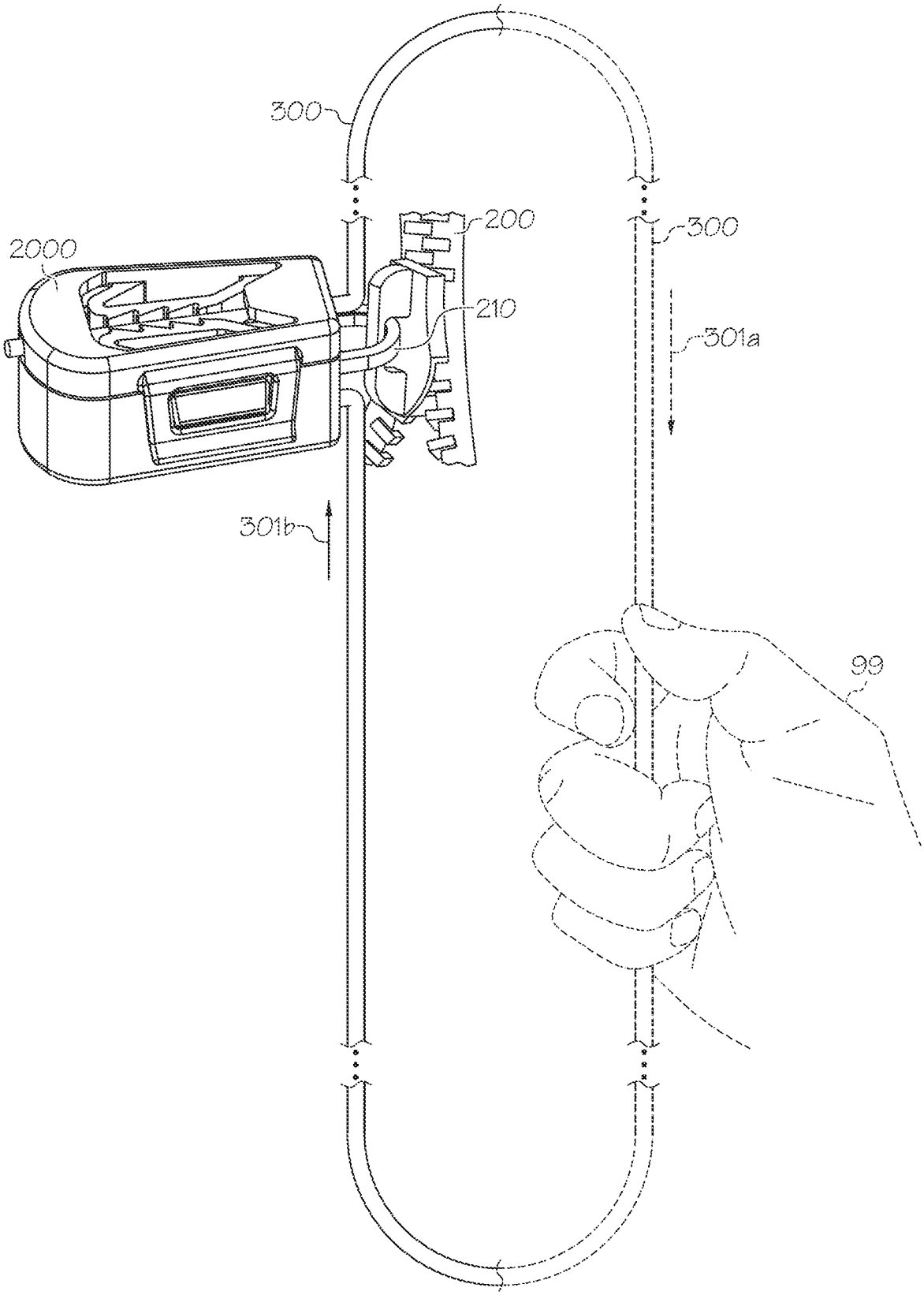
FIG. 1K1

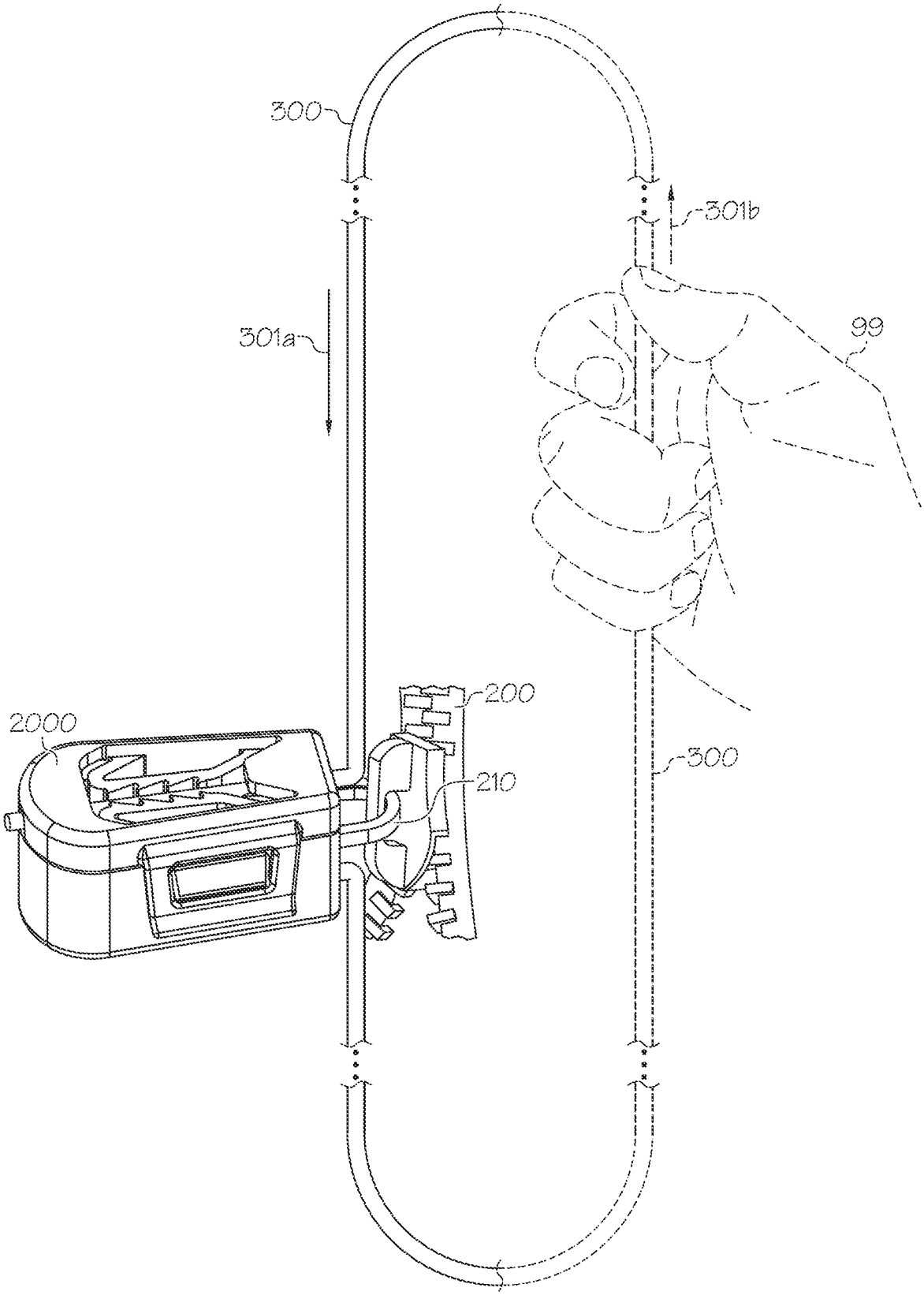
FIG. 1L1

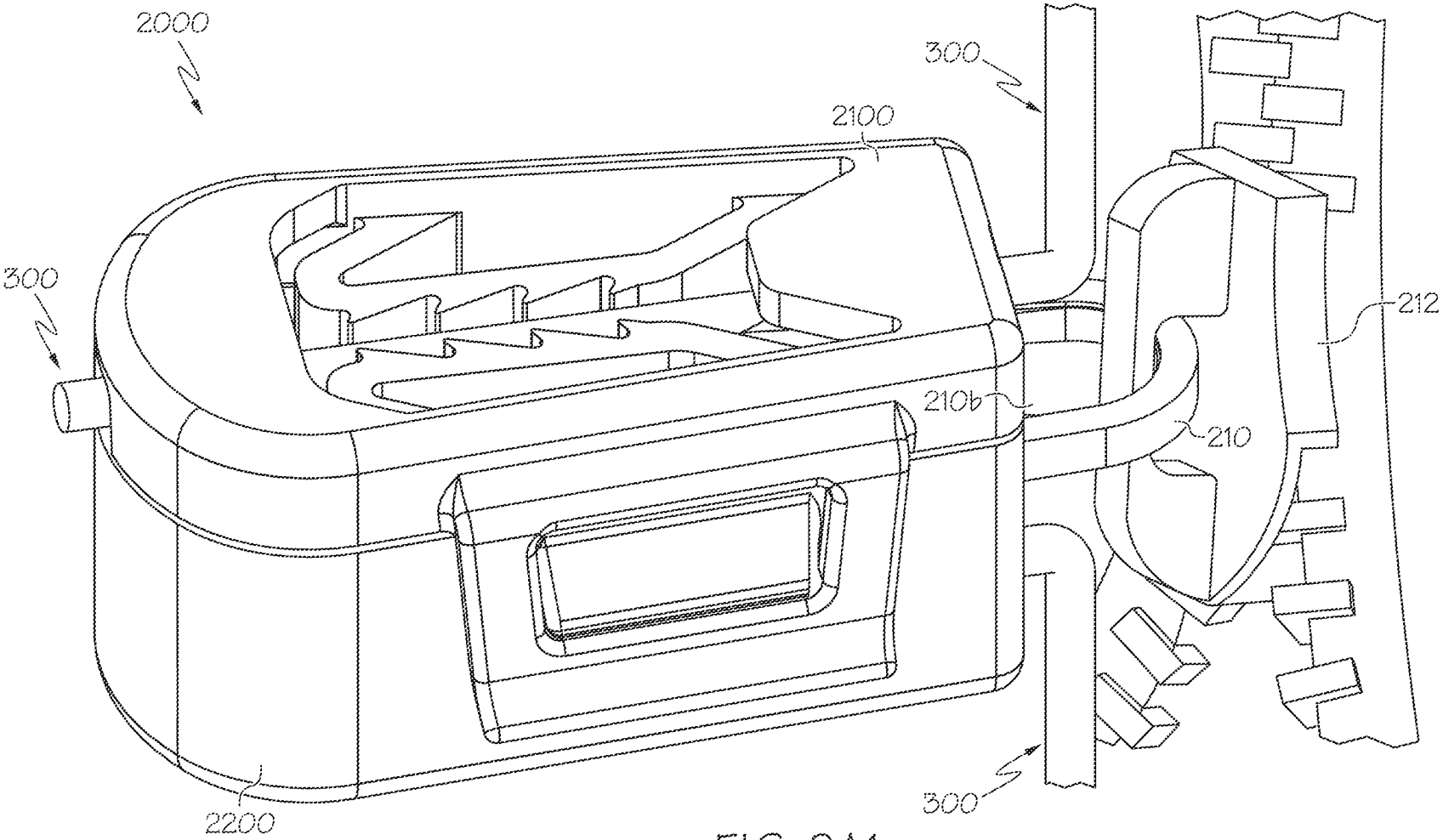
FIG. 2A1

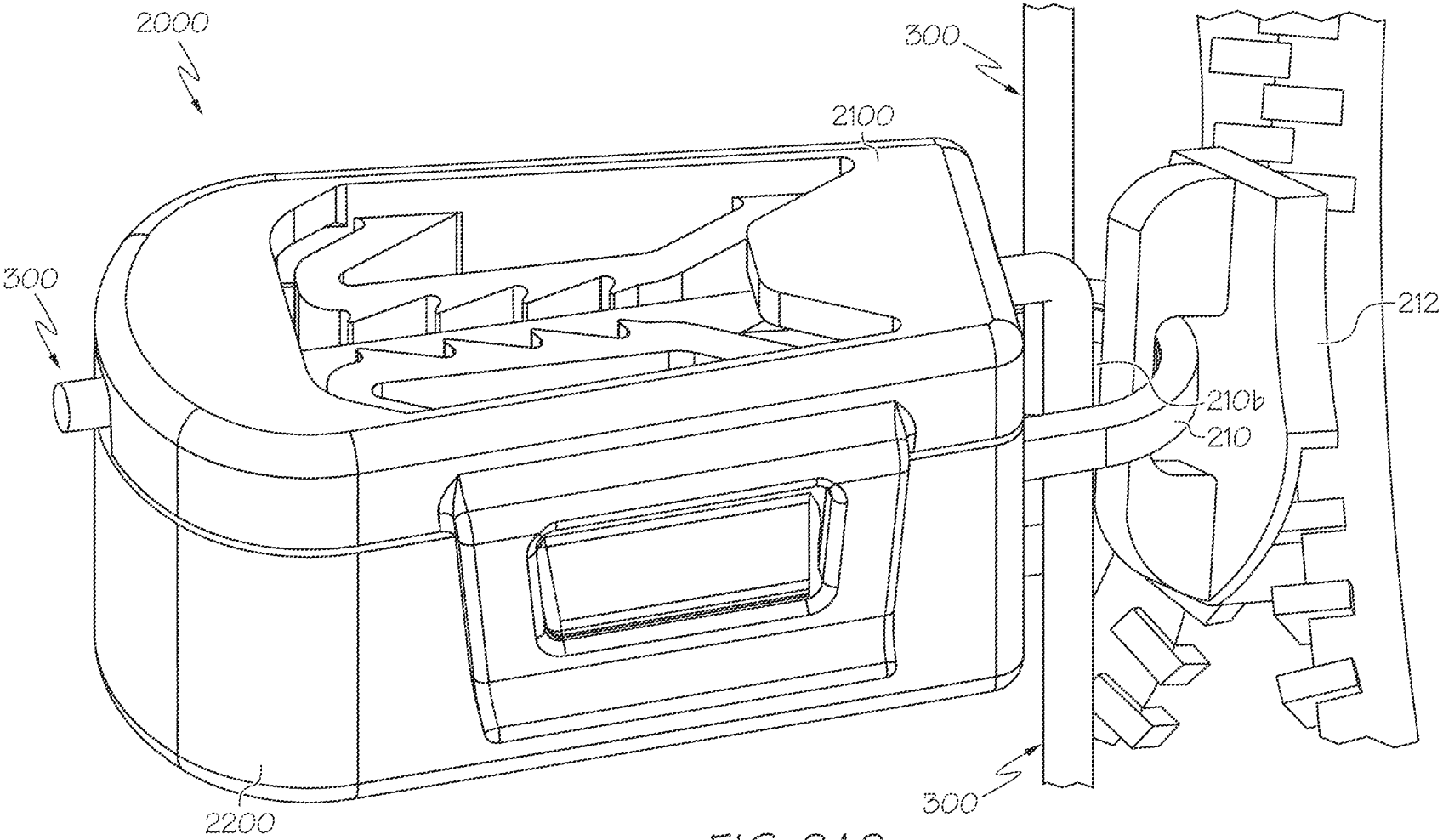
FIG. 2A2

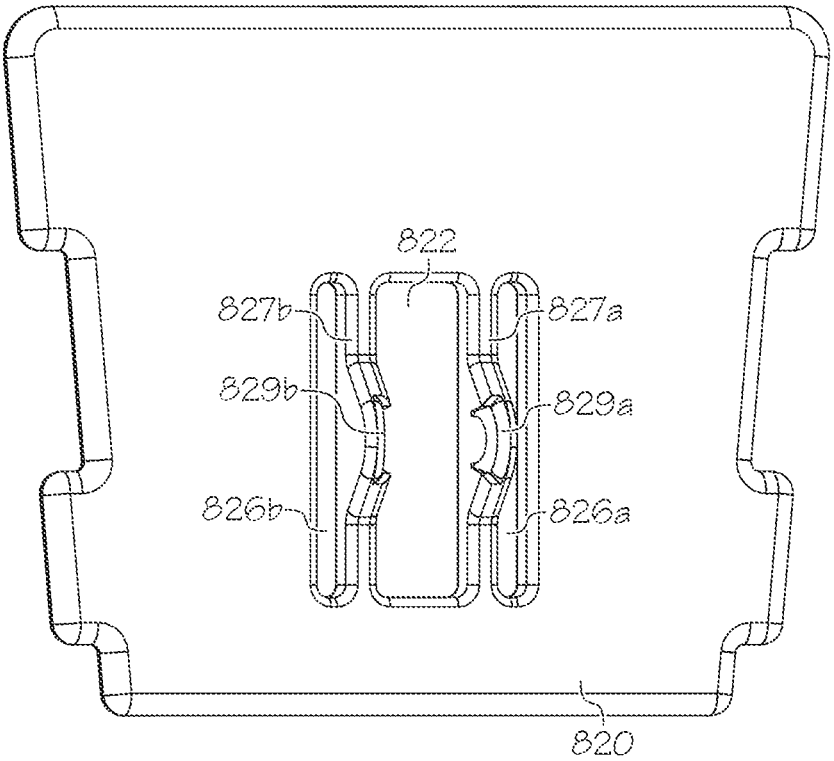
FIG. 9B1

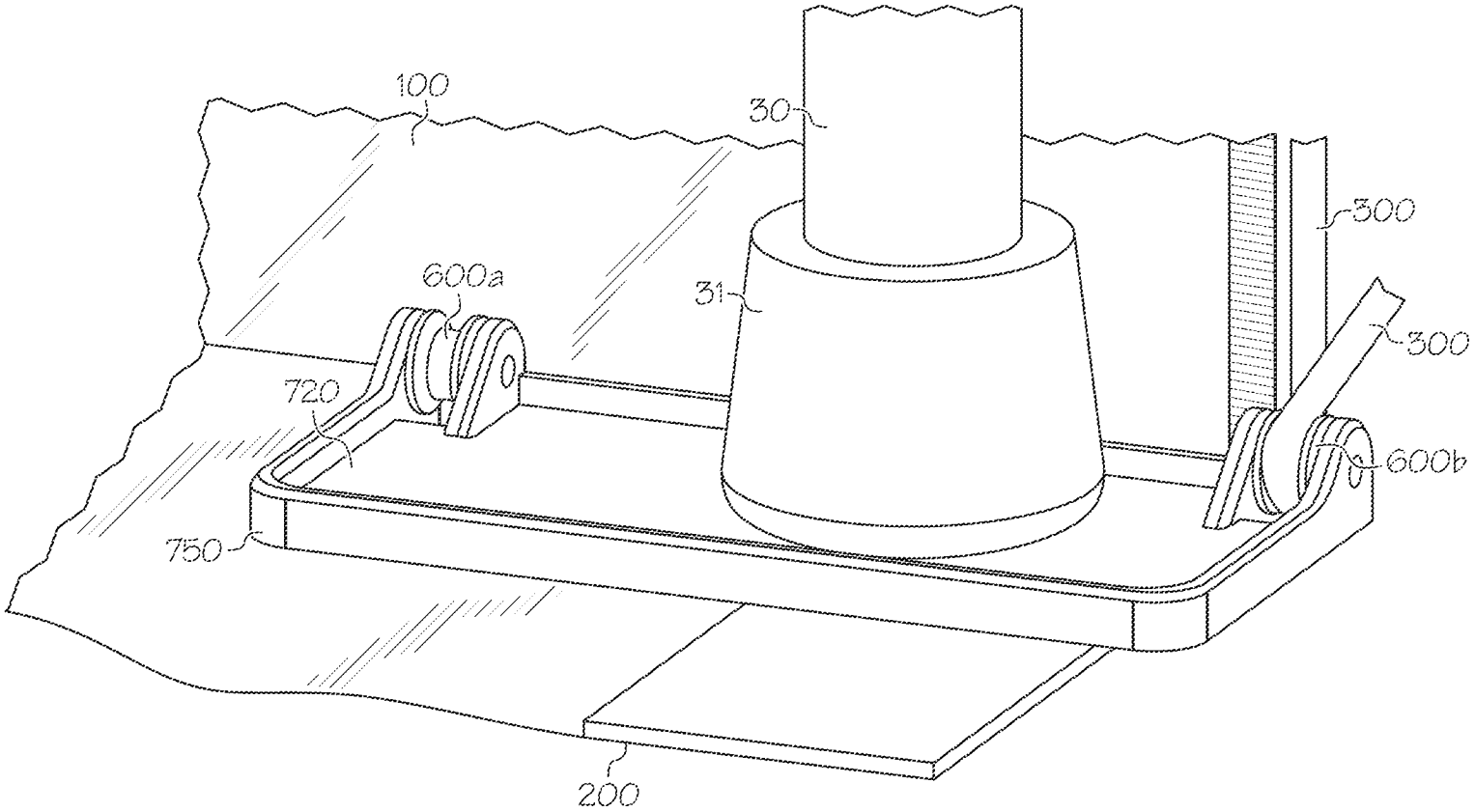
FIG. 14A1

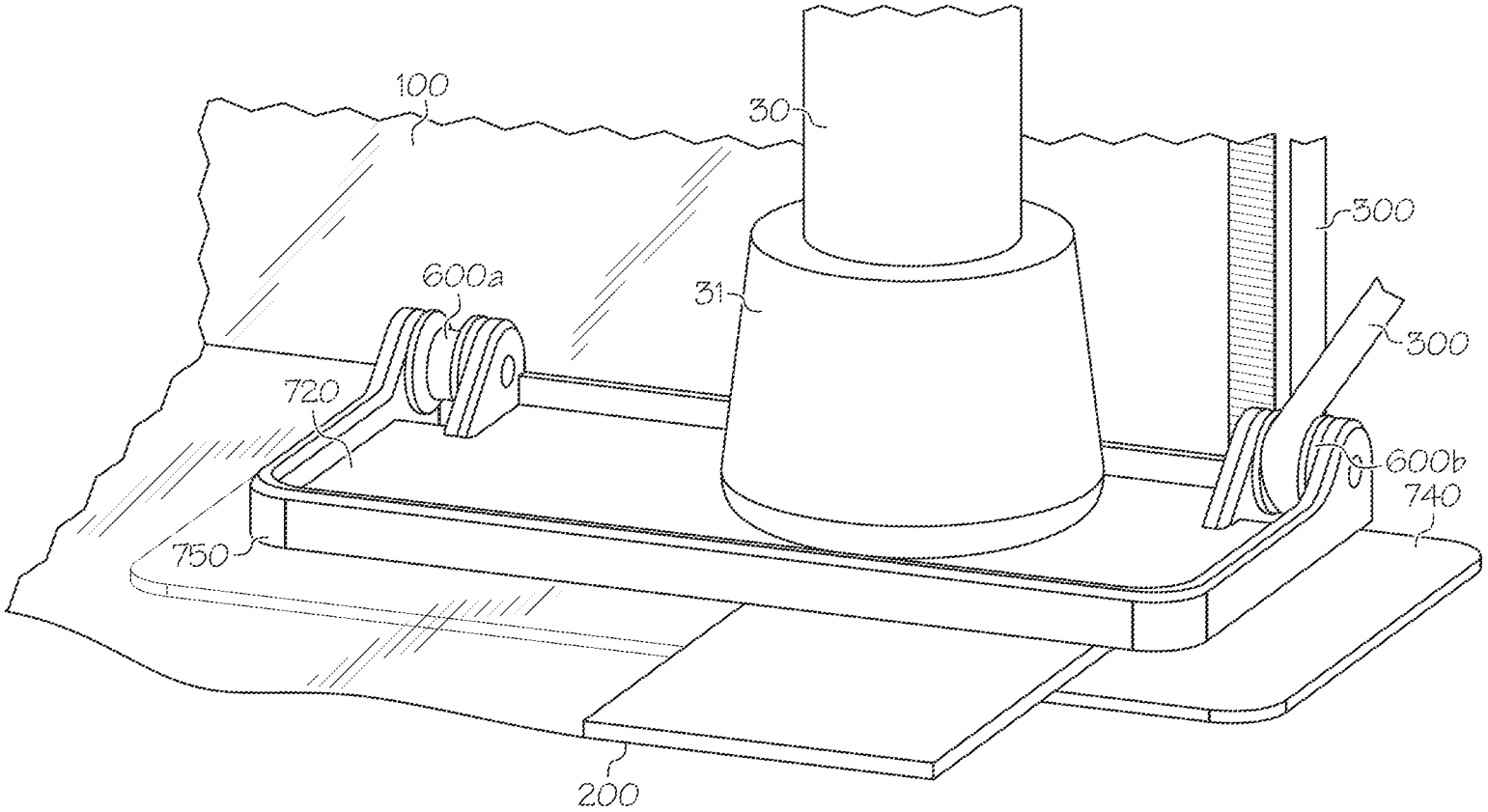
FIG. 14A2

ZIPPER PULL SYSTEM AND METHODS OF USE

RELATED APPLICATIONS

This application is a continuation of U.S. application Ser. No. 17/603,756, filed Oct. 14, 2021, which claims benefit to International Application No.:
PCT/US2020/031284, filed on May 4, 2020, which claims benefit to U.S. Provisional Application Ser. No. 62/842,490, filed May 2, 2019;

U.S. Provisional Application Ser. No. 62/845,786, filed May 9, 2019;

U.S. Provisional Application Ser. No. 62/847,874, filed May 14, 2019; and

U.S. Provisional Application Ser. No. 62/873,834, filed Jul. 12, 2019;

the content of each being incorporated herein by reference, in its entirety.

This application is related to:

U.S. Pat. No. 5,924,469, issued on Jul. 20, 1999,
U.S. Pat. No. 6,564,512, issued on May 20, 2003,
U.S. Pat. No. 7,073,758, issued on Jul. 11, 2006,
U.S. Pat. No. 7,533,712, issued on May 19, 2009,
U.S. Pat. No. 7,658,219, issued on Feb. 9, 2010,
U.S. Pat. No. 7,670,401, issued on Mar. 2, 2010,
U.S. Pat. No. 7,743,512, issued on Jun. 29, 2010,
U.S. Pat. No. 7,717,382, issued on May 18, 2010,
U.S. Pat. No. 9,115,539, issued on Aug. 25, 2015,
U.S. Pat. No. 9,657,514, issued on May 23, 2017,
U.S. Pat. No. 9,663,962, issued on May 30, 2017,
U.S. Pat. No. 10,081,955 issued on Sep. 25, 2018,
U.S. Pat. No. 10,174,514, issued on Jan. 8, 2019,
U.S. Pat. No. 10,428,539, issued on Oct. 1, 2019, Patent Cooperation Treaty Application Serial Number PCT/US16/068493, filed on Dec. 23, 2016, PCT Publication No. WO 2017/117,042, published Jul. 6, 2017, U.S. patent application Ser. No. 16/063,865, filed on Jun. 19, 2018, United States Publication No. 2020-0087935, published Mar. 19, 2020, U.S. patent application Ser. No. 15/822,423, filed on Nov. 27, 2017, United States Publication No. 2018-0154293, published Jun. 7, 2018, Patent Cooperation Treaty Application Serial Number PCT/US19/65102, filed on Dec. 6, 2019, PCT Publication No. 2020/118277, published Jun. 11, 2020, Patent Cooperation Treaty Application Serial Number PCT/US20/13282, filed on Jan. 13, 2020, PCT Publication No. 2020/146862, published Jul. 16, 2020, Patent Cooperation Treaty Application Serial Number PCT/US20/13415, filed on Jan. 13, 2020, PCT Publication No. 2020/146904, published Jul. 16, 2020, the content of each being incorporated herein by reference in its entirety.

BACKGROUND

Partition systems are employed to isolate portions of a building or room, by serving as a barrier to dust, noise, light, odors, and other intrusions. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Other workers setting up a barrier employ tape or other adhesives which could result in paint being removed from the wall or the adhesive material being difficult to remove. The tape usually fails to stick, but, if it does stick, as the tape is removed, paint can pull off with the tape, or adhesive is left behind.

U.S. Pat. Nos. 5,924,469 and 7,658,219, incorporated herein by reference, disclose partition mount systems that address these limitations. These systems utilize a plurality of spring-biased pole mounts that secure a curtain or drape material, such as plastic, cloth, and the like, to form a temporary partition. The disclosed system is a "clean" system configured to be installed and removed without damaging or otherwise marking the ceiling, floor or walls in the construction zone. Assembly is easy and fast and can be accomplished by a single individual. In certain applications, however, a sag, or gap, may be present in the curtain along a pole next to a wall, ceiling, door frame, or other abutting surface, compromising the effectiveness of the installation.

U.S. Pat. No. 7,533,712, the content of which is incorporated herein by reference, discloses a mount system that mitigates or eliminates sag, or gaps, between an installed curtain and an abutting surface such as a wall or ceiling. The system accomplishes this in a manner that avoids permanent damage to the wall or ceiling surface. The system includes a head with an elongated body and a compressible curtain interface. A pole, for example, as described in connection with U.S. Pat. Nos. 5,924,469 and 7,658,219, may be configured to urge the head and the curtain to the abutting surface, thereby eliminating a sag, or gap in the curtain.

In certain configurations, a pole supporting the elongated body of the head may be positioned so as to inhibit human movement. In addition, a single, elongated head may not be long enough to eliminate all of the sag in the partition system, and, thus, multiple poles and corresponding elongated heads may be required.

In some situations, it is desired to have a defined entryway location for ingress into/egress from a partitioned area. Contemporary entryway mechanisms for such systems can employ a zipper mechanism, such as a zippered doorway. Such systems require an operator to manually un-zip the doorway to permit entry/exit and to re-zip the doorway to re-seal the entryway after entry/exit.

SUMMARY

In an aspect, a system comprises a first pulley; a first pulley mount constructed and arranged to couple the first pulley to a curtain including a zipper, the first pulley mount comprising a first portion and a second portion that are removably coupled to each other with a portion of the curtain between them when mounted to the curtain; a second pulley; a second pulley mount constructed and arranged to couple the second pulley in position relative to the curtain; and an elongated pull coupled to the first pulley, the second pulley, and a zipper pull of the zipper.

In another aspect, a system comprises a first pulley; a first pulley mount constructed and arranged to couple the first pulley to a curtain including a zipper, the first pulley positioned at an interior region of the first pulley mount; a second pulley; a second pulley mount constructed and arranged to couple the second pulley in position relative to the curtain; and an elongated pull coupled to the first pulley, the second pulley, and a zipper pull of the zipper.

In another aspect, a system comprises: a first pulley; a first pulley mount constructed and arranged to couple the first pulley to a curtain including a zipper, the first pulley mount comprising a first portion and a second portion that are slidably coupled to each other with a portion of the curtain between them when mounted to the curtain; a second pulley; a second pulley mount constructed and arranged to couple the second pulley in position relative to the curtain; and an elongated pull coupled to the first pulley, the second pulley, and a zipper pull of the zipper.

In another aspect, a system comprises a first pulley; a first pulley mount constructed and arranged to couple the first pulley to a curtain including a zipper; a second pulley; a second pulley mount constructed and arranged to couple the second pulley in position relative to the curtain; an elongated pull coupled to the first pulley, the second pulley, and a zipper pull of the zipper; and a pull coupler that removably secures the elongated pull to the zipper pull.

In some embodiments, the first pulley is positioned at a vertical position that is above a vertical position of the second pulley.

In some embodiments, the first pulley is positioned at a vertical position at a top region of the zipper and wherein the second pulley is positioned at a vertical position at a bottom region of the zipper.

In some embodiments, the first pulley is positioned at a vertical position that is similar to a vertical position of the second pulley.

In some embodiments, the first pulley mount comprises a first pulley housing, wherein the first pulley is positioned at an interior region of the first pulley housing.

In some embodiments, the first pulley housing comprises an aperture and wherein the first pulley is positioned in the aperture.

In some embodiments, the system further comprises a linkage coupling the first pulley to the first pulley mount.

In some embodiments, the first pulley mount is coupled to a pole.

In some embodiments, the first pulley is coupled to an upper portion of the zipper.

In some embodiments, the first pulley is coupled to an upper portion of a zipper tape of the zipper.

In some embodiments, the first pulley is integral with the first pulley mount.

In some embodiments, the first pulley is coupled to a curtain head.

In some embodiments, the first pulley is smaller than 10 mm, 20 mm, or 30 mm in diameter.

In some embodiments, an angular position of the first pulley is electrically controlled.

In some embodiments, an angular position of the first pulley is controlled remotely.

In some embodiments, the first pulley comprises a channel constructed and arranged to interface with the elongated pull.

In some embodiments, the first pulley comprises plastic.

In some embodiments, the first pulley comprises metal.

In some embodiments, an angular position of the first pulley is magnetically controlled.

In some embodiments, the first portion and the second portion of the first pulley mount are suspended on the curtain at a first vertical position.

In some embodiments, first portion is positioned at a first side of the curtain and the second portion is positioned at a second side of the curtain.

In some embodiments, the first portion is slidingly coupled to the second portion.

In some embodiments, the first portion is slidingly coupled to the second portion with the portion of the curtain therebetween.

In some embodiments, the first portion is constructed and arranged to be coupled to and removed from the second portion and removed in a first direction along a first axis and prevented from being coupling to and removed from the second portion in a second direction along a second axis orthogonal to the first axis.

In some embodiments, the second portion comprises one or more claws.

In some embodiments, at least two of the one or more claws are positioned on opposing sides of the second portion.

In some embodiments, the first portion is constructed and arranged to be positioned between the at least two of the one or more claws that are positioned on opposing sides of the second portion.

In some embodiments, the first portion is tapered along its length.

In some embodiments, the second portion is tapered along its length.

In some embodiments, the first portion and second portion are magnetically coupled to each other through the curtain.

In some embodiments, the system further comprises a second pulley housing, wherein the second pulley is positioned at an interior region of the second pulley housing.

In some embodiments, the second pulley housing comprises a linkage coupling the second pulley to the second pulley mount.

In some embodiments, the second pulley mount comprises a plate, wherein the second pulley comprises first and second second pulleys at opposite positions of the plate.

In some embodiments, the second pulley is coupled to a pole.

In some embodiments, the second pulley is coupled to a lower portion of the zipper.

In some embodiments, second pulley is coupled to a lower portion of a zipper tape of the zipper.

In some embodiments, second pulley is integral with the second pulley mount.

In some embodiments, second pulley is smaller than 10 mm, 20 mm, or 30 mm in diameter.

In some embodiments, an angular position of the second pulley is electrically controlled.

In some embodiments, an angular position of the second pulley is controlled remotely.

In some embodiments, the second pulley comprises a channel constructed and arranged to interface with the elongated pull.

In some embodiments, the second pulley comprises plastic.

In some embodiments, the second pulley comprises metal.

In some embodiments, an angular position of the second pulley is magnetically controlled.

In some embodiments, the second pulley mount comprises a base plate and a linkage.

In some embodiments, base plate is constructed and arranged to be held in position relative to the curtain by a base of a pole positioned on the base plate.

In some embodiments, base plate is larger in area than a cross-sectional area of the diameter of a pole.

In some embodiments, linkage of the second pulley couples the base plate to the second pulley.

In some embodiments, the second pulley is integral with the second pulley mount.

In some embodiments, the second pulley mount comprises a base plate.

In some embodiments, the second pulley is positioned at a corner region of the base plate.

In some embodiments, the second pulley comprises first and second second pulleys integral with the second pulley mount.

In some embodiments, the first second pulley is positioned at a first corner region of the base plate and the second second pulley is positioned at a second corner region of the base plate.

In some embodiments, the elongated pull comprises a string.

In some embodiments, the elongated pull comprises metal.

In some embodiments, the elongated pull is bonded to the zipper pull.

In some embodiments, the elongated pull is tied to the zipper pull.

In some embodiments, the elongated pull is magnetically coupled to the zipper pull.

In some embodiments, the system further comprises a pull coupler that removably secures the elongated pull to the zipper pull.

In another aspect, a pull coupler comprises: a first portion comprising a first portion channel, the first portion channel constructed and arranged to engage with an elongated pull; and a second portion coupled to the first portion, the second portion constructed and arranged to couple with a zipper pull.

In some embodiments, the first portion comprises one or more teeth and one or more of the one or more teeth are positioned along at least a portion of a first side of the first portion channel.

In some embodiments, the first portion comprises four teeth along a portion of the first side of the first portion channel.

In some embodiments, one or more of the one or more teeth are positioned along at least a portion of a second side of the first portion channel.

In some embodiments, the first portion comprises four teeth along a portion of the second side of the first portion channel.

In some embodiments, the pull coupler further comprises at least one hinge.

In some embodiments, the at least one hinge rotatably couples the first portion and the second portion.

In some embodiments, the pull coupler comprises two hinges.

In some embodiments, the first portion comprises at least one front opening.

In some embodiments, the first portion comprises one front opening.

In some embodiments, the first portion comprises at least one rear opening.

In some embodiments, the first portion comprises one rear opening.

In some embodiments, the first portion comprises a curved front surface.

In some embodiments, the second portion comprises at least one rear opening.

In some embodiments, the second portion comprises one rear opening.

In some embodiments, the second portion 2200 comprises a pull mount constructed and arranged to couple with the opening of a zipper pull.

In some embodiments, the second portion comprises one or more lower supports constructed and arranged to be positioned below a zipper pull and position the zipper pull at a desired height.

In some embodiments, the second portion comprises four lower supports.

In some embodiments, the second portion comprises one lower support that extends around the second portion.

In some embodiments, the one or more lower supports are positioned at the edge of the second portion.

In some embodiments, the second portion comprises one or more upper supports constructed and arranged to be positioned above a zipper pull and position the zipper pull at a desired height.

In some embodiments, the second portion comprises four upper supports.

In some embodiments, the second portion comprises one upper support that extends around the second portion.

In some embodiments, the pull coupler further comprises a locking mechanism constructed and arranged to secure the first portion to the second portion.

In some embodiments, the locking mechanism comprises a first portion and a second portion, the first portion of the locking mechanism and the second portion of the locking mechanism being constructed and arranged to mate with one another.

In some embodiments, the locking mechanism comprises a button.

In some embodiments, the locking mechanism comprises a pin and slot.

In some embodiments, the locking mechanism comprises a lock and key.

In some embodiments, the locking mechanism comprises a hook and loop mechanism.

In another aspect, a method comprising the steps of: providing a first pulley mount; coupling the first pulley mount to a curtain, the first pulley mount comprising a first portion and a second portion that are slidably coupled to each other with a portion of the curtain between them when mounted to the curtain; providing a second pulley mount; providing a first pulley; coupling the first pulley to the first pulley mount; providing a second pulley; coupling the second pulley to the second pulley mount; providing an elongated pull; and coupling the elongated pull to the first pulley, the second pulley, and a zipper pull of a zipper.

In another aspect, a system, comprises: a first pulley; a first pulley mount constructed and arranged to couple the first pulley to a curtain; a second pulley; a second pulley mount constructed and arranged to couple the second pulley in position relative to the curtain; an elongated pull coupled to the first pulley, the second pulley, and a zipper pull of a zipper; and a pull coupler, comprising: a first portion comprising a first portion channel, the first portion channel constructed and arranged to engage with an elongated pull; and a second portion coupled to the first portion, the second portion constructed and arranged to couple with a zipper pull.

In another aspect, a method comprises the steps of: providing an elongated pull comprising a first end and a second end; providing a pull coupler, comprising: a first portion, comprising: a first portion channel, a rear opening, and a front opening, wherein the first portion channel constructed and arranged to engage with an elongated pull; and a second portion coupled to the first portion, the second portion comprising a rear opening, the second portion constructed and arranged to couple with a zipper pull; inserting the first end of the elongated pull into the rear opening of the second portion; knotting the first end of the elongated pull inside the second portion, the knot being wider than the rear opening of the second portion, the knot being constructed and arranged to prevent the first end of the elongated pull from leaving the pull coupler; and inserting the second end of the elongated pull into the rear opening of the first portion and through the first portion channel In some embodiments, the first portion of the pull coupler further comprises a first extension.

In some embodiments, the first extension comprises at least one opening constructed and arranged to improve the flexibility of the first extension.

In some embodiments, the pull coupler further comprises a second extension.

In some embodiments, the second extension comprises at least one opening constructed and arranged to improve the flexibility of the second extension.

In some embodiments, the first extension and/or the second extension comprise one or more teeth.

In some embodiments, the one or more teeth are constructed and arranged such that the one or more teeth of the first extension face the one or more teeth of the second extension.

In some embodiments, the first and second extensions are constructed and arranged such that the first portion channel passes between the one or more teeth of the first extension and the one or more teeth of the second extension.

In some embodiments, the method further comprises the step of passing the second end of the elongated pull through the first portion channel of the first portion.

In some embodiments, the first portion channel is constructed and arranged such that the elongated pull can easily pass through the first portion channel in one direction and cannot easily pass through the first portion channel in another direction.

In some embodiments, the first portion channel is constructed and arranged such that the elongated pull can easily pass through the first portion channel from the rear end of the first portion towards the front end of the first portion.

In some embodiments, the first portion channel is constructed and arranged such that the elongated pull cannot easily pass through the first portion channel from the front end of the first portion towards the rear end of the first portion.

In some embodiments, the method further comprises the step of inserting the second end of the elongated pull through the front opening of the first portion.

In some embodiments, the front opening of the first portion is constructed and arranged to be aligned with the rear opening of the first portion.

In another aspect, a method of assembling a system comprises the steps of: providing a first pulley mount comprising a first pulley; providing a curtain comprising a zipper, the zipper comprising a top region and a bottom region; coupling the first pulley mount to the curtain at a position above the top region of the zipper; providing a second pulley mount comprising a second pulley at a bottom region of the zipper opposite the top region of the zipper, mounting a pole relative to the zipper so that a lower end of the pole communicates with a portion of the second pulley mount; coupling an elongated pull to the first pulley and second pulley so that a first portion of the elongated pull is at a first surface of the curtain and so that a second portion of the elongated pull is at a second surface; and coupling the elongated pull to a zipper pull of the zipper at a pull coupler that mechanically clamps the elongated pull in position at the zipper pull.

In some embodiments, the first pulley is positioned at an interior region of the first pulley mount.

In some embodiments, the first portion and a second portion are slidably coupled to each other with a portion of the curtain between them when mounted to the curtain.

In some embodiments, the method further comprises coupling a pull coupler to removably secure the elongated pull to the zipper pull.

BRIEF DESCRIPTION OF THE DRAWINGS

The foregoing and other features and advantages of the inventive concepts will be apparent from the more particular description of embodiments of the inventive concepts, as illustrated in the accompanying drawings in which like reference characters refer to the same parts throughout the different views. The drawings are not necessarily to scale, emphasis instead being placed upon illustrating the principles of the inventive concepts.

FIGS. 1C and 1C1 are perspective views of an installer installing an embodiment of a second pulley mount under the pole and near the bottom of the zipper, in accordance with aspects of the present inventive concepts.

FIGS. 1D, 1D1, and 1D2 are a perspective views of an installer installing an embodiment of a first pulley mount, in accordance with aspects of the present inventive concepts.

FIGS. 1E and 1E1 are a perspective views of an installer installing an embodiment of an elongated pull through an opening above the zipper, in accordance with aspects of the present inventive concepts.

FIGS. 1F and 1F1 are a perspective views of an installer installing an embodiment of an elongated pull around a second pulley, in accordance with aspects of the present inventive concepts.

FIGS. 1G and 1G1 are perspective views of an installer installing an embodiment of an elongated pull to a pull coupler, in accordance with aspects of the present inventive concepts.

FIGS. 1H and 1H1 are perspective views of an installer installing an embodiment of an elongated pull and a zipper pull to a pull coupler, in accordance with aspects of the present inventive concepts.

FIGS. 1I and 1I1 are perspective views of an installer using an embodiment of a zipper pull system, in accordance with aspects of the present inventive concepts.

FIGS. 1J and 1J1 are perspective views of an installer using an embodiment of a zipper pull system, in accordance with aspects of the present inventive concepts.

FIGS. 1K and 1K1 are perspective views of an installer passing through an opening in the curtain, after using an embodiment of a zipper pull system, in accordance with aspects of the present inventive concepts.

FIGS. 1L and 1L1 are perspective views of an installer using an embodiment of a zipper pull system, in accordance with aspects of the present inventive concepts.

FIG. 2 is a perspective view of an embodiment of an elongated pull securely coupled to a zipper pull, in accordance with aspects of the present inventive concepts.

FIG. 2A1 is a perspective view of an embodiment of a pull coupler, a zipper pull, and an elongated pull, in accordance with the present inventive concepts.

FIG. 2A2 is a perspective view of an embodiment of a pull coupler, a zipper pull, and an elongated pull, in accordance with the present inventive concepts.

FIG. 2I is a perspective view of the pull coupler of FIG. 2B and an elongated pull, in accordance with aspect of the present inventive concepts.

FIG. 9B1 is a perspective rear view of an embodiment of a tapered first portion, in accordance with aspects of the present inventive concepts.

FIG. 9I is a perspective view of an embodiment of a curved first pulley mount mounted to a curtain, in accordance with aspects of the present inventive concepts.

FIG. 14A1 is a perspective view of an embodiment of a base plate including multiple second pulleys, for example, a first second pulley and a second second pulley, in accordance with aspects of the present inventive concepts.

FIG. 14A2 is a perspective view of an embodiment of a base plate including multiple second pulleys, for example, a first second pulley and a second second pulley, in accordance with aspects of the present inventive concepts.

DETAILED DESCRIPTION OF EMBODIMENTS

Figure 1:
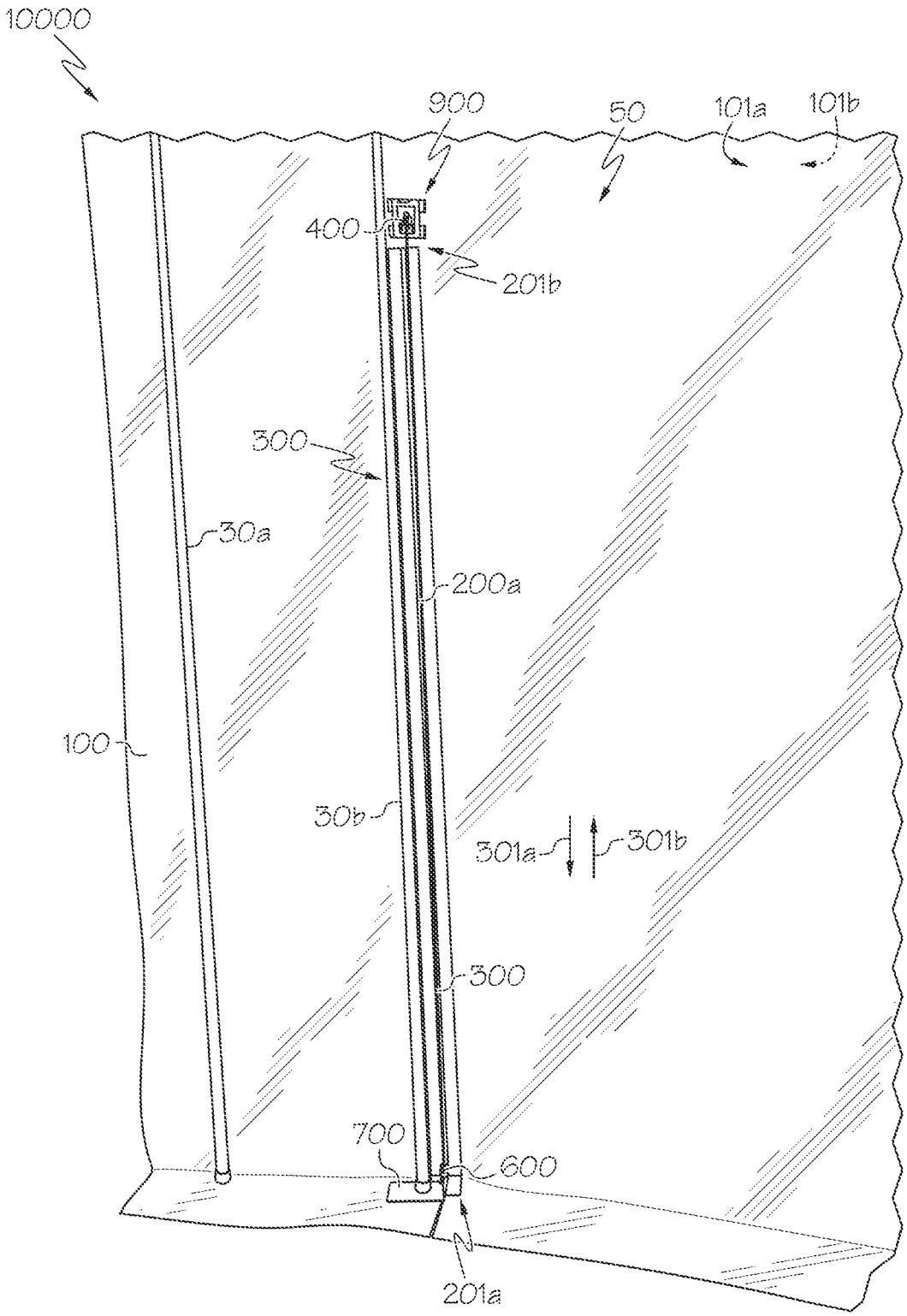
FIG. 1 is a perspective view of an embodiment of a zipper pull system, in accordance with aspects of the present inventive concepts.

Various example embodiments will be described more fully hereinafter with reference to the accompanying drawings, in which some example embodiments are shown. The present inventive concepts may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. A first element may be said to be "transverse" to a second element if the first element has a direction of extension that is not parallel to the direction of extension of the second element.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in such shapes.

FIG. 1 is a perspective view of an embodiment of a zipper pull system 10000, in accordance with aspects of the present inventive concepts. In the embodiment shown in FIG. 1, one or more spring-biased pole mounts 30*a*, 30*b*, 30*c* (see, for example, FIG. 1B) secure a curtain 100 or drape material, such as plastic, cloth, and the like, to form a temporary partition. In some embodiments, the curtain 100 comprises one or more zippers 200 constructed and arranged to form a doorway region 50. In the embodiment shown in FIG. 1, the curtain 100 comprises a zipper arranged to form a doorway region 50. When the zipper 200 is open, the curtain 100 comprises an opening 70 (see FIG. 3). In some embodiments, the opening 70 is constructed and arranged to allow an operator to pass through. Although the embodiment shown in FIG. 1 comprises one zipper 200, alternative embodiments comprise a different number of zippers.

In some embodiments, the one or more zipper 200 comprises zipper tape. In some embodiments, the zipper tape comprises a left portion and a right portion, each, for example including opposed zipper teeth. In such embodiments, when the zipper is in the open state, a zipper pull 210 of the zipper 200 is coupled to teeth at either the left portion of the zipper tape or the right portion of the zipper tape.

In the embodiment shown in FIG. 1, the zipper pull system 10000 comprises an elongated pull 300 securely coupled to the zipper pull 210 (see FIG. 2), a first pulley 400, and a second pulley 600. In this embodiment, the elongated pull 300 extends in a direction at a first side 101*a*, for example near a front surface, of the curtain 100 and is securely coupled to the zipper pull 210, which is likewise located at the first side 101*a* of the curtain 100. In this embodiment, the elongated pull 300 is coupled to a first pulley 400 positioned near the top 201*b* of the zipper 200. In this embodiment, the elongated pull 300 passes through a first hole 22 (see for example, FIG. 7) in the curtain 100 and extends in a direction along a second side 101*b*, for example near a rear surface, of the curtain 100 toward and through a second pulley 600 positioned near the bottom 201*a* of the zipper 200.

In alternative embodiments, the elongated pull 300 passes below the curtain 100 and emerges back at the first side 101*a* of the curtain 100 at a position at, or near, a bottom 201*b* of the zipper 200.

In alternative embodiments, the elongated pull 300 passes through a first hole 22 (see for example, FIG. 7) in the curtain 100 and extends in a direction along a second side 101*b* of the curtain 100 toward a second pulley 600 positioned near the bottom 201*a* of the zipper 200. In such alternative embodiments, the elongated pull 300 passes through a second hole 24 (see for example, FIG. 21) and emerges back at the first side 101*a* of the curtain 100 at a position at, or near, a bottom 201*b* of the zipper 200.

In FIG. 1, the first pulley mount 500 secures the first pulley 400 to the curtain 100 at a position at, or near, a top of the zipper 200. In FIG. 1, the second pulley mount 700 secures the second pulley 600 at or near a bottom 201*a* of the zipper 200. In some embodiments, the user can open the zipper 200 by moving the elongated pull 300 in a first direction relative to the first pulley 400 and the second pulley 600. In some embodiments, the user can close the zipper 200 by moving the elongated pull 300 in a second direction relative to the first pulley 400 and the second pulley 600.

In the embodiment shown in FIG. 1, the zipper pull system 10000 is arranged vertically. In this embodiment, the user can open the zipper 200 by moving the elongated pull 300 in an upward direction 301*b*. In this embodiment, a user can close the zipper 200 by moving the elongated pull 300 in a downward direction 301*a*. In alternative embodiments, moving the elongated pull in an upward direction closes the zipper. In alternative embodiments, moving the elongated pull in a downward direction opens the zipper.

In the embodiment, shown in FIG. 1, if the user is on the second side 101*b* of the curtain 100, the directions corresponding to opening and closing the zipper 200 are reversed. In this embodiment, from the second side 101*b* of the curtain 100, moving the elongated pull 300 in the upward direction 301*b* will close the zipper 200.

In alternative embodiments, the zipper pull system 10000 is not arranged vertically. In such embodiments, in order to open/close the zipper, the user may need to move the elongated pull in a direction with both a vertical and/or horizontal component.

In some embodiments, for example in the present illustrative embodiment, the elongated pull 300 comprises a rope. In alternative embodiments, the elongated pull 300 comprises a different elongated material that is constructed and arranged to transfer tension, including, but not limited to, string, wire, cables, ribbon, belt, or any such suitable material. In alternative embodiments, the position and movement of the elongated pull 300, for example in an upward and downward direction 301*b*, 301*a* is controlled remotely.

In some embodiments, a zipper pull system 10000 is assembled by first mounting a pole 30*a* between first and second surfaces, for example between a floor and a ceiling of a building. In some embodiments, a curtain 100 is coupled to the pole 30*a*, and the pole 30*a* operates to create vertical tension in the curtain 100 between the floor and the ceiling. Neighboring poles 30*c*, etc. (see, for example, FIG. 1A), likewise mounted, operate to create horizontal tension in the curtain. In this manner, the pole system creates vertical and horizontal tension in the curtain, which tension is transferred to similarly tension the zipper 200. At least one of the poles, for example pole 30*b* in the present example of FIG. 1, is mounted so that the foot 31 (see FIG. 4) of the pole 30*b* is proximal a lower portion 201*a* of the zipper 200. In some embodiments, a first pulley mount 500 and a first pulley 400 are mounted to a region of the curtain 100 above an upper portion 201*b* of the zipper 200. In some embodiments, a second pulley mount 700 and a second pulley 600 are mounted at or near the lower portion 201*a* of the zipper 200. In some embodiments, an elongated pull 300 is coupled to the first pulley 400, the second pulley 600, and securely coupled to a zipper pull 210. In this manner, the elongated pull 300 is sufficiently tensioned between the first pulley 400 and second pulley 600 so as to form an elongated loop of material that passes along the first, front side 101*a* and second, rear side 101*b* of the curtain 100, passing through an upper portion of the curtain 100 at an upper opening at or near the first pulley 400 and passing through a lower portion of the curtain 100 at or near the second pulley 600. In some embodiments the elongated pull 300 passes through the lower portion of the curtain 100 at or near a lower opening in the curtain at or near the second pulley 600. In other embodiments the elongated pull 300 passes through the lower portion of the curtain 100 at or near a lower opening in the zipper 200 at or near the second pulley 600. In some embodiments, manually grasping the elongated pull 300 and pulling the elongated pull 300 in one direction, for example in the upward direction 301*b*, opens the zipper 200 and manually grasping and pulling the elongated pull 300 in the opposite direction for example in the downward direction 301*a* closes the zipper 200. Accordingly, an operator can stand at normal height and open and close the zipper 200 no matter the position of the zipper pull 210. In this manner, the elongated pull 300 operates as an extension of the zipper pull 210, eliminating the need for an operator to bend over and reach downward for the zipper pull 210 when it is positioned below the operator's body, and similarly eliminating the need for an operator to reach upward for the zipper pull 210 when it is positioned above the operator's body. During the opening and closing process the first pulley mount 400 is sufficiently secured to the curtain 100 to withstand the tension applied to the elongated pull 300 and, accordingly, the pulley 400. Similarly, during this process the second pulley mount 700 is sufficiently secured in position to withstand the tension applied to the elongated pull 300 and, accordingly, the pulley 600.

In the embodiment shown in FIG. 1, the zipper pull system 10000 is coupled to a zipper 200 oriented in a vertical direction, for example positioned between a floor and ceiling of a room or between surfaces of an object. In alternative embodiments, the zipper pull system 10000 is coupled to a zipper oriented in a horizontal direction, for example positioned between walls of a room or between surfaces of an object. In alternative embodiments, the zipper pull system 10000 is coupled to a zipper oriented in a direction with both vertical and horizontal components, for example between walls, floors, or ceilings of a room or between surfaces of an object.

FIGS. 1A-1L are perspective views illustrating an installer 99 installing an embodiment of a zipper pull system 10000, in accordance with aspects of the present inventive concepts.

Figure 1A:
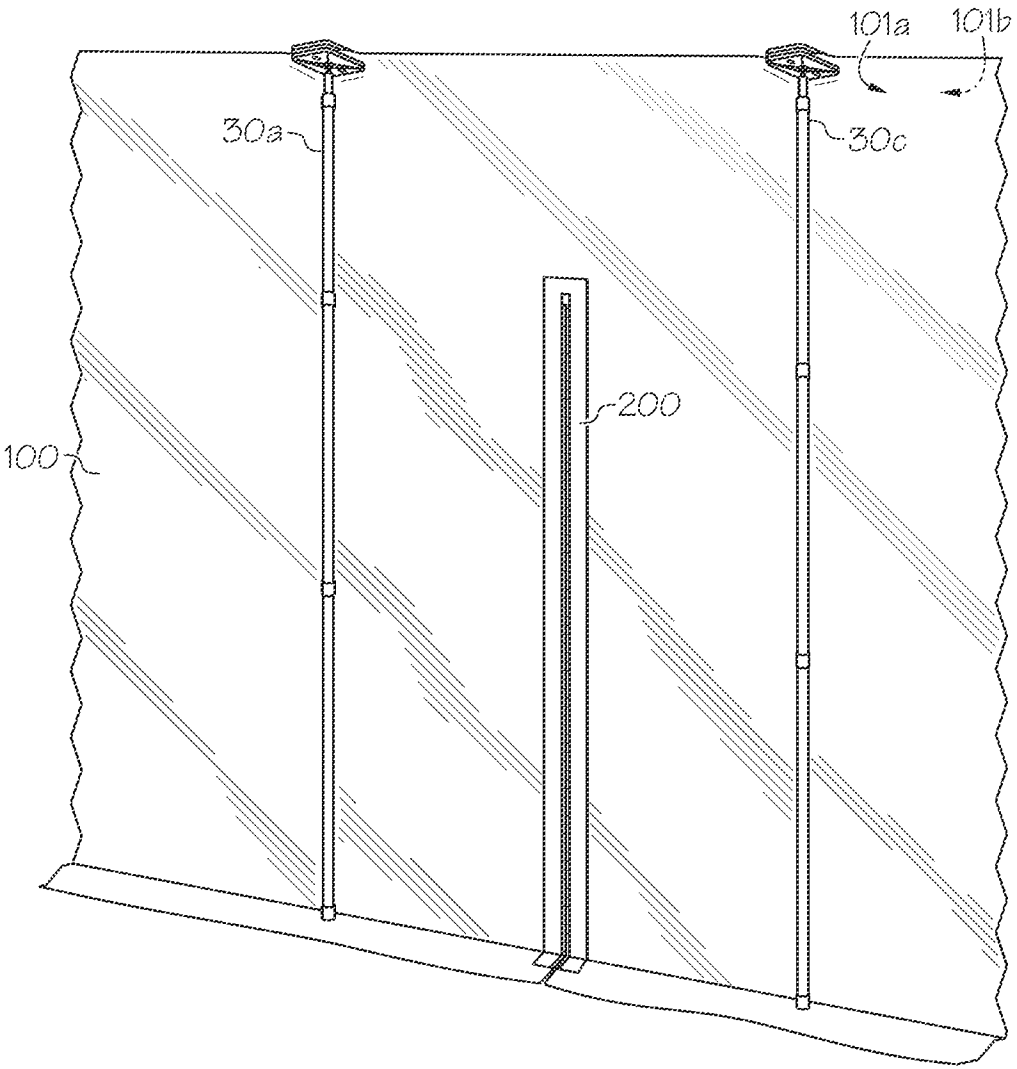
FIG. 1A is a perspective view of an embodiment of a curtain mounted between two poles, in accordance with aspects of the present inventive concepts.

FIG. 1A is a perspective view of an embodiment of a curtain 100 mounted between two poles 30*a*, 30*c*, in accordance with aspects of the present inventive concepts. The curtain 100 includes a zipper 200. In some embodiments, such as the one in FIG. 1A, the zipper comprises zipper tape. In some embodiments, such as this one, the zipper tape comprises a left portion and a right portion. In such embodiments, when the zipper is in the open state, the zipper pull is coupled to either the left portion of the zipper tape or the right portion of the zipper tape. In some embodiments, the zipper tape extends onto the floor. In alternative embodiments, the zipper tape does not extend onto the floor. In alternative embodiments, the number and/or arrangement of the poles may be different. In some embodiments, the zipper 200 can be pre-attached to the curtain 100. In some embodiments, the zipper 200 can be attached to the curtain at the time of the present-described illustrated installation.

In the embodiment shown in FIG. 1A the curtain 100 is arranged such that it extends in a linear manner. In alternative embodiments, the curtain 100 is arranged such that it extends in a curved manner. In the embodiment shown in FIG. 1A, both the first pole 30*a* and the second pole 30*c* are positioned at a first side 101*a* of the curtain 100. In alternative embodiments, the first 30*a* and/or second pole 30*c* is positioned at a second side 101*b* of the curtain 100.

Figure 1B:
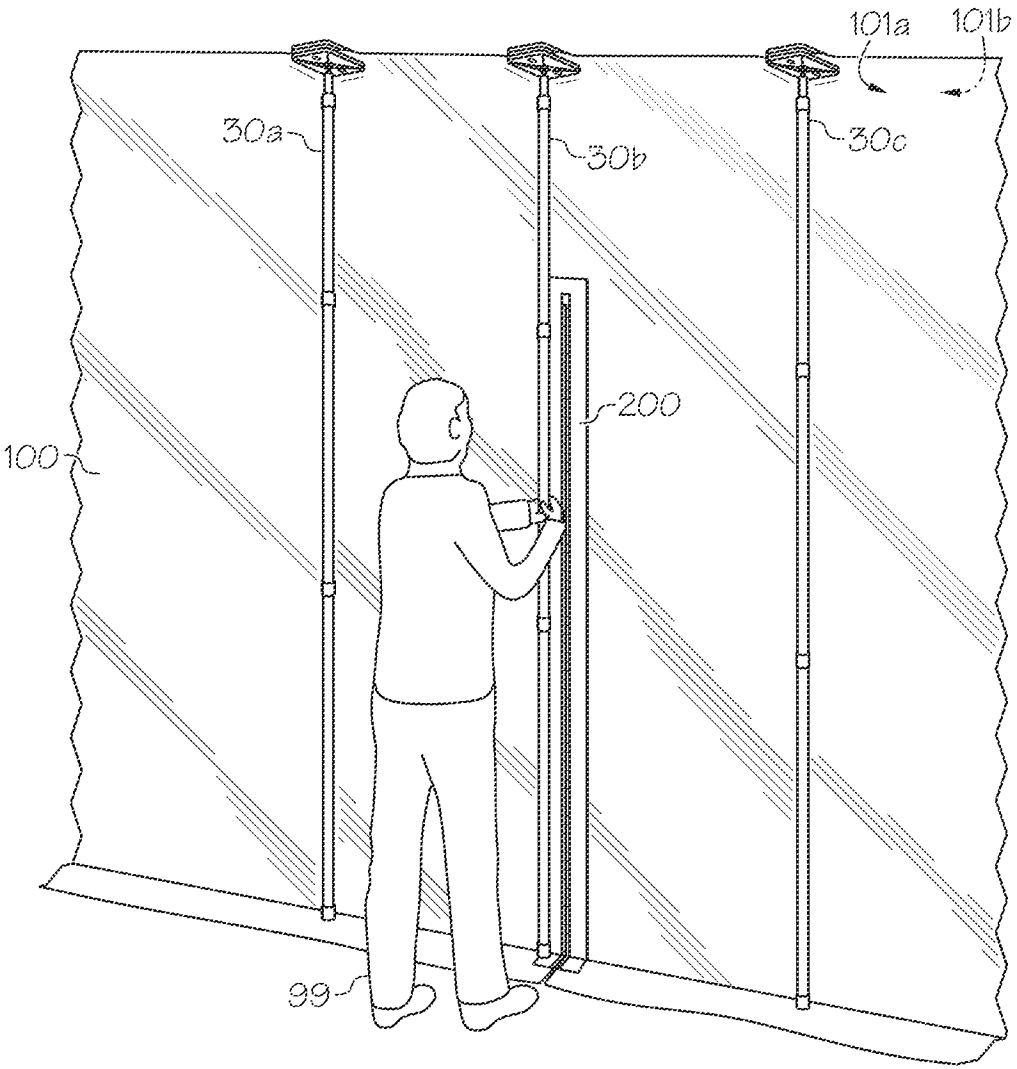
FIG. 1B is a perspective view of an embodiment of an installer installing an additional pole near the zipper, in accordance with aspects of the present inventive concepts.

FIG. 1B is a perspective view of an embodiment of an installer 99 installing an additional pole 30*b* near the zipper 200, in accordance with aspects of the present inventive concepts. In the embodiment shown in FIG. 1B, the additional pole 30*b* is added to the left of the zipper 200 (as seen from a first side 101*a*). In alternative embodiments, the additional pole 30*b* is added to the right of the zipper 200.

Figure 1C:
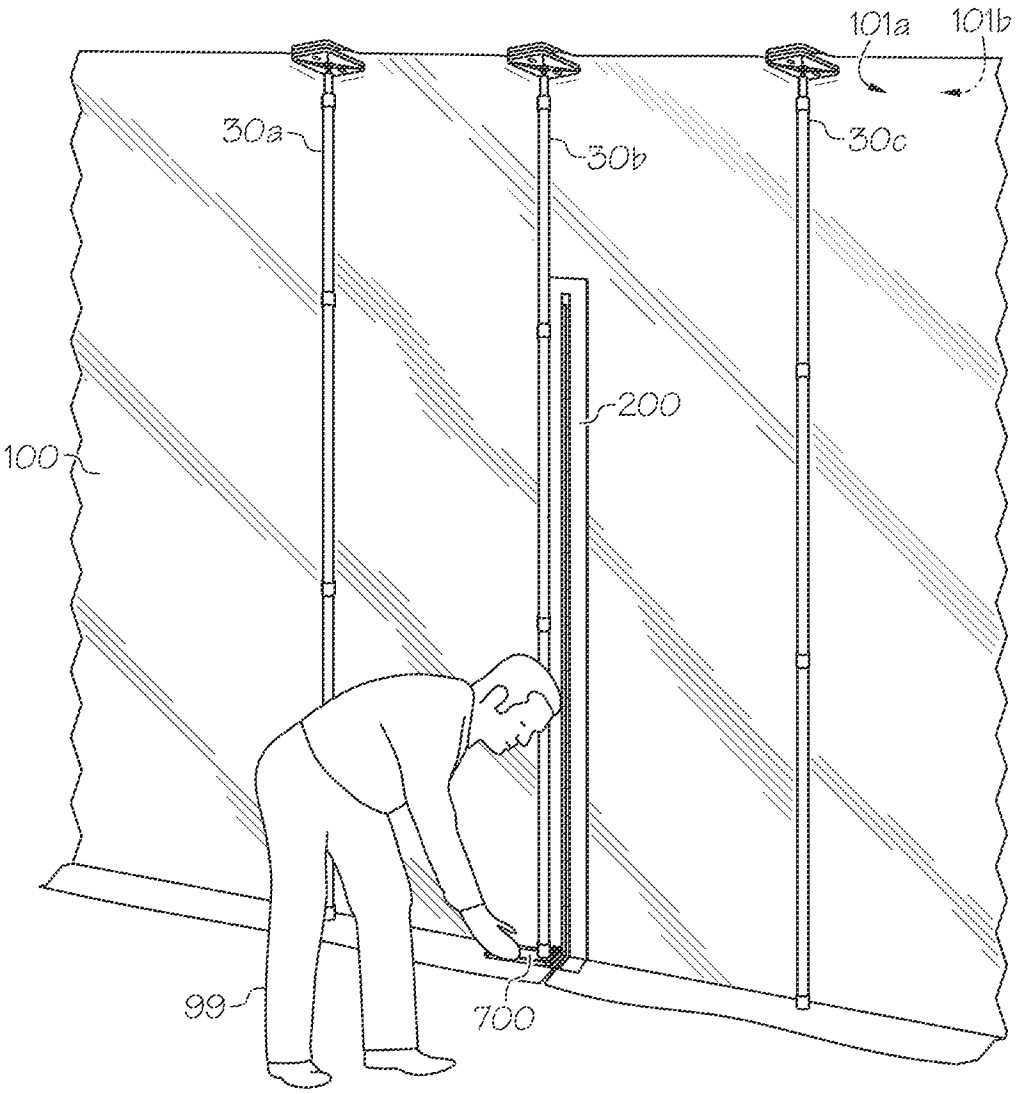
Figure 13:
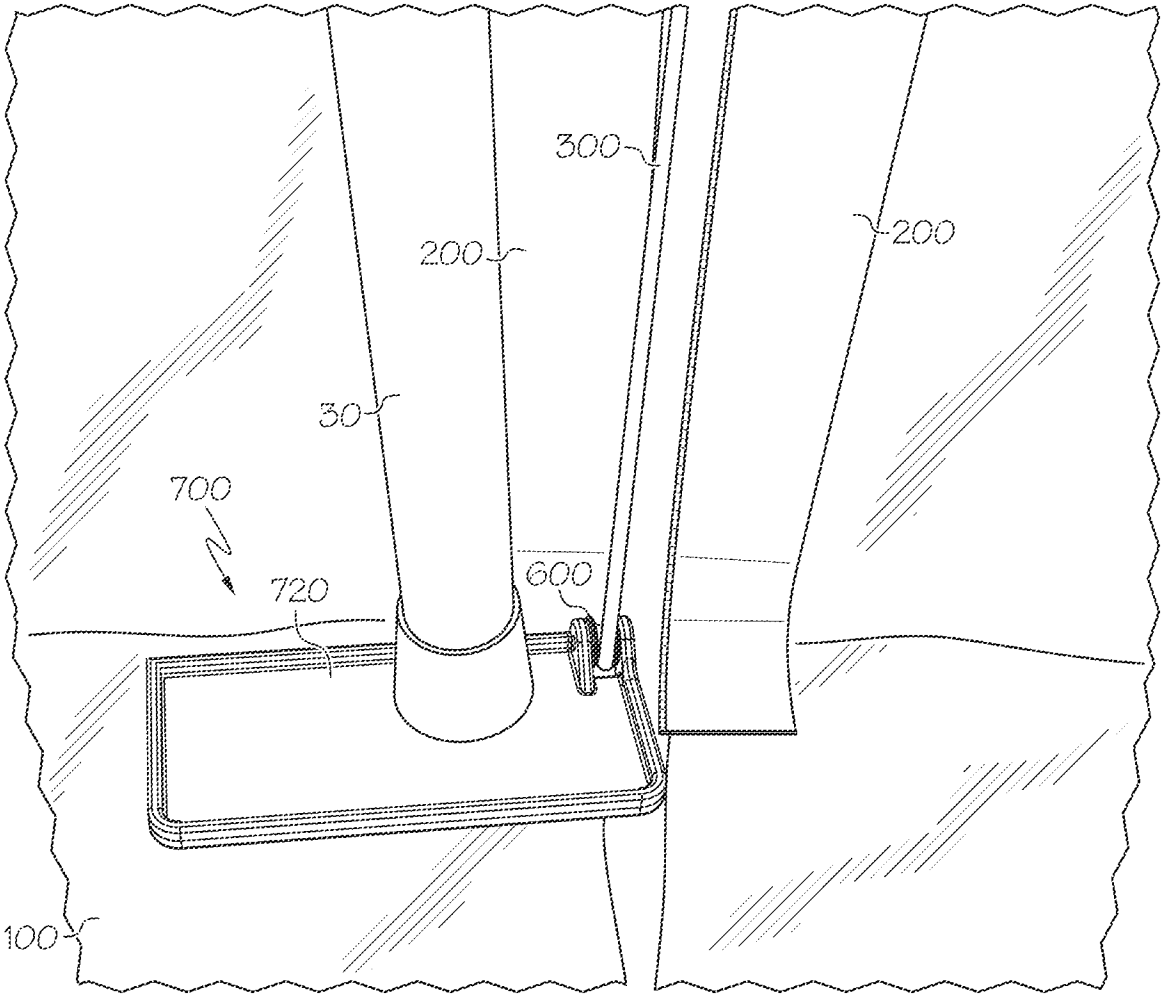
FIG. 13 is a perspective view of an embodiment of the second pulley and the second pulley mount, in accordance with aspects of the present inventive concepts.

FIGS. 1C and 1C1 are perspective views of an installer 99 installing an embodiment of a second pulley mount 700 under the pole 30*b* and near the bottom of the zipper 200, in accordance with aspects of the present inventive concepts. In the embodiment shown in FIGS. 1C and 1C1 the second pulley mount 700 comprises a base plate 720 including multiple second pulleys, for example, a first second pulley 600*a* and a second second pulley 600*b*, in accordance with aspects of the present inventive concepts (see FIG. 14 and/or FIG. 14A1). In this embodiment, both the first second pulley 600*a* and the second second pulley 600*b* are located at corners of the base plate 720. In alternative embodiments, the second pulley is located at one or both of the front corners of the base plate 720. Placement of multiple second pulleys at multiple corner positions of the base plate 720 allows an installer 99 even further options for enhanced placement of the second pulley 600 directly underneath the position of the zipper. For example, although the embodiment depicted in FIG. 13 illustrates the pole 30 and the corresponding base plate 720 positioned at a left side of the zipper 200 for tensioning the left portion of the zipper tape, in some embodiments, it may instead be preferred to instead tension the right portion of the zipper tape. In such a case, the second second pulley 600*b* can be employed with the elongated pull 300.

Figure 1D:
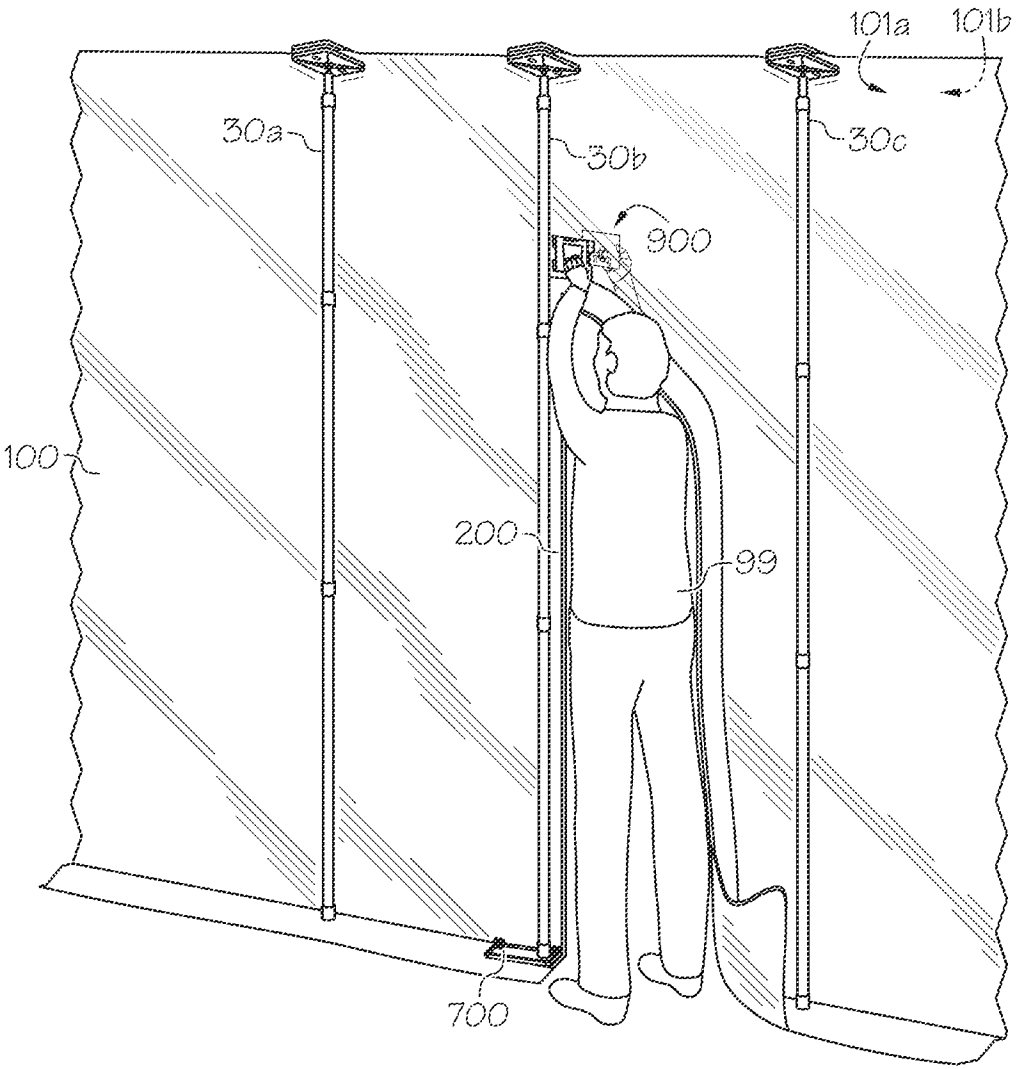
Figure 2:
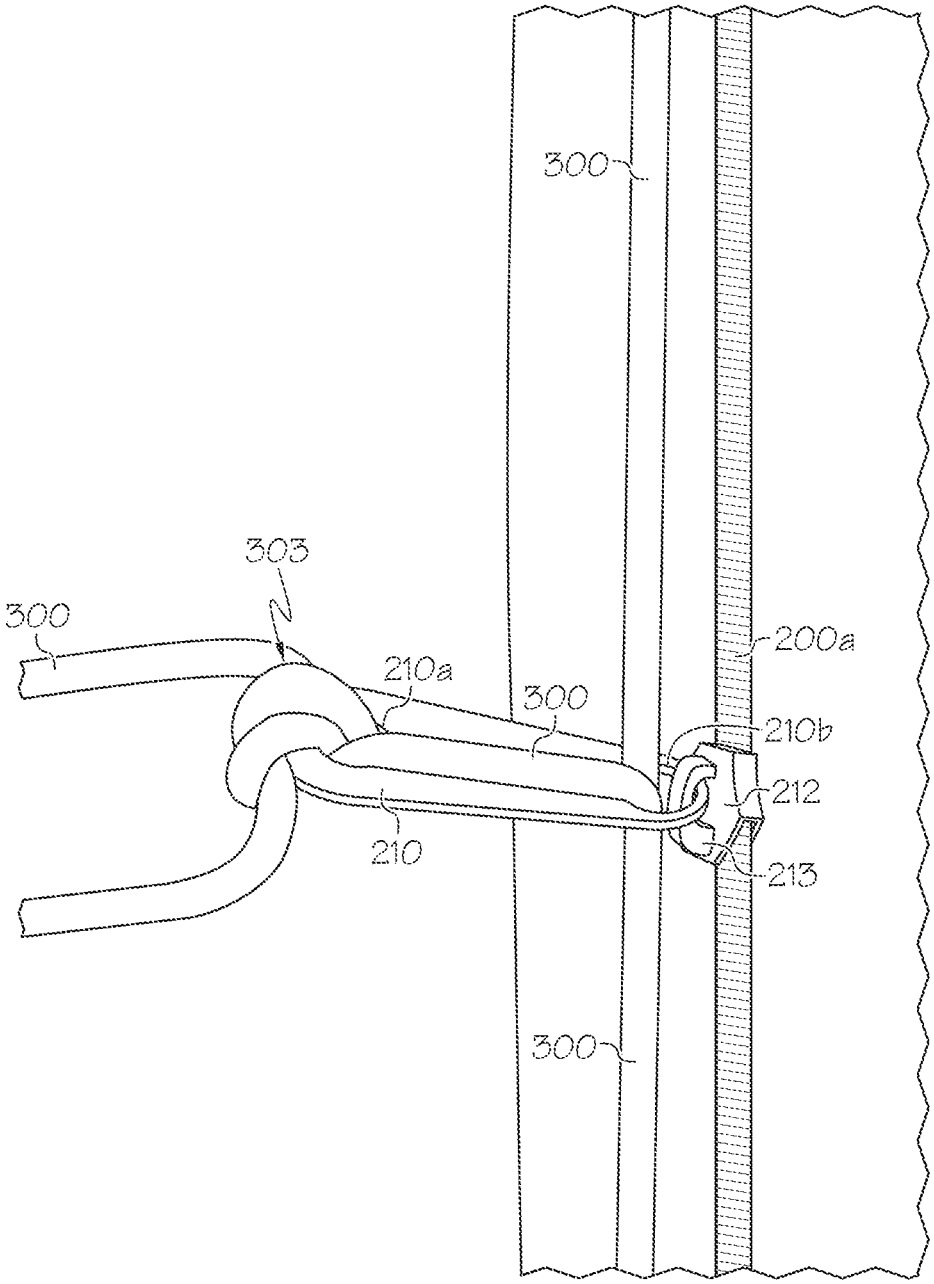

FIGS. 1D, 1D1, and 1D2 are a perspective views of an installer 99 installing an embodiment of a first pulley mount 900, in accordance with aspects of the present inventive concepts. In this embodiment, the installer 99 installs a first pulley mount 900 as described in connection with FIGS. 9J-9L. In alternative embodiments, the installer 99 installs another first pulley mount described herein. In this embodiment, the installer 99 positions the first portion 920 of the first pulley mount 900 at the desired location on the first side 101*a* of the curtain 100. In this embodiment, the installer 99 couples the second portion 960 of the first pulley mount 900 to the first portion 920, with the second portion 960 being on the second side 101*b* of the curtain 100. The installer 99 cuts an opening 100*a* in the curtain 100 such that the elongated pull can pass from the first side of the curtain 101*a* to the second side 101*b* of the curtain 100. In some embodiments, the opening 100*a* has dimensions that match the dimensions of an opening in the first portion 920 of the first pulley mount 900 and/or the dimensions of an opening in the second portion 960 of the first pulley mount 900.

In some embodiments, as shown in FIG. 1D2, the installer 99 cuts the opening in the curtain 100 before mounting the first 920 and second 960 portions of the first pulley mount 900.

Figure 1E:
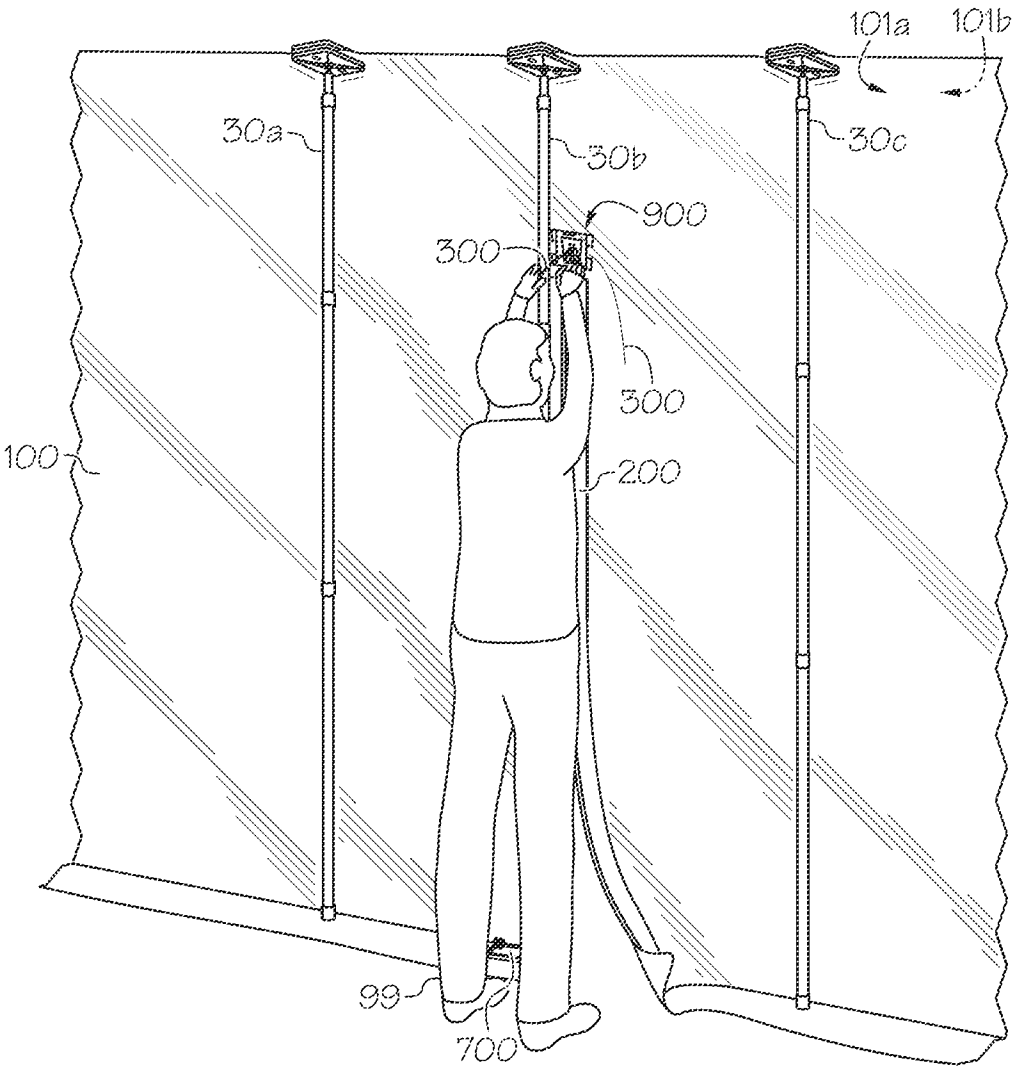

FIGS. 1E and 1E1 are a perspective views of an installer 99 installing an embodiment of an elongated pull 300 through an opening above the zipper 200, in accordance with aspects of the present inventive concepts. In this embodiment, the elongated pull 300 passes from the first side 101*a* of the curtain 100 to the second side 101*b* of the curtain 100. In this embodiment, the elongated pull also passes through the first portion 920 of the first pulley mount 900 and the second portion 960 of the first pulley mount 900. In some embodiments, such as the one shown in FIG. 1E, the elongated pull 300 interfaces with a surface of the first pulley 400.

Figure 1F:
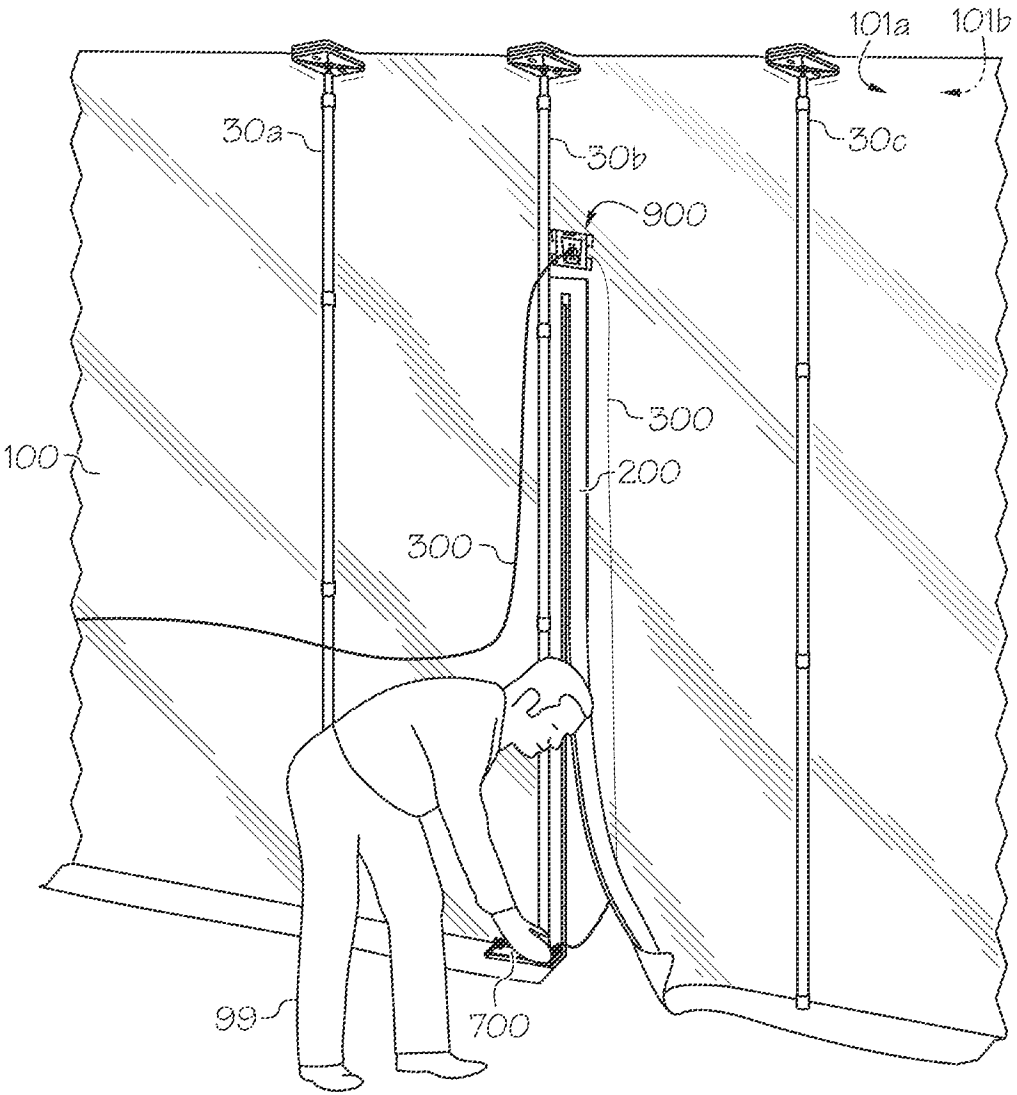

FIGS. 1F and 1F1 are a perspective views of an installer 99 installing an embodiment of an elongated pull 300 around a second pulley 600, in accordance with aspects of the present inventive concepts. In this embodiment, the elongated pull 300 extends from the first pulley 400, at the second side of the curtain 101*b*, towards the second pulley 600. The elongated pull 300 is arranged such that it interfaces with a surface of the second pulley 600 and returns to the first side of the curtain 100. More details are described herein in connection with FIG. 14-14A2.

Figure 1G:
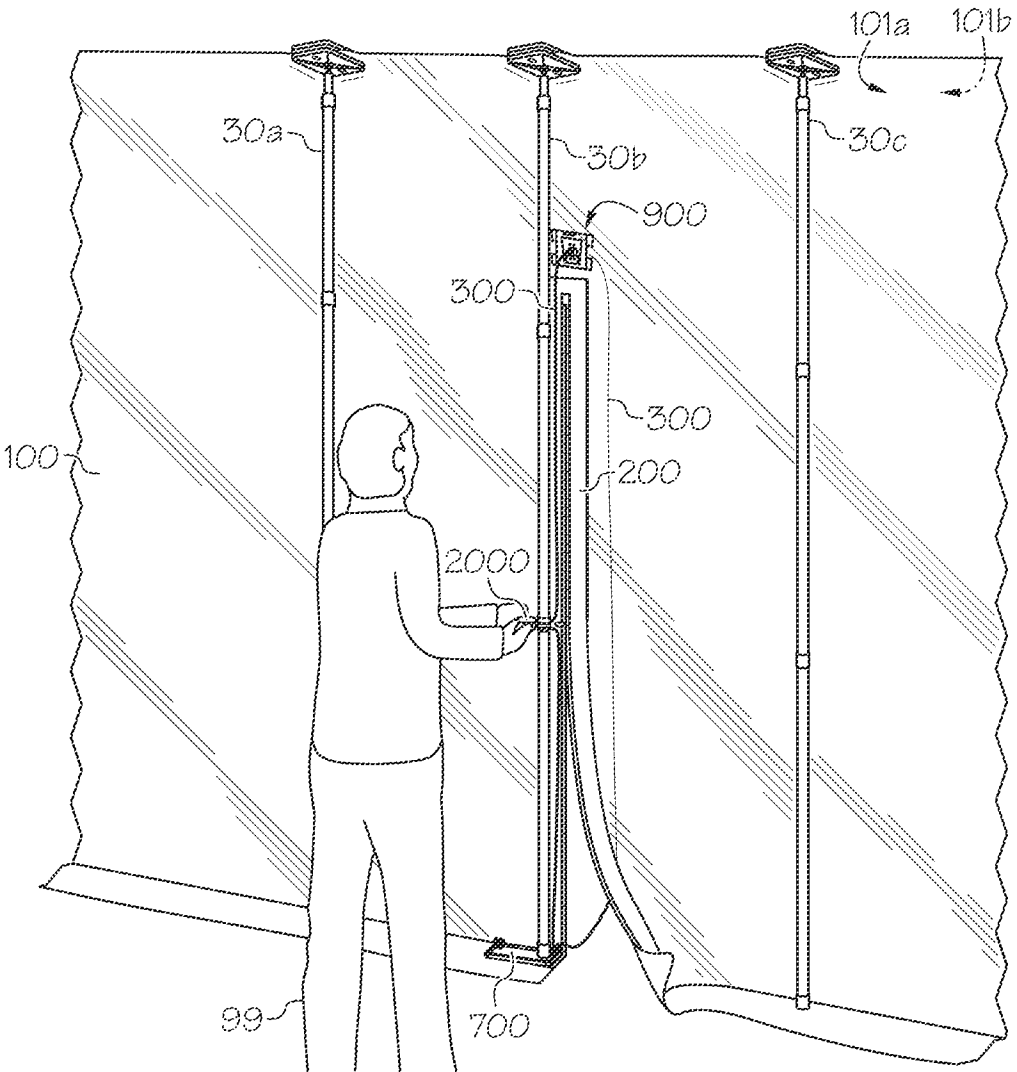

FIGS. 1G and 1G1 are perspective views of an installer 99 installing an embodiment of an elongated pull 300 to a pull coupler 2000, in accordance with aspects of the present inventive concepts. In some embodiments, such as this one, a zipper pull 210 and the elongated pull 300 are both coupled to a pull coupler 3000. In some embodiments, one end of the elongated pull 300 is coupled to a first portion of the pull coupler and another end of the elongated pull 300 is coupled to a second portion of the pull coupler. More details are described herein in connection with FIGS. 2-2K.

Figure 1H:
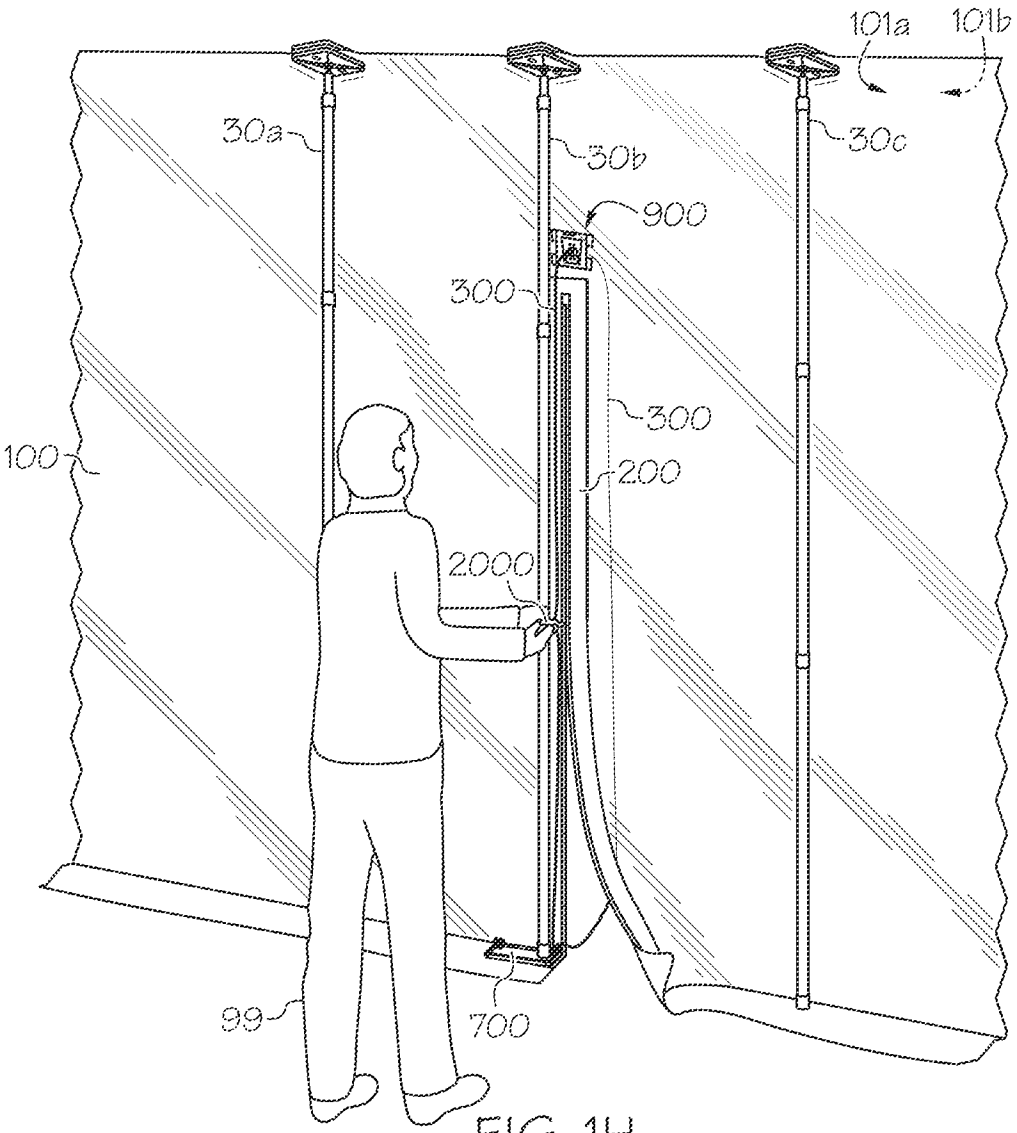

FIGS. 1H and 1H1 are perspective views of an installer 99 installing an embodiment of an elongated pull 300 and a zipper pull 210 to a pull coupler 2000, in accordance with aspects of the present inventive concepts. More details are described herein in connection with FIGS. 2-2K.

FIGS. 1I and 1I1 are perspective views of an installer 99 using an embodiment of a zipper pull system 10000, in accordance with aspects of the present inventive concepts. In this embodiment, the installer 99 lowers the zipper pull 210 by grasping the elongated pull 300 and pulling the elongated pull 300 in a downward direction 301*a*. If the installer 99 was at the second side 101*b* of the curtain 100, the installer 99 could lower the zipper pull 210 by pulling the elongated pull 300 in an upward direction 301*b*. In this embodiment, lowering the zipper pull 210 closes the zipper 200. In alternative embodiments, lowering the zipper pull 210 opens the zipper 200.

Figure 1J:
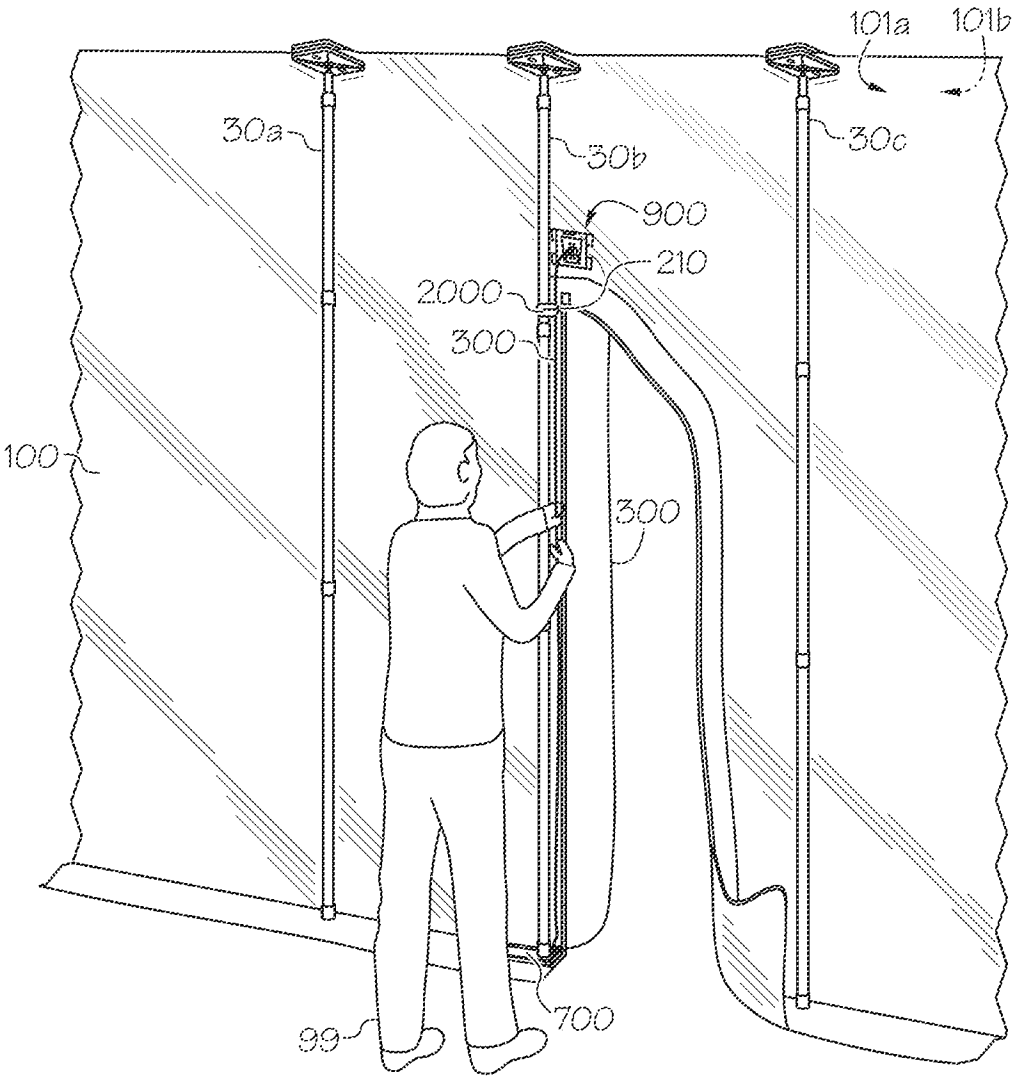

FIGS. 1J and 1J1 are perspective views of an installer 99 using an embodiment of a zipper pull system 10000, in accordance with aspects of the present inventive concepts. In this embodiment, the installer 99 raises the zipper pull 210 by pulling the elongated pull 300 in an upward direction 301*b*. If the installer 99 was at the second side 101*b* of the curtain 100, the installer 99 could raise the zipper pull 210 by pulling the elongated pull 300 in a downward direction 301*a*. In this embodiment, raising the zipper pull 210 opens the zipper 200. In alternative embodiments, raising the zipper pull 210 closes the zipper 200.

Figure 1K:
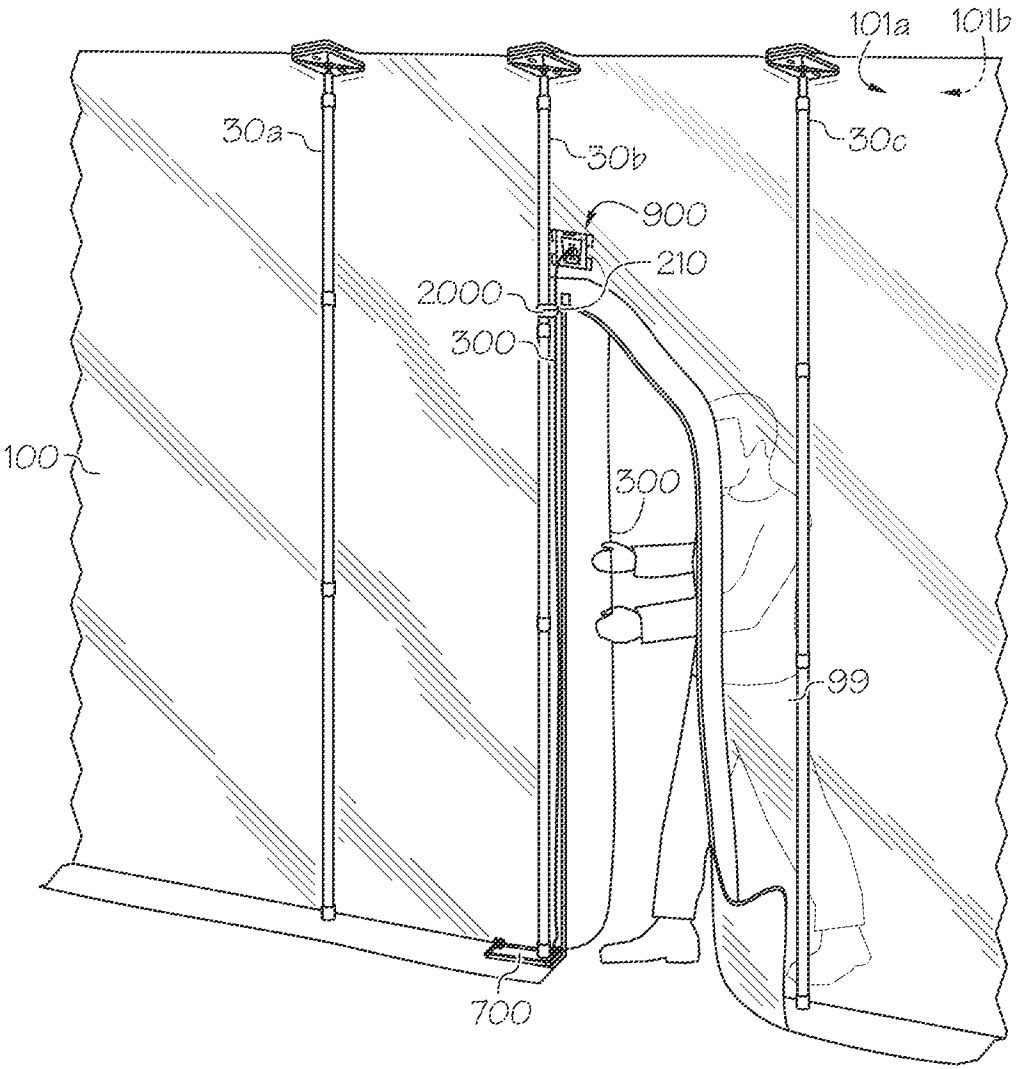

FIGS. 1K and 1K1 are perspective views of an installer 99 passing through an opening in the curtain 100, after using an embodiment of a zipper pull system 10000, in accordance with aspects of the present inventive concepts.

Figure 1L:
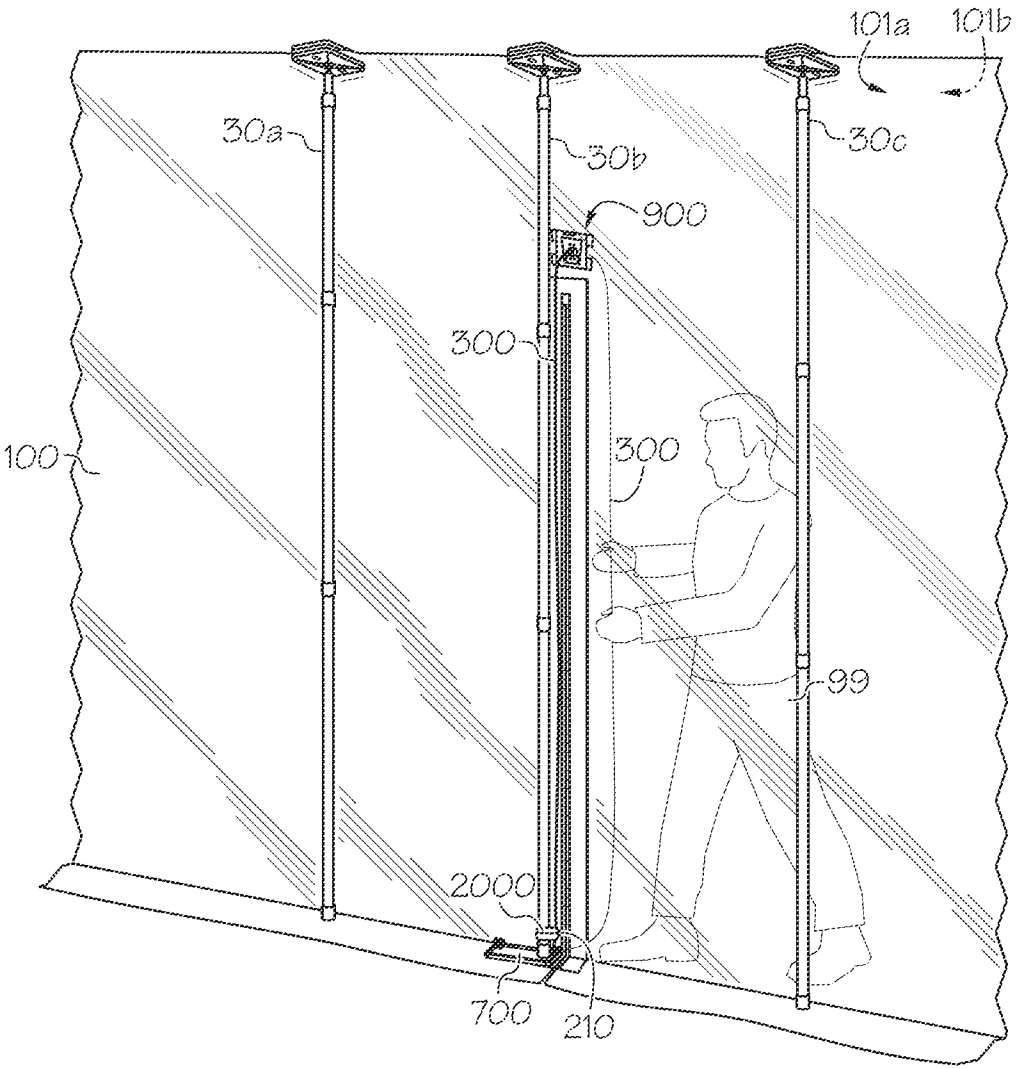

FIGS. 1L and 1L1 are perspective views of an installer 99 using an embodiment of a zipper pull system 10000, in accordance with aspects of the present inventive concepts. In FIG. 1L the installer 99 is at the second side 101*b* of the curtain 100. In this embodiment, in order to close the zipper 200, the installer 99 lowers the zipper pull 210 by pulling the elongated pull 300 in an upward direction 301*b*. In this embodiment, lowering the zipper pull 210 closes the zipper 200. In alternative embodiments, lowering the zipper pull 210 opens the zipper 200.

FIG. 2 is a perspective view of an embodiment of an elongated pull 300 securely coupled to a zipper pull 210, in accordance with aspects of the present inventive concepts. FIG. 2 shows one possible way of coupling the elongated pull 300 to the zipper pull 210, for example using a knot 303 tied through an eyelet 210*a* at a first end of the zipper pull 210. In alternative embodiments, the elongated pull 300 is securely coupled to the zipper pull 210 using any of a number of different, suitable knot configurations. In alternative embodiments, the elongated pull 300 is securely coupled to the zipper pull 210 using one or more other coupling mechanisms, including, but not limited to, glue, a clip, buckle, tape, or any other mechanism suitable for securely coupling two components. A second end of the zipper pull 210 opposite the eyelet 210*a* includes an opening 210*b* that interfaces with a coupling bridge 213 of a slider 212 of the zipper. In this manner, the zipper pull 210 pivots relative to the slider 212. In the embodiment shown, portions of the elongated pull 200 pass through the opening 210*b*, where it is re-routed to extend in the first and second directions 301*a*, 301*b* toward the first and second pulleys 400, 600.

FIG. 2A1 is a perspective view of an embodiment of a pull coupler 2000, a zipper pull 210, and an elongated pull 300, in accordance with the present inventive concepts. In some embodiments, the pull coupler 2000 is constructed and arranged to couple a zipper pull 210 and an elongated pull 300. In some embodiments, such as the one shown in FIG. 2A1, the pull coupler 2000 comprises a first portion 2100 and a second portion 2200.

In the embodiment shown in FIG. 2A1, one end of the elongated pull 300 is coupled to the first portion 2100 of the pull coupler 2000 and extends toward the first pulley. In the embodiment shown in FIG. 2A1, another end of the elongated pull 300 is coupled to the second portion 2200 of the pull coupler 2000 and extends toward the second pulley.

In some embodiments, the zipper pull system 10000 comprises one or more pull couplers 2000. In some embodiments, one or more of the one or more pull couplers of neighboring zippers are coupled together.

FIG. 2A2 is a perspective view of an embodiment of a pull coupler, a zipper pull 210, and an elongated pull 300, in accordance with the present inventive concepts. In the embodiment shown in FIG. 2A2, one end of the elongated pull 300 is coupled to the first portion 2100 of the pull coupler 2000 and extends toward the second pulley. In the embodiment shown in FIG. 2A2, another end of the elongated pull 300 is coupled to the second portion 2200 of the pull coupler 2000 and extends toward the first pulley. In such an arrangement, sections of the elongated pull 300 cross, as shown in FIG. 2A2. In alternative embodiments, a portion of the elongated pull 300 is wrapped around a portion of the zipper pull 210.

Figure 2B:
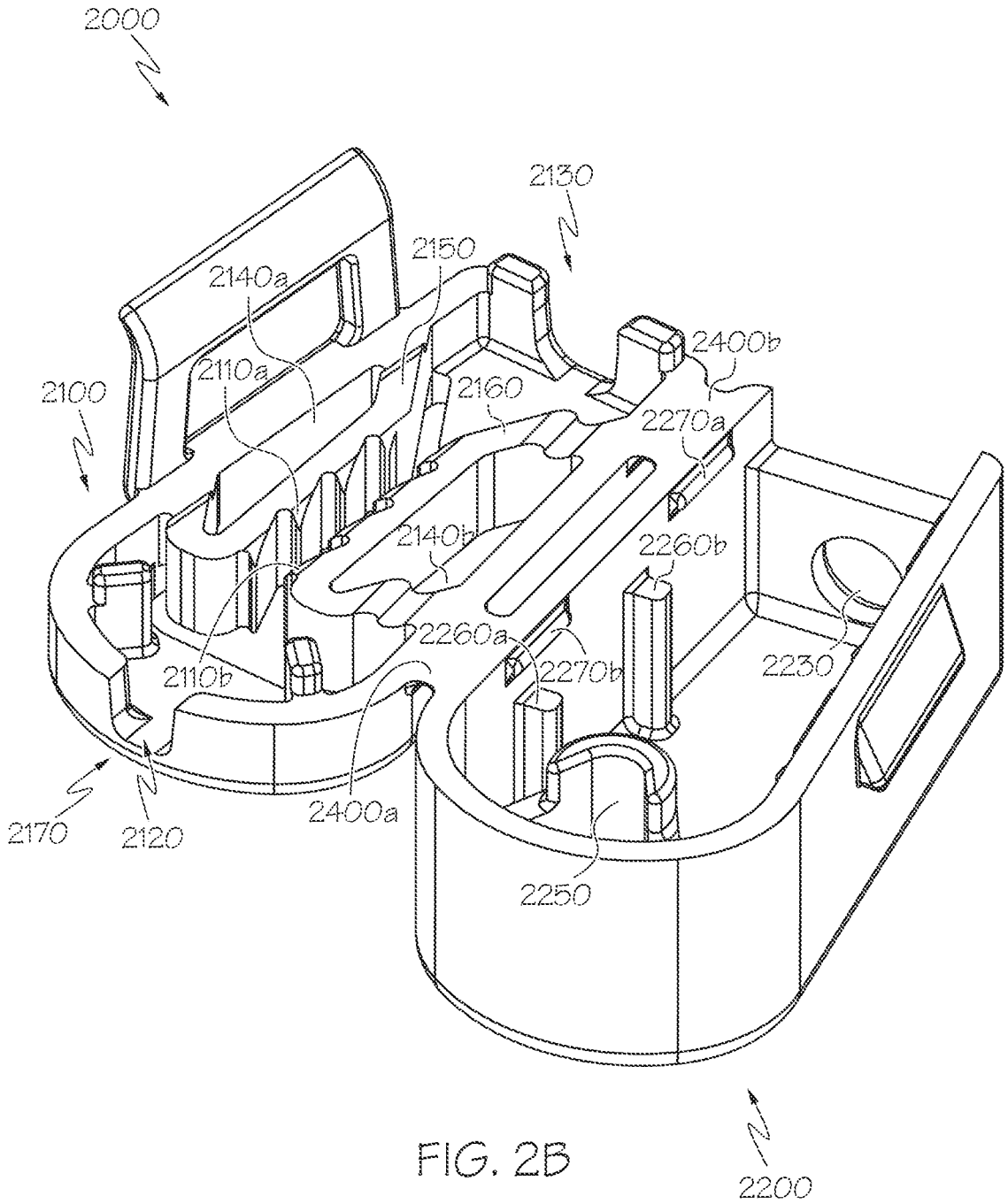
FIG. 2B is a perspective view of an embodiment of the pull coupler of FIG. 2A, in accordance with the present inventive concepts.

FIG. 2B is a perspective view of an embodiment of the pull coupler 2000 of FIG. 2A, in accordance with the present inventive concepts. In some embodiments, the first portion 2100 comprises at least one front opening 2120. In the embodiment shown in FIG. 2B, the first portion 2100 comprises one front opening 2120. In alternative embodiments, the first portion 2100 comprises a different number of front openings.

In some embodiments, the first portion 2100 comprises at least one rear opening 2130. In the embodiment shown in FIG. 2B, the first portion 2100 comprises one rear opening 2130. In alternative embodiments, the first portion 2100 comprises a different number of rear openings.

In some embodiments, the first portion 2100 of the pull coupler 2000 comprises a first extension 2150. In some embodiments, the first portion 2100 of the pull coupler 2000 also comprises a second extension 2160. In some embodiments, the first 2150 and/or second 2160 extensions comprise one or more teeth 2110. In some embodiments, the one or more teeth are constructed and arranged such that the one or more teeth 2110*a* of the first extension 2150 face or oppose the one or more teeth 2110*b* of the second extension 2160, as shown in FIG. 2B and FIG. 2J. In some embodiments, the two extensions 2150, 2160 are constructed and arranged such that a first portion channel 2170 passes between the one or more teeth 2110*a* of the first extension 2150 and the one or more teeth 2110*b* of the second extension 2160. In the embodiment shown in FIG. 2A, the pull coupler 2000 comprises eight teeth—four on each side. In alternative embodiments, the first 2150 and/or second 2160 extensions comprises a different number of teeth. In some embodiments, the first portion channel 2170 is constructed and arranged to engage with the elongated pull 300.

In some embodiments, such as the one shown in FIG. 2B, the first extension 2150 comprises a first opening 2140*a*. In some embodiments, such as the one shown in FIG. 2B, the second extension 2160 comprises a second opening 2140*b*. In some embodiments, the first opening 2140*a* of the first extension 2150 is constructed and arranged to allow "give" in the first extension 2150. Such "give" may be helpful to allow for elastic deformation when the elongated pull 300 passes through the first portion channel 2170. In some embodiments, the second opening 2140*b* of the second extension 2160 is constructed and arranged to allow "give" in the second extension 2160. Such "give" may be helpful to allow for elastic deformation when the elongated pull 300 passes through the first portion channel 2170. In alternative embodiments, the first extension 2150 comprises more than one opening. In some embodiments, the first extension 2150 does not comprise an opening. In alternative embodiments, the second extension 2160 comprises more than one opening. In some embodiments, the second extension 2160 does not comprise an opening.

In some embodiments, such as the embodiment shown in FIG. 2B, the first portion 2100 comprises a curved front surface. In alternative embodiments, the first portion 2100 does not comprise a curved front surface.

In some embodiments, the second portion 2200 comprises at least one rear opening 2230. In the embodiment shown in FIG. 2B, the second portion 2200 comprises one rear opening 2230. In alternative embodiments, the second portion 2200 comprises a different number of rear openings.

In some embodiments, the second portion 2200 comprises a pull mount 2250 constructed and arranged to couple with an opening of a zipper pull.

In some embodiments, the second portion 2200 comprises one or more lower supports 2260 constructed and arranged to be positioned below the zipper pull as a seat or rest of the zipper pull, and thereby position the zipper pull at the desired height in the second portion. In the embodiment shown in FIG. 2B, the second portion 2200 comprises four lower supports 2260*a, b* (two are not visible in this view). In alternative embodiments, the second portion 2200 comprises a different number of lower supports. In some embodiments, the second portion 2200 comprises one lower support that extends around the second portion 2200. In the embodiment shown in FIG. 2B, the one or more lower supports 2260 are positioned at the edge of the second portion 2200. In alternative embodiments, the one or more lower supports 2260 are positioned away from the edge of the second portion 2200.

In some embodiments, the second portion 2200 comprises one or more upper supports 2270 constructed and arranged to be positioned above the zipper pull and position the zipper pull at the desired height. In the embodiment shown in FIG. 2B, the second portion 2200 comprises four upper supports 2270*a, b* (two are not visible in this view). In alternative embodiments, the second portion 2200 comprises a different number of upper supports. In some embodiments, the second portion 2200 comprises one upper support that extends around the second portion 2200.

In some embodiments, the pull coupler 2000 comprises at least one hinge 2400. In some embodiments, such as the embodiment shown in FIG. 2B, the at least one hinge rotatably couples the first portion 2100 to the second portion 2200. In the embodiment shown in FIG. 2B the pull coupler 2000 comprises two hinges 2400*a, b*. In alternative embodiments, the pull coupler 2000 comprises a different number of hinges. In alternative embodiments, the pull coupler 2000 does not comprise a hinge.

Figure 2C:
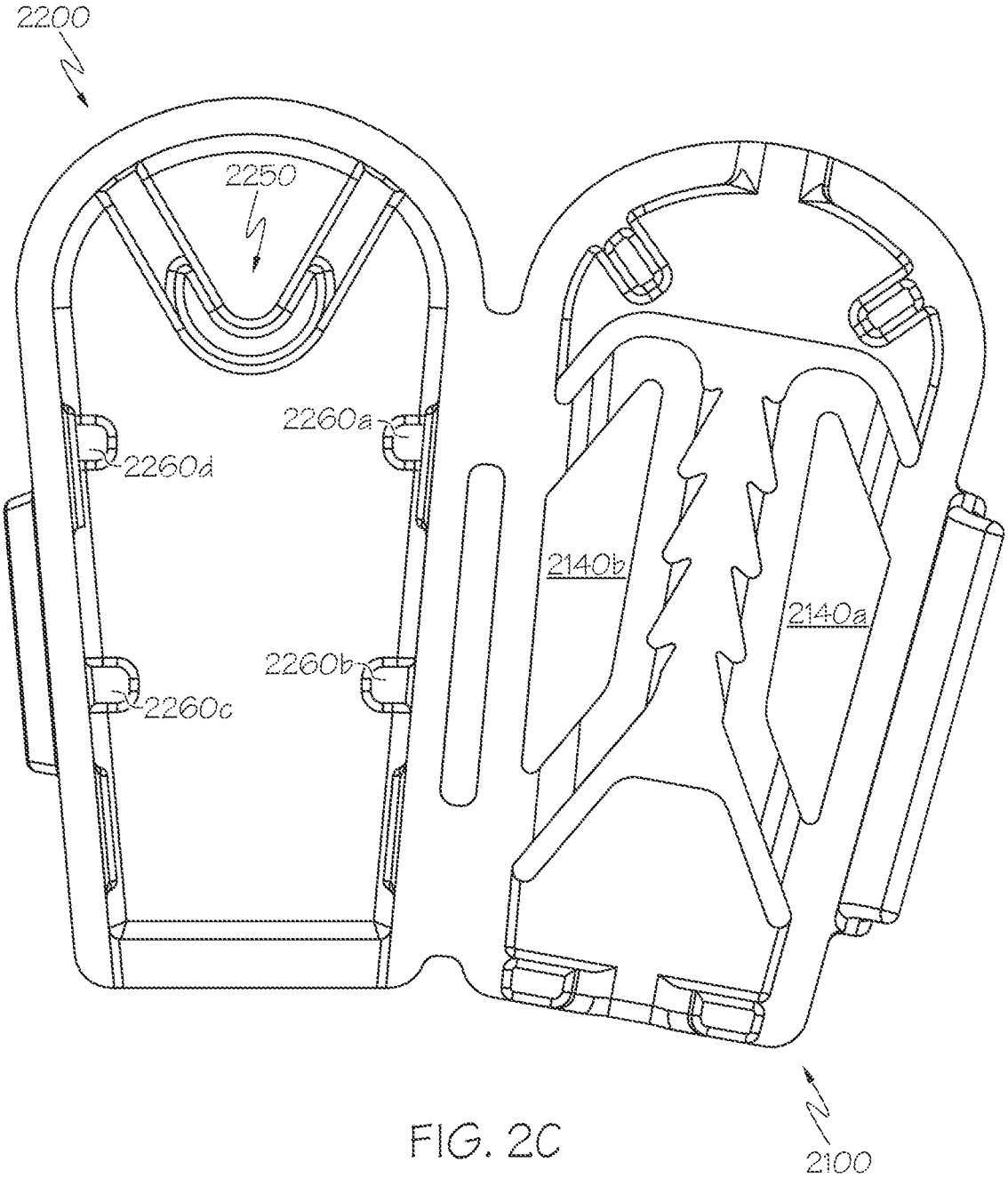
FIG. 2C is a top view of an embodiment of the pull coupler of FIG. 2A, in accordance with the present inventive concepts.

FIG. 2C is a top view of an embodiment of the pull coupler 2000 of FIG. 2A, in accordance with the present inventive concepts.

Figure 2D:
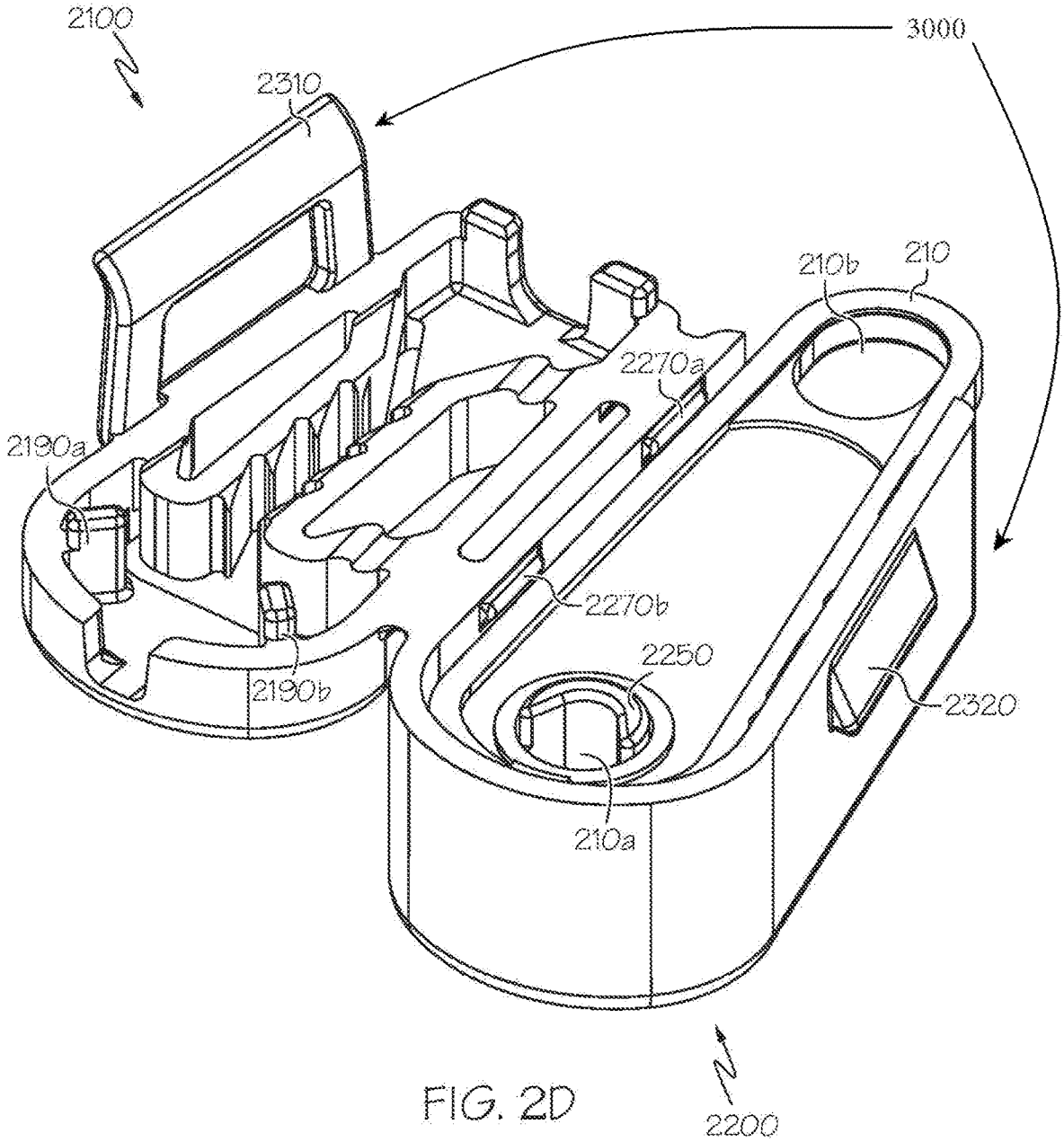
FIG. 2D is a top view of an embodiment of the pull coupler of FIG. 2A and a zipper pull, in accordance with the present inventive concepts.

FIG. 2D is a top view of an embodiment of the pull coupler 2000 of FIG. 2A and a zipper pull 210, in accordance with the present inventive concepts. In some embodiments, such as the embodiments shown in FIG. 2D the pull coupler 2000 is constructed and arranged such that the eyelet 210*a* of the zipper pull 210 fits around and seats on the pull mount 2250. In some embodiments, the second portion 2200 comprises one or more upper supports 2270 constructed and arranged to be positioned above the zipper pull and position the zipper pull at the desired height. In the embodiment shown in FIG. 2B, the second portion 2200 comprises four upper supports 2270*a, b* (two are not visible in this view). In alternative embodiments, the second portion 2200 comprises a different number of upper supports. In some embodiments, the second portion 2200 comprises one upper support that extends around the second portion 2200.

In some embodiments, the first portion 2100 of the pull coupler 2000 comprises at least one post 2190 constructed and arranged to apply downward pressure on a zipper pull 210 installed in the pull coupler 2000. In the embodiment shown in FIG. 2B the first portion 2100 of the pull coupler 300 comprises two posts 2190*a, b*. In alternative embodiments, the first portion 2100 comprises a different number of posts.

In some embodiments, such as the embodiment shown in FIG. 2D, the pull coupler comprises a locking mechanism 3000. In some embodiments, such as the embodiment shown in FIG. 2D the locking mechanism 3000 comprises a first portion 2310 and a second portion 2320. The first portion 2310 and the second portion 2320 of the locking mechanism are constructed and arranged to mate. In alternative embodiments, the locking mechanism 3000 comprises a button. In alternative embodiments, the locking mechanism 3000 comprises a pin and slot. In alternative embodiments, the locking mechanism 3000 comprises a lock and key. In alternative embodiments, the locking mechanism 3000 comprises a hook and loop mechanism.

Figure 2E:
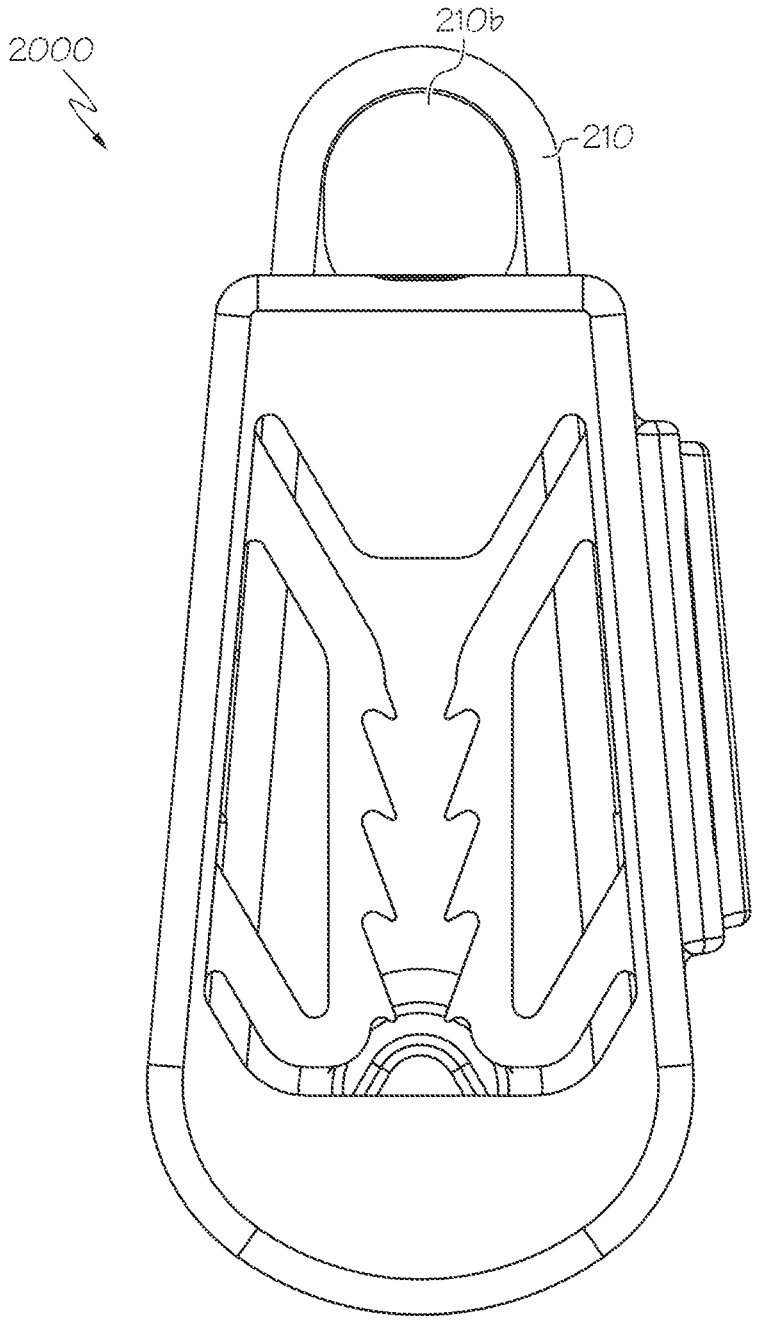
FIG. 2E is a top view of an embodiment of the pull coupler of FIG. 2A coupled to a zipper pull, in accordance with the present inventive concepts.

FIG. 2E is a top view of an embodiment of the pull coupler 2000 of FIG. 2A coupled to a zipper pull 210, in accordance with the present inventive concepts. In this view the first portion 2100 of the pull coupler 2000 is secured to the second portion 2200 of the pull coupler 2000.

Figure 2F:
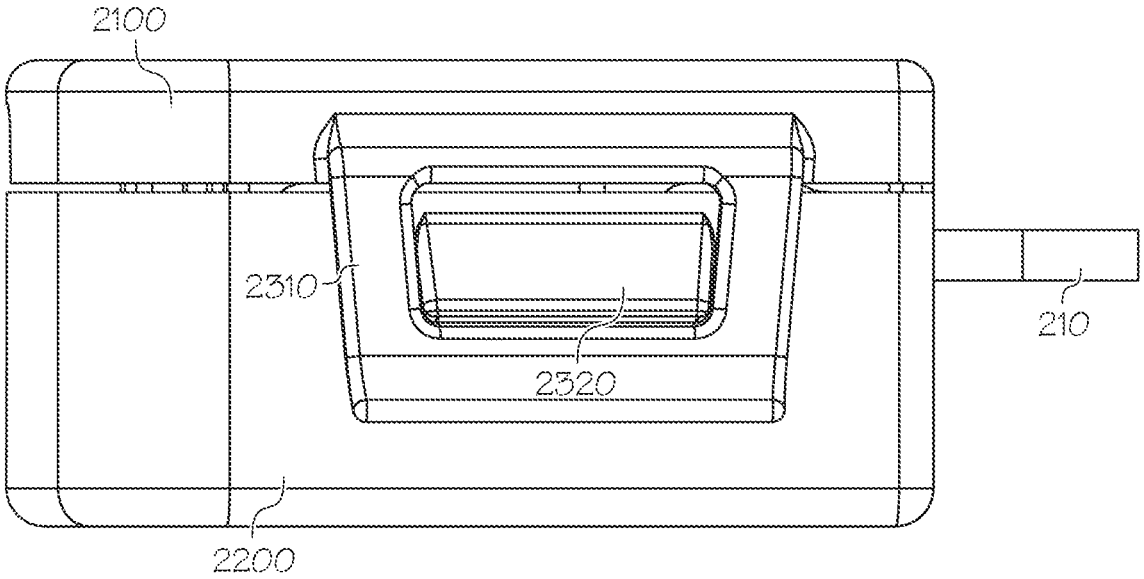
FIG. 2F is a side view of an embodiment of the pull coupler of FIG. 2A and a zipper pull, in accordance with the present inventive concepts.

FIG. 2F is a side view of an embodiment of the pull coupler 2000 of FIG. 2A and a zipper pull 210, in accordance with the present inventive concepts.

Figure 2G:
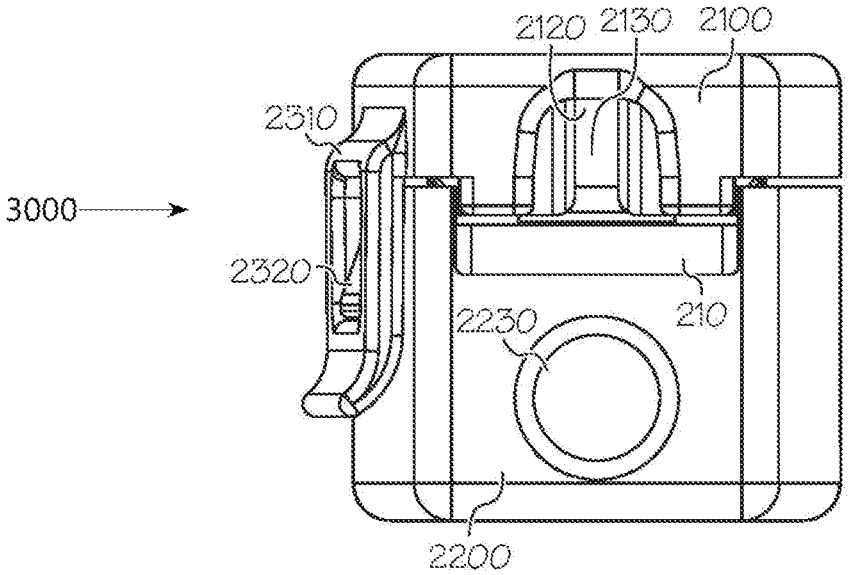
FIG. 2G is a rear view of an embodiment of the pull coupler of FIG. 2A and a zipper pull, in accordance with the present inventive concepts.

FIG. 2G is a rear view of an embodiment of the pull coupler 2000 of FIG. 2A and a zipper pull 210, in accordance with the present inventive concepts.

Figure 2H:
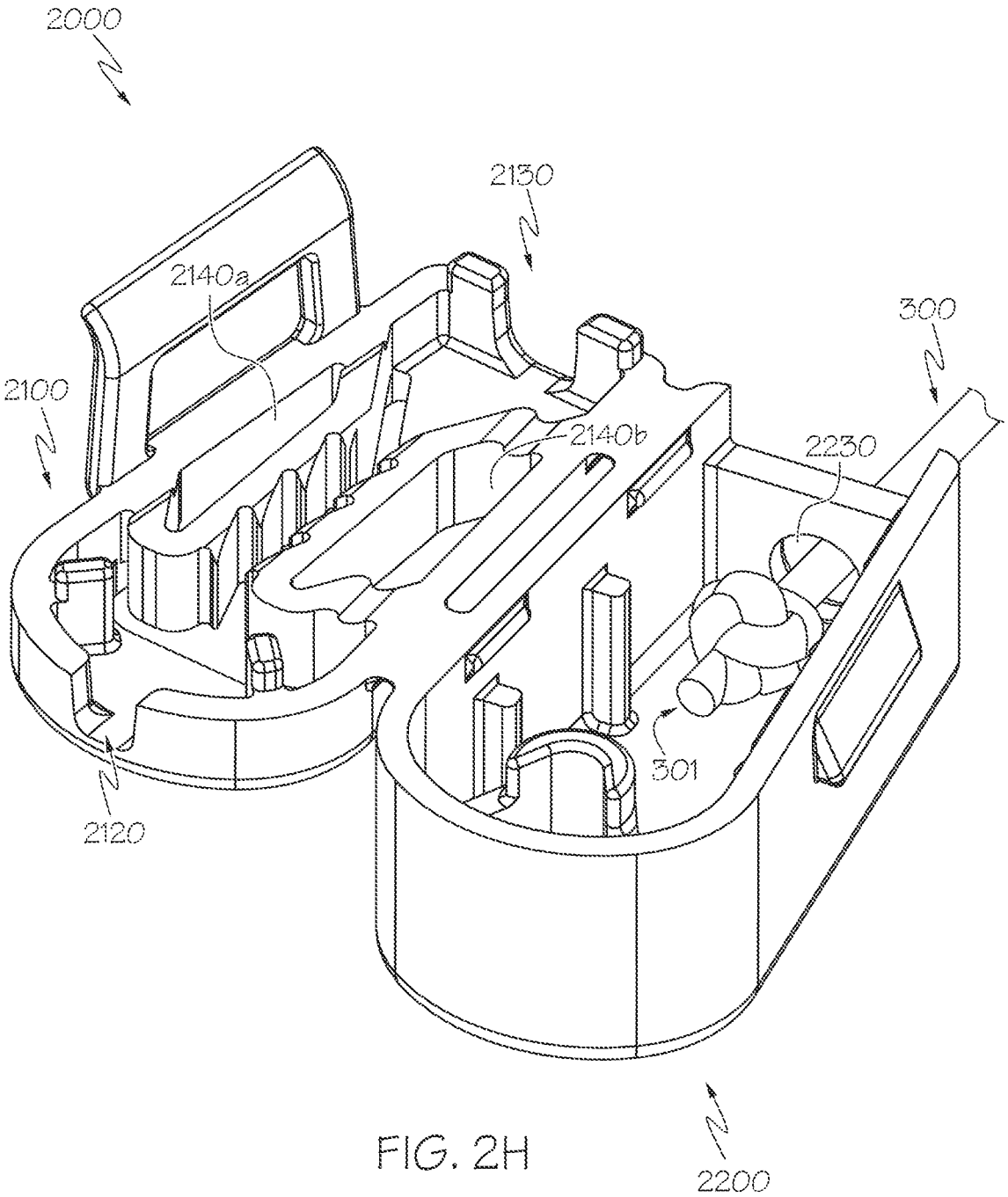
FIG. 2H is a perspective view of the pull coupler of FIG. 2B and an elongated pull, in accordance with aspects of the present inventive concepts.
Figure 2J:
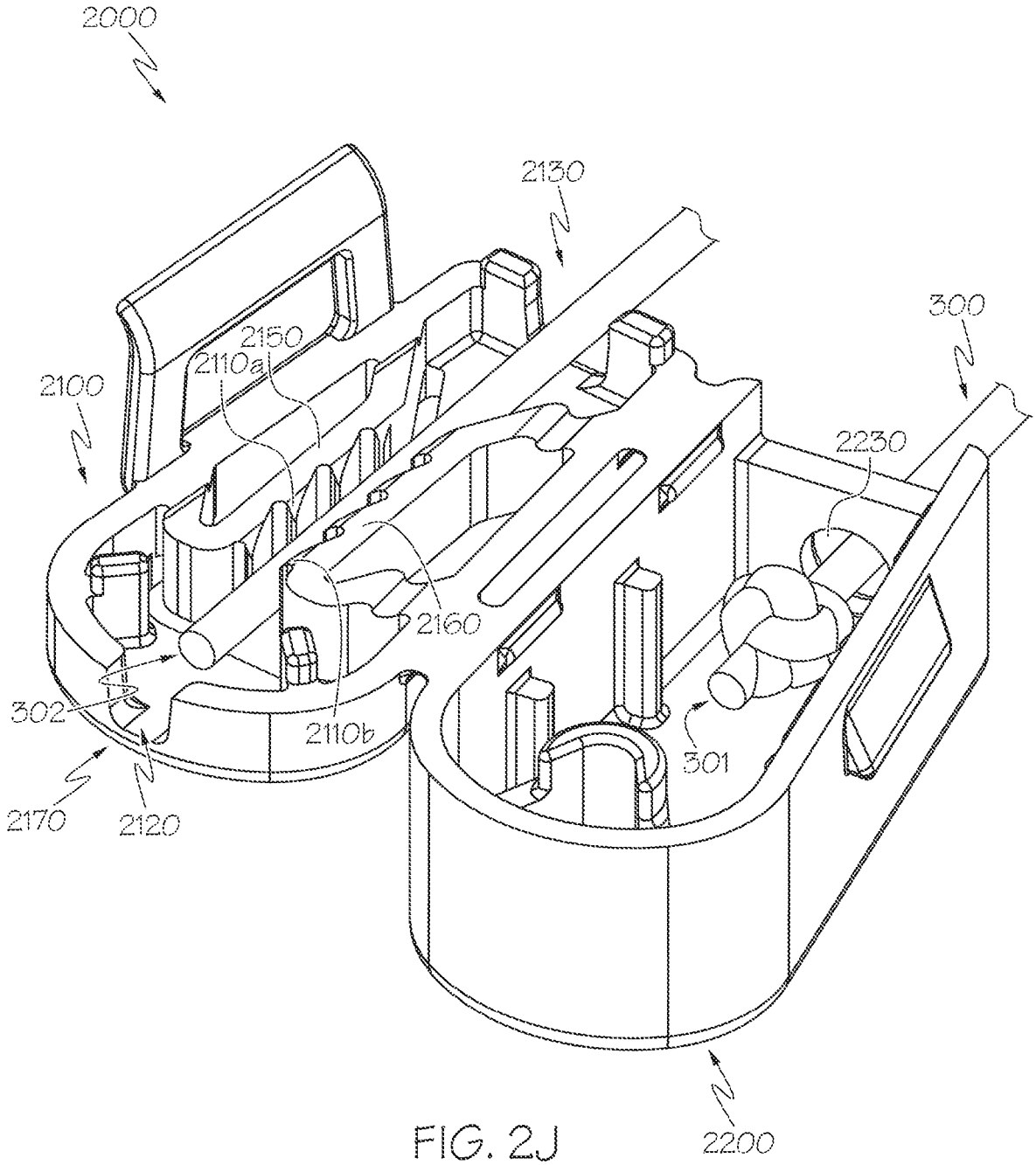
FIG. 2J is a perspective view of the pull coupler of FIG. 2B and an elongated pull, in accordance with aspect of the present inventive concepts.

FIG. 2H is a perspective view of the pull coupler of FIG. 2B and an elongated pull 300, in accordance with aspects of the present inventive concepts. In some embodiments, a method of installing an elongated pull 300 in a pull coupler 2000 comprises a step of inserting a first end 301 of the elongated pull 300 into the rear opening 2230 of the second portion 2200. In some embodiments, the first end 301 end of the elongated pull 300 is knotted, with the knot being wider than the rear opening 2230, the knot being constructed and arranged to prevent the first end 301 of the elongated pull 300 from leaving the pull coupler 2000.

In some embodiments, a second end 302 of the elongated pull 300 passes around the first pulley 400 and the second pulley 600. In some embodiments, the elongated pull begins on one side of the first pulley 400, passes through the opening in the curtain 100, and emerges on a second side of the first pulley 400 (and a second side of the curtain 100). In some embodiments, the elongated pull extends to the second pulley 600, passes through an opening in the curtain 100 or passes under the curtain 100, and emerges on the first side of the second pulley (and a first side of the curtain 100).

In some embodiments, the elongated pull makes contact with a surface of the first pulley 400. In some embodiments, the elongated pull moves as the zipper is opened and/or closed. Because the elongated pull may be in contact with a top surface of the first pulley 400, such motion may cause the first pulley 400 to rotate relative to the first pulley mount 800.

In some embodiments, the elongated pull makes contact with a surface of the second pulley 600. In some embodiments, the elongated pull moves as the zipper is opened and/or closed. Because the elongated pull may be in contact with a surface of the second pulley 600, such motion may cause the second pulley 600 to rotate.

FIG. 2I is a perspective view of the pull coupler 2000 of FIG. 2B and an elongated pull 300, in accordance with aspect of the present inventive concepts. In some embodiments, a method of installing an elongated pull 300 in a pull coupler 2000 comprises a step of inserting the second end 302 of the elongated pull 300 into the rear opening 2130 of the first portion 2100.

FIG. 2J is a perspective view of the pull coupler 2000 of FIG. 2B and an elongated pull 300, in accordance with aspect of the present inventive concepts. In some embodiments, the first portion 2100 of the pull coupler 2000 comprises a first extension 2150. In some embodiments, the first portion 2100 of the pull coupler 2000 also comprises a second extension 2160. In some embodiments, the first 2150 and/or second 2160 extensions comprise one or more teeth 2110. In some embodiments, the one or more teeth are constructed and arranged such that the one or more teeth 2110*a* of the first extension 2150 face the one or more teeth 2110*b* of the second extension 2160, as shown in FIG. 2B and FIG. 2J. In some embodiments, the two extensions are constructed and arranged such that a first portion channel 2170 passes between the one or more teeth 2110*a* of the first extension 2150 and the one or more teeth 2110*b* of the second extension 2160.

In some embodiments, a method of installing an elongated pull 300 in a pull coupler 2000 comprises a step of inserting the second end 302 of the elongated pull 300 through the first portion channel 2170 of the first portion 2100. In some embodiments, the first portion channel 2170 and the one or more teeth 2110 are constructed and arranged such that the elongated pull 300 can easily pass through the first portion channel 2170 in one direction and cannot easily pass through the first portion channel 2170 in another direction. In the embodiments shown in FIG. 2J the first portion channel 2170 and the one or more teeth 2110 are constructed and arranged such that the elongated pull 300 can easily pass through the first portion channel 2170 from the rear end of the first portion 2100 towards the front end of the first portion 2100. In the embodiment shown in FIG. 2J the first portion channel 2170 and the one or more teeth 2110 are constructed and arranged such that the elongated pull 300 cannot easily pass through the first portion channel 2170 from the front end of the first portion 2100 towards the rear end of the first portion 2100.

Figure 2K:
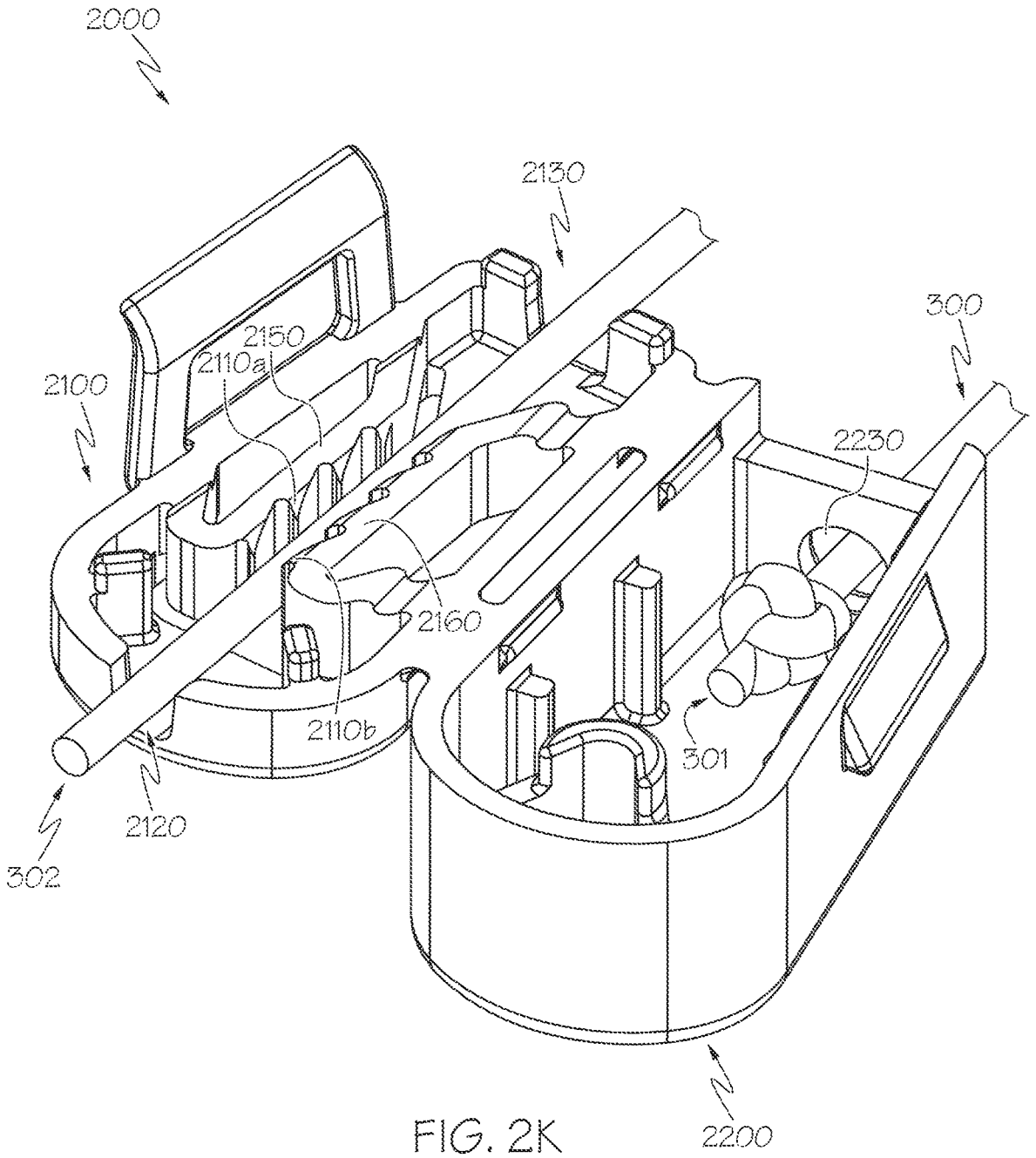
FIG. 2K is a perspective view of the pull coupler of FIG. 2B and an elongated pull, in accordance with aspect of the present inventive concepts.

FIG. 2K is a perspective view of the pull coupler 2000 of FIG. 2B and an elongated pull 300, in accordance with aspect of the present inventive concepts. In some embodiments, a method of installing an elongated pull 300 in a pull coupler 2000 comprises a step of inserting the second end 302 of the elongated pull 300 through the front opening 2120 of the first portion 2100. In some embodiments, the front opening 2120 of the first portion 2100 is constructed and arranged to be aligned with the rear opening 2130 of the first portion 2100. In some embodiments, the user may pull the elongated pull 300 through the front opening 2120 of the first portion 2100 in order to adjust the tension in the elongated pull 300.

Figure 3:
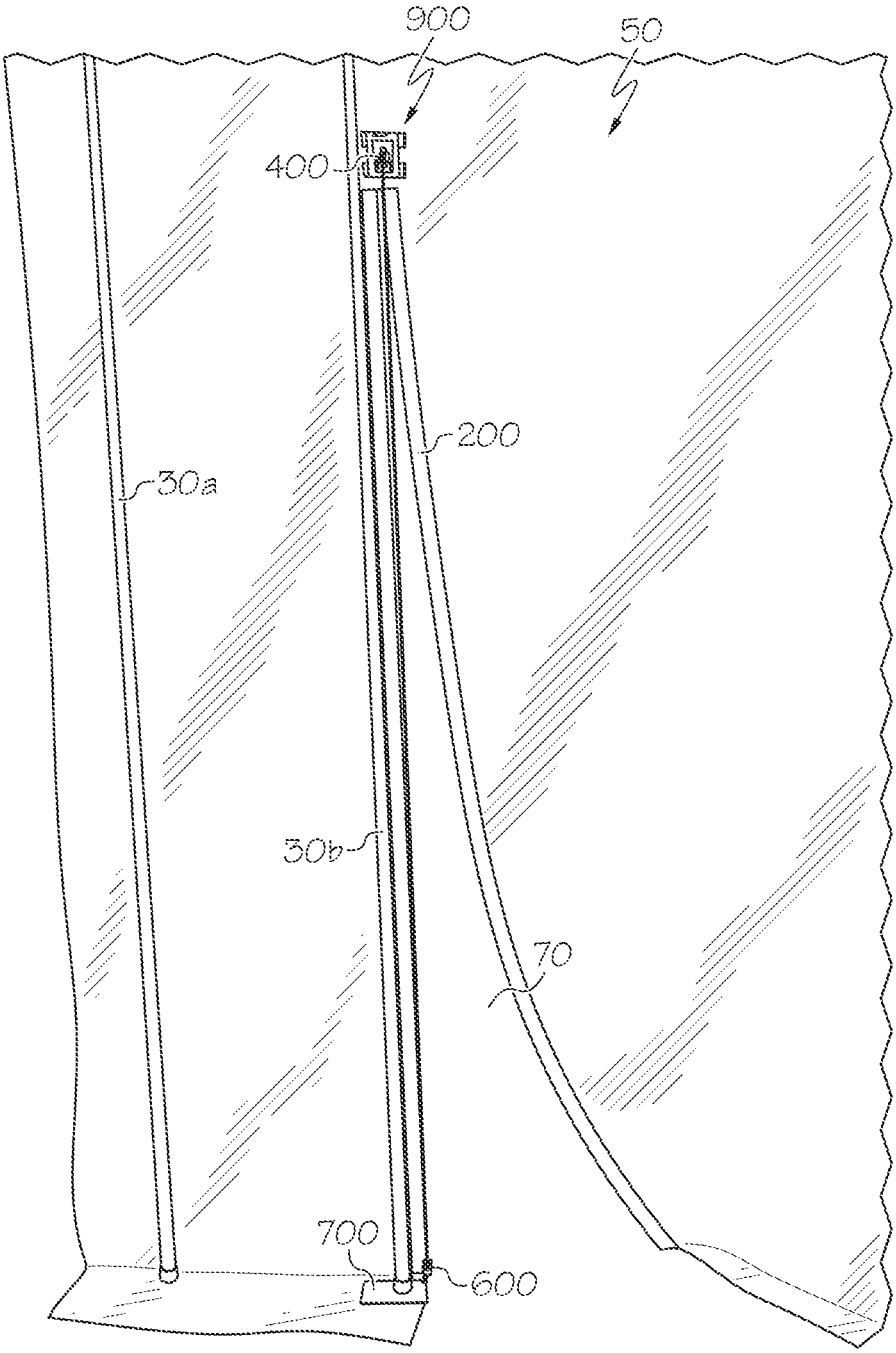
FIG. 3 is a front view of the embodiment of FIG. 1, in which the first zipper is open, in accordance with aspects of the present inventive concepts.

FIG. 3 is a front view of the embodiment of FIG. 1, in which the zipper 200 is open, in accordance with aspects of the present inventive concepts. With the zipper 200 open, an opening 70 in the doorway region 50 allows a user to pass through.

Figure 4:
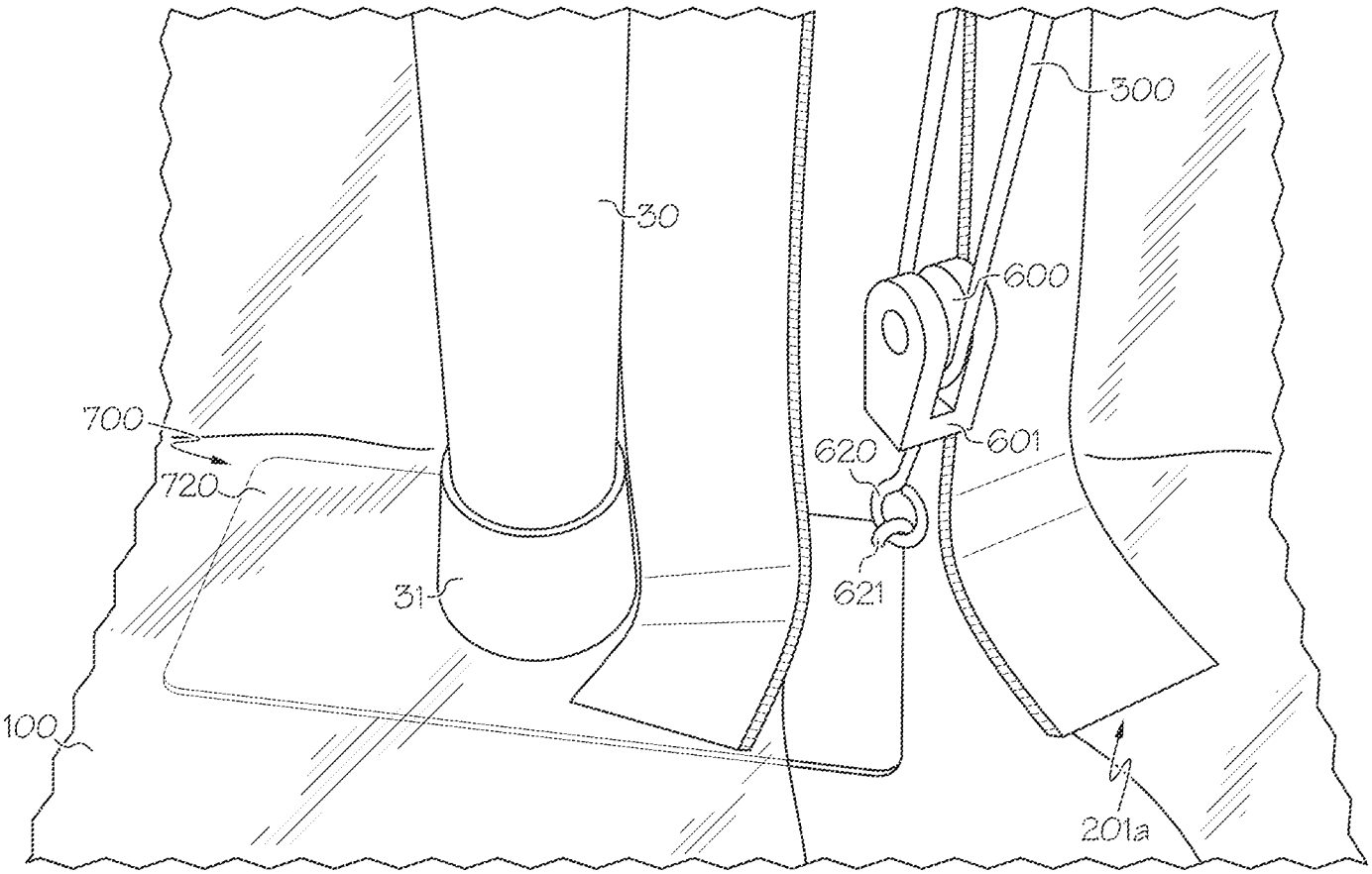
FIG. 4 is a perspective view of an embodiment of the second pulley and the second pulley mount, in accordance with aspects of the present inventive concepts.

FIG. 4 is a perspective view of an embodiment of the second pulley 600 and the second pulley mount 700, in accordance with aspects of the present inventive concepts. In this embodiment, the second pulley 600 is coupled to a second pulley housing 601, and the second pulley housing 601 is in turn coupled to a second hook 620 coupled to a base plate 720 of the second pulley mount 700. In this embodiment, the second hook 620 is coupled to the second pulley mount 700 at a pulley hinge 621. The interaction of the pulley hinge 621 and second hook 620 permits the pulley 600 to pivot relative to the base plate 720 of the second pulley mount. In some embodiments, the second pulley mount 700 comprises one or more linkage elements between the second pulley 600 and the base plate 720. In some embodiments, the second pulley mount 700 comprises one or more linkage elements between the hook 620 coupled to the second pulley 600 and the base plate 720. In some embodiments, the one or more linkage elements comprise a joint constructed and arranged to allow the second pulley 600 to articulate relative to the base plate 720. In some embodiments, the position of the second pulley 600 is fixed relative to the base plate 720. In some embodiments, the second pulley 600 is at an interior region of the second pulley housing 601.

In this embodiment, the base plate 720 comprises a rectangular shape. In alternative embodiments, the base plate 720 comprises a different shape, including, but not limited to, a circle, a square, oval or any other suitable geometric shape. In some embodiments, the base plate 720 is substantially planar. In some embodiments, the base plate has a more complex geometry such as a curved, arcuate, semi-cylindrical, semi-spherical or other suitable geometry.

In the embodiment shown in FIG. 4, a pole 30 is positioned above a portion of the curtain 100 and the base plate 720. In this embodiment, the pole 30 applies sufficient pressure to secure the position of the curtain 100 and the base plate 720 relative to each other, and relative to the neighboring surface, such as a floor. In this embodiment, the pole 30 comprises a foot 31 configured to increase friction between the pole 30 and the surface beneath the pole 30. In this embodiment, the foot 31 comprises a rubber or synthetic material that exhibits elastic deformation properties. In alternative embodiments, the foot 31 comprises one or more different materials suitable for increasing the friction between the pole 30 and the surface beneath the pole 30.

Figure 5:
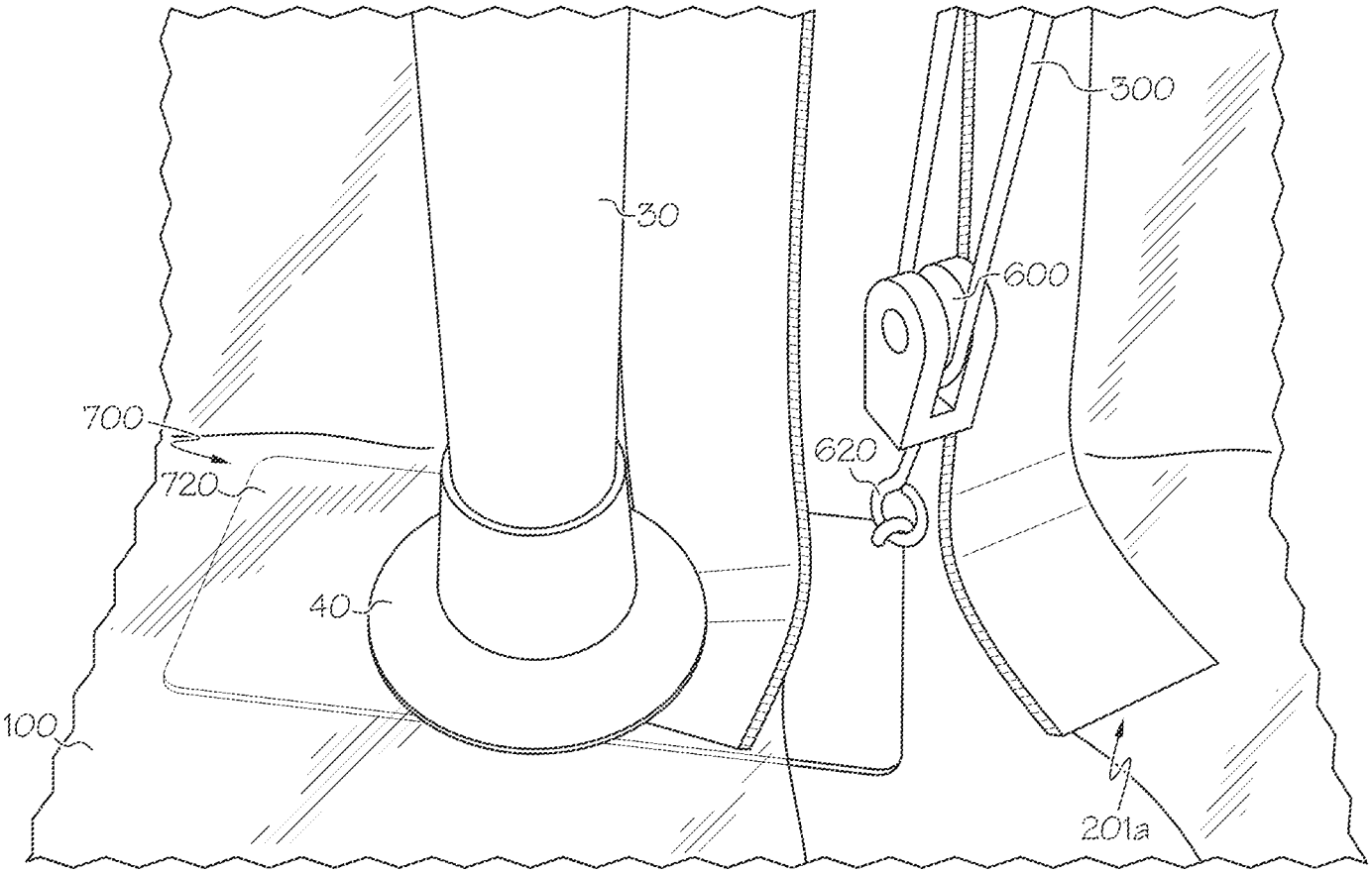
FIG. 5 is a front view of an embodiment of the second pulley and the second pulley mount, in accordance with aspects of the present inventive concepts.

FIG. 5 is a perspective view of an embodiment of the second pulley 600 and the second pulley mount 700, in accordance with aspects of the present inventive concepts. This embodiment is similar to the embodiment shown in FIG. 4, except that, in this embodiment, a flexible pole seat 40 is positioned between the pole 30 and the curtain 100. In this embodiment, the pole 30 applies sufficient pressure to secure the position of the curtain 100, the flexible pole seat 40, and the base plate 720. In this embodiment, flexible pole seat 40 is configured to increase friction between the pole 30 and the surface beneath the pole 30. In this embodiment, the flexible pole seat 40 comprises rubber or synthetic material that exhibits elastic deformation properties. In alternative embodiments, the flexible pole seat 40 comprises one or more different materials suitable for increasing the friction between the pole 30 and the surface beneath the pole 30.

Figure 6:
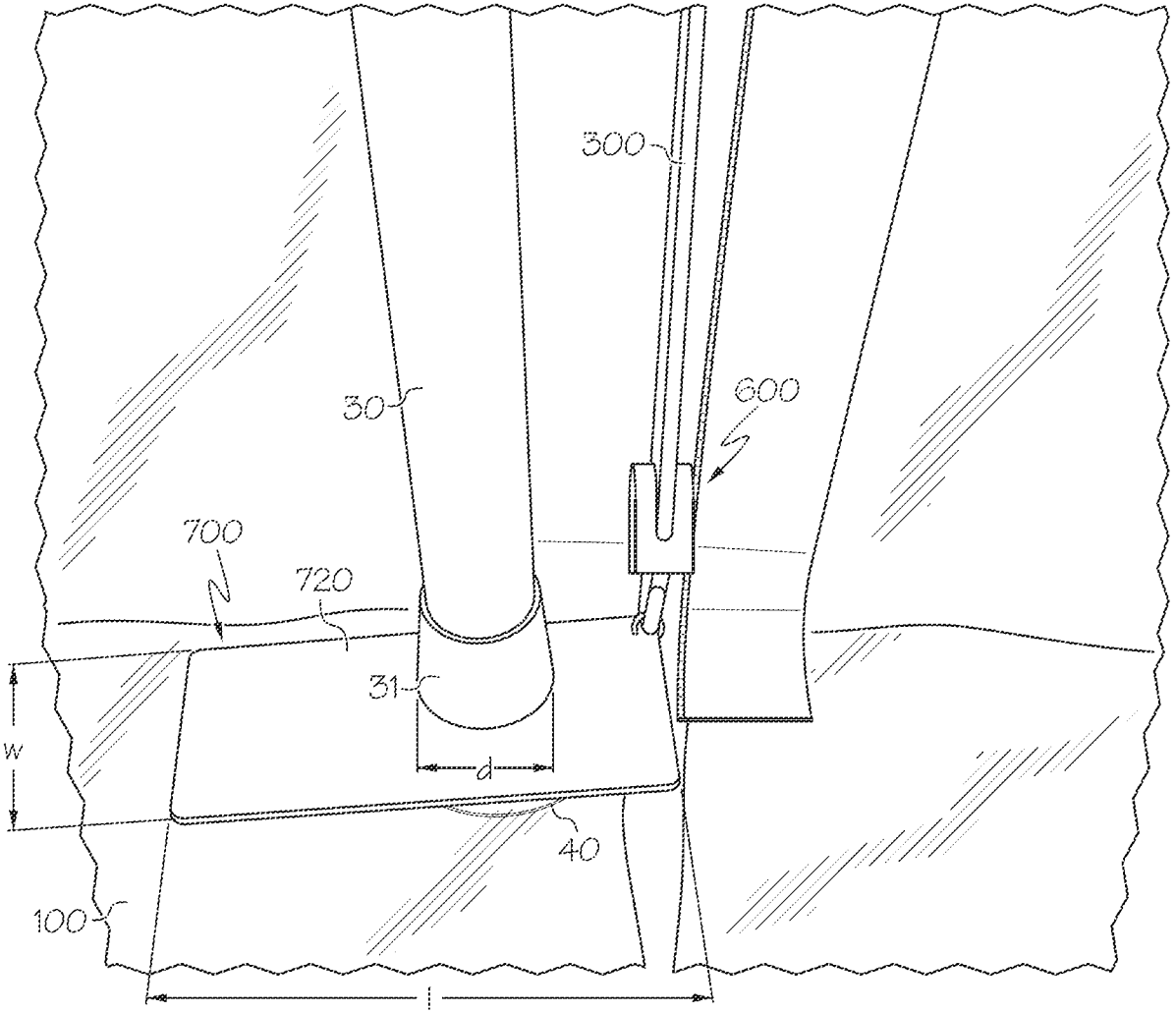
FIG. 6 is a front view of an embodiment of the second pulley and the second pulley mount, in accordance with aspects of the present inventive concepts.

FIG. 6 is a perspective view of an embodiment of the second pulley 600 and the second pulley mount 700, in accordance with aspects of the present inventive concepts. This embodiment is similar to the embodiment shown in FIG. 4, except that, in this embodiment, the base plate 720 is positioned between the pole 30 and the curtain 100. In this embodiment, the pole 30 applies sufficient pressure to secure the position of the curtain 100 and the base plate 720. In this embodiment, the flexible pole seat 40 is positioned between the curtain 100 and the floor, in order to increase friction between the two surfaces.

In some embodiments, the base plate 720 is of an area that is greater than a cross-sectional area of the foot 31 of the pole 30. In the embodiment illustrated in FIG. 6, the base plate is of a width w that is greater than a diameter d of the foot 31 of the pole 30, and the base plate is of a length l that is greater than a diameter d of the foot 31 of the pole 30.

In some embodiments, the base plate 720 is of a sufficient weight to secure the curtain 100 to the neighboring surface, for example, a floor. In some embodiments, the base plate 720 is rigid. In some embodiments, the base plate 720 is flexible.

In some embodiments, the second pulley 600 is integral with the base plate 700. An integral arrangement can comprise an arrangement whereby the axle of the pulley is fixed to the base plate. For example, the axle seats for the pulley can be formed in a common mold along with the base plate. In some embodiments, the second pulley 600 extends from a portion of the base plate 700. In some embodiments, the second pulley 600 is directly coupled to the lower portion 201*a* of the zipper 200. In some embodiments, the second pulley housing 601 is integral with the base plate 700.

Figure 7:
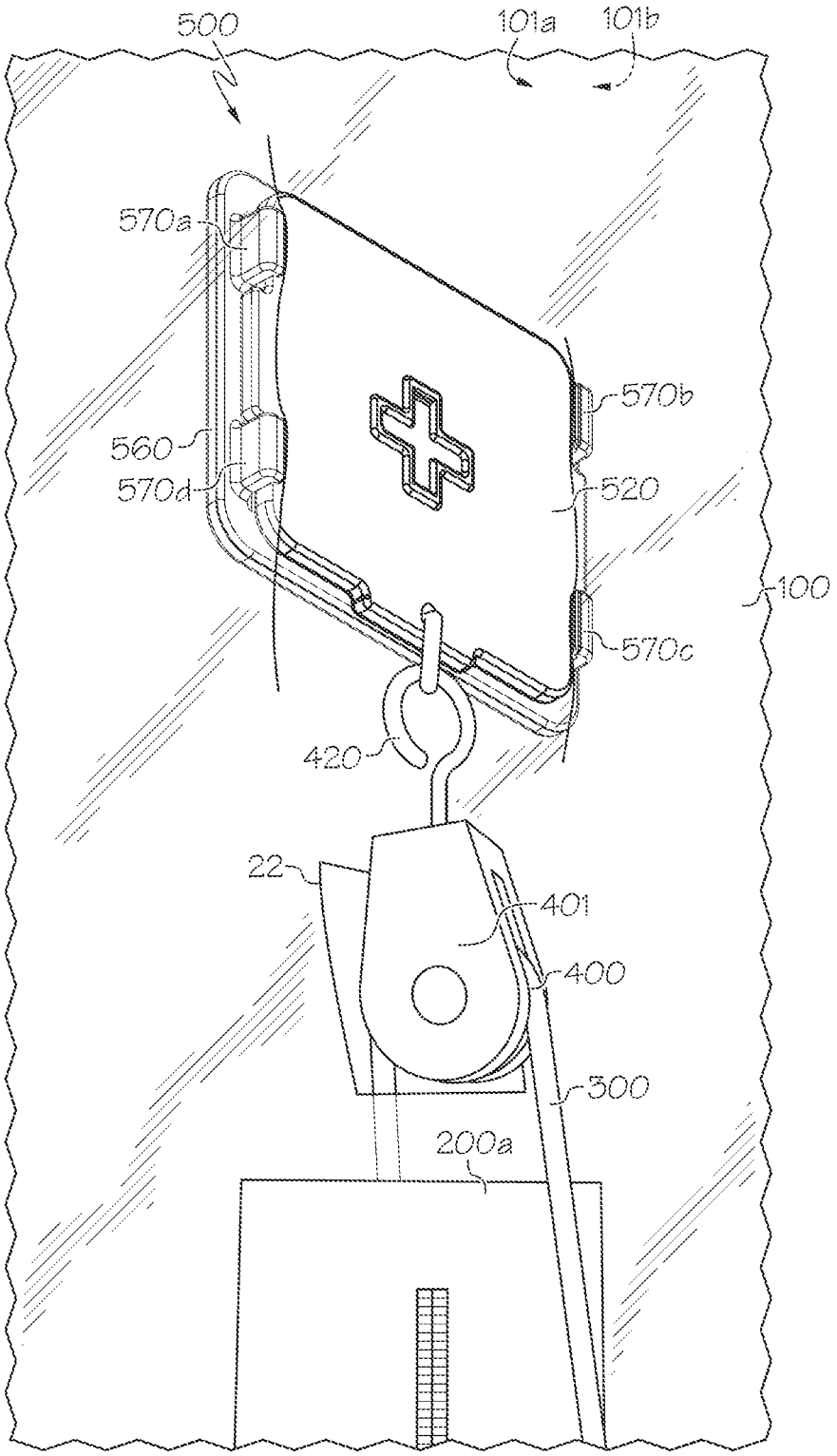
FIG. 7 is a perspective front view of an embodiment of the first pulley and the first pulley mount, in accordance with aspects of the present inventive concepts.

FIG. 7 is a perspective front view of an embodiment of the first pulley 400 and the first pulley mount 500 mounted at a first side of the curtain 100, in accordance with aspects of the present inventive concepts. In this embodiment, the first pulley 400 is coupled to a first pulley housing, 401. The first pulley housing is in turn coupled to a first hook 420. In this embodiment, the first hook 420 is coupled to the first pulley mount 500. In alternative embodiments, the first pulley 400 is integral with a top region of the zipper 200. In some embodiments, the first pulley 400 is at an interior region of the first pulley housing 401.

In this embodiment, the first pulley mount 500 comprises a first portion 520 and a second portion 560. In the embodiment shown in FIG. 7, the first portion 520 is constructed and arranged to couple with the second portion 560 such that a portion of the curtain 100 is positioned between them. In the embodiment shown in FIG. 7, the second portion 560 comprises at least one claw 570 that is constructed and arranged to secure the second portion 560 with the first portion 520. In alternative embodiments, the first portion 520 and second portion 560 are coupled using an alternative mechanism. Mechanisms that can be employed for this purpose include curtain clip mechanisms of the various patents incorporated herein by reference, and other mechanisms.

In the embodiment shown in FIG. 7, the first portion 520 comprises a substantially square shape. In alternative embodiments, the first portion 520 comprises a different shape, including, but not limited to, a rectangle, a circle, or any such polygon. In the embodiment shown in FIG. 7, the second portion 560 comprises a substantially square shape. In alternative embodiments, the second portion 560 comprises a different shape, including, but not limited to, a rectangle, a circle, or any such polygon. In some embodiments, the width of the first pulley mount 500 is substantially the same as the width of the zipper 200. In some embodiments, the first portion 520 is constructed and arranged to be slidably coupled to the second portion 560. In some embodiments, the first portion 520 is constructed and arranged to be removably coupled to the second portion 560.

In the embodiment shown in FIG. 7, a front portion of the elongated pull 300*a* extends along a first side of the curtain 100, passes over a top of first pulley 400 and through hole 22 in the curtain 100. In the embodiment shown in FIG. 7, a portion of the elongated pull 300 extends downwards on the second side of the curtain 100. In alternative embodiments, the elongated pull 300 extends along only one side of the curtain 100.

In some embodiments, the first pulley 400 is positioned between the first portion 520 and the second portion 560. In such embodiments, the first portion 520 and/or the second portion 560 comprises an opening and the first pulley 400 is positioned in the opening.

In some embodiments, the elongated pull extends from one side of the first pulley 400, passes through an opening in the first portion, passes through an opening of the second portion, and emerges on a second side of the first pulley 400 (and a second side of the curtain 100). In some embodiments, the elongated pull makes contact with a surface of the first pulley 400. In some embodiments, the elongated pull moves as the zipper is opened and/or closed. Because the elongated pull may be in contact with a surface of the first pulley 400, such motion may cause the first pulley 400 to rotate relative to the first pulley mount.

Figure 8:
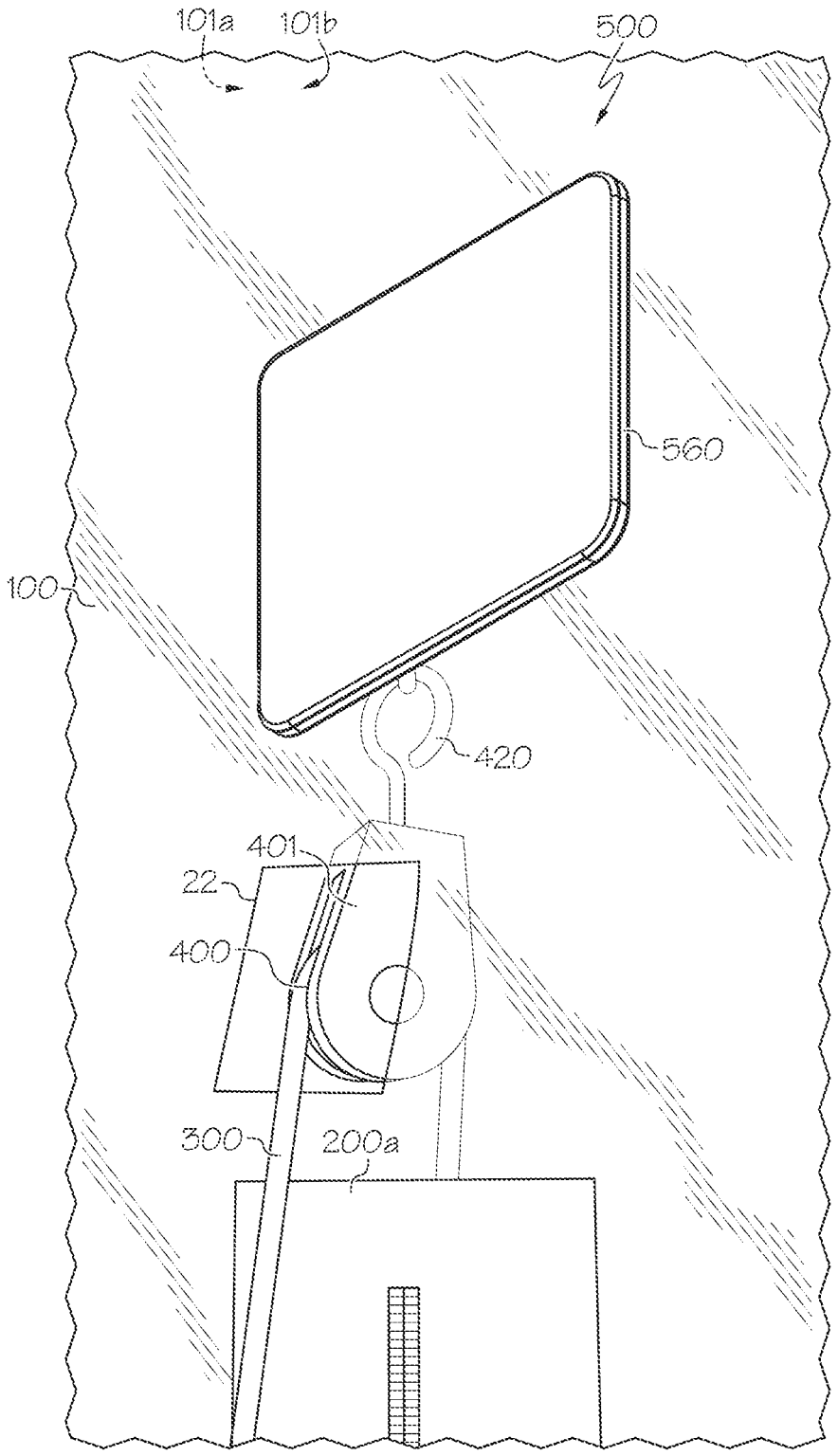
FIG. 8 is a perspective rear view of an embodiment of the first pulley and the first pulley mount, in accordance with aspects of the present inventive concepts.

FIG. 8 is a perspective rear view of an embodiment of the first pulley 400 and the first pulley mount 500 on a second side of the curtain 100, in accordance with aspects of the present inventive concepts. FIG. 8 illustrates the embodiment in FIG. 7, as viewed from the second side 101*b* of the curtain 100. In this view the first hole 22 is visible. The first hole 22 in the curtain 100 is aligned with a position at which the elongated pull 300 passes over the first pulley 400.

Figure 9:
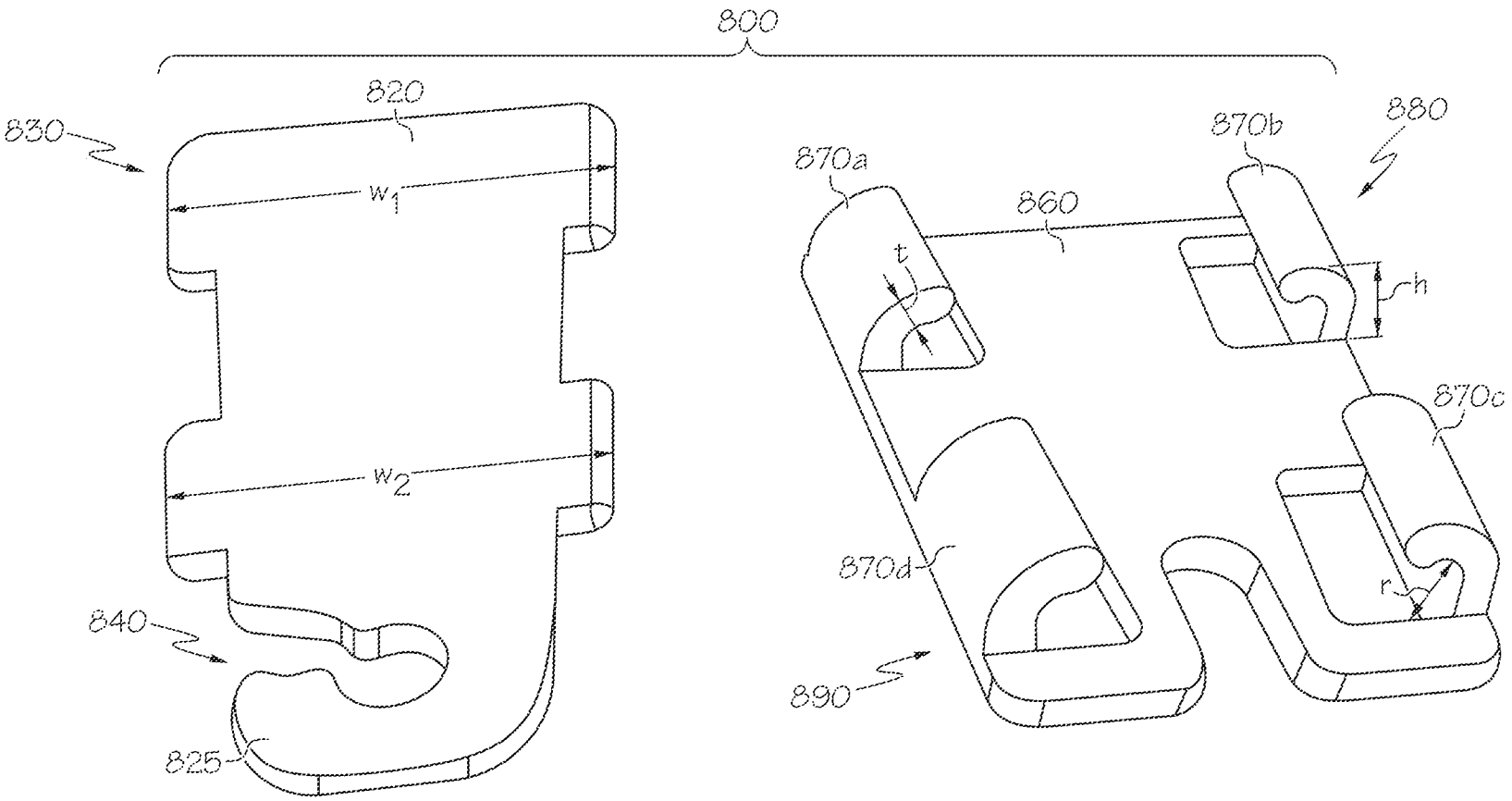
FIG. 9 is a perspective view of an embodiment of a tapered first pulley mount, in accordance with aspects of the present inventive concepts.

FIG. 9 is a perspective view of an embodiment of another embodiment of a first pulley mount 800, in accordance with aspects of the present inventive concepts. In the embodiment shown in FIG. 9, the tapered first portion 820 is constructed and arranged to couple with the tapered second portion 860 such that a portion of the curtain 100 is positioned between them. In this embodiment, the second portion 860 comprises four claws 870*a-d*, including two pairs of opposed claws 870*a*, 870*b* and 870*c*, 870*d*. In alternative embodiments, the second portion 860 comprises a different number of claws. In alternative embodiments, the one or more claws 870 comprise a different length than those shown in FIG. 9. In alternative embodiments, the one or more claws 870 comprise a different height h than those shown in FIG. 9. In alternative embodiments, the one or more claws 870 comprise a different thickness t than those shown in FIG. 9. In alternative embodiments, the one or more claws 870 comprise a different radius of curvature r than those shown in FIG. 9. In alternative embodiments, the first portion 820 and the second portion 860 are coupled using an alternative mechanism.

In the embodiment shown in FIG. 9, a top region 830 of the tapered first portion 820 is wider than a bottom region 840 of the tapered first portion 820. The tapered first portion 820 is reduced in width from the top region 830 where it has a first width w1 in a direction toward the bottom region 840 where is has a second width w2. The first width w1 is greater than the second width w2. In some embodiments, the tapered first portion 820 is of a greater width than the tapered first portion 820 shown in FIG. 9. In some embodiments, the tapered first portion 820 is smaller than the tapered first portion 820 shown in FIG. 9. In some embodiments, the tapered first portion 820 has a more rapid reduction in width over its length than the tapered first portion 820 shown in FIG. 9. In some embodiments, the tapered first portion 820 has a less rapid reduction in width over its length than the tapered first portion 820 shown in FIG. 9.

In the embodiment shown in FIG. 9, the bottom region 840 of the tapered first portion 820 comprises a hook 825 that is constructed and arranged to couple with the first pulley 400. In some embodiments, the hook 825 is integral with the first portion 820.

In the embodiment shown in FIG. 9, a top region 880 of the tapered second portion 860 is wider than a bottom region 890 of the tapered second portion 860. The width of the tapered second portion 860 is reduced from the top region 880 in a direction toward the bottom region 890. In some embodiments, the tapered second portion 860 is of a greater width than the tapered second portion 860 shown in FIG. 9. In some embodiments, the tapered second portion 860 is of a smaller width than the tapered second portion 860 shown in FIG. 9. In some embodiments, the tapered second portion 860 has a more rapid reduction in width over its length than the tapered second portion 860 shown in FIG. 9. In some embodiments, the tapered second portion 860 has a less rapid reduction in width over its length than the tapered second portion 860 shown in FIG. 9.

In some embodiments, the tapered first portion 820 and the tapered second portion 860 are constructed and arranged such that they comprise a substantially similar taper. In some embodiments, the first tapered portion 820 is constructed and arranged to be slidably coupled to the second tapered portion 860. In this manner, the tapered portions can slide relative to each other with a portion of the curtain between them when being coupled to a curtain. In some embodiments, the first tapered portion 820 is constructed and arranged to be removably coupled to the second tapered portion 860 with the curtain therebetween when the portions are mounted to the curtain. In this manner, the portions can be applied and removed manually, by an installer, without the need for tools or other mechanical means. In some embodiments, the first tapered portion 820 is constructed and arranged to be coupled to the second tapered portion 860, such that the hook extends beyond the bottom region 890 of the second tapered portion 860.

Figure 9A:
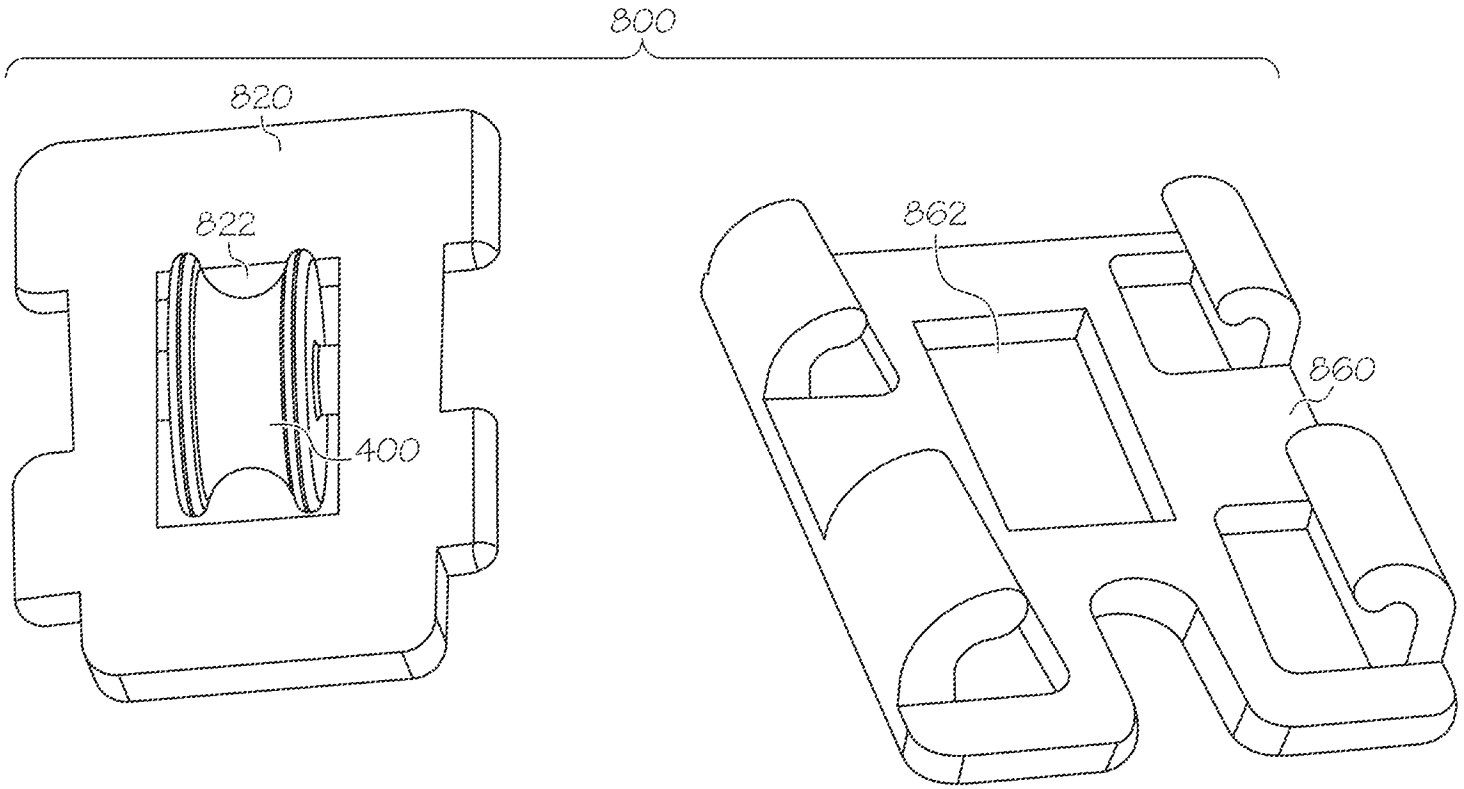
FIG. 9A is a perspective view of an embodiment of a tapered first pulley mount, in accordance with aspects of the present inventive concepts.

FIG. 9A is a perspective view of an embodiment of a tapered first pulley mount 800, in accordance with aspects of the present inventive concepts. In this embodiment, the first tapered portion 820 comprises an opening 822. In this embodiment, the tapered second portion 860 comprises an opening 862. In the embodiment shown in FIG. 9A the first pulley 400 is positioned in the opening 822 of the tapered first portion 820. With the pulley 400 positioned in an opening 822 of the first portion 820, the pulley can be said to be positioned at an interior region of the first portion 820. In other words, the pulley 400 is not positioned at or beyond an outer perimeter of the first portion 820, but rather at an interior region thereof. In alternative embodiments, the first pulley 400 is positioned in the opening 862 of the tapered second portion 860. In some embodiments, the pulley 400 is integral with the first and/or second portions 820, 860.

In some embodiments, the elongated pull extends from one side of the first pulley 400, passes through the opening 822 in the tapered first portion 820, passes through the opening 862 of the tapered second portion 860, and emerges on a second side of the first pulley 400 (and a second side of the curtain 100). In some embodiments, the elongated pull makes contact with a surface of the first pulley 400. In some embodiments, the elongated pull moves as the zipper is opened and/or closed. Because the elongated pull may be in contact with a surface of the first pulley 400, such motion may cause the first pulley 400 to rotate relative to the first pulley mount 800.

In other embodiments the pulley mount 800 can comprise a first plate and a second plate that are magnetically coupled to each other through the curtain.

Figure 9B:
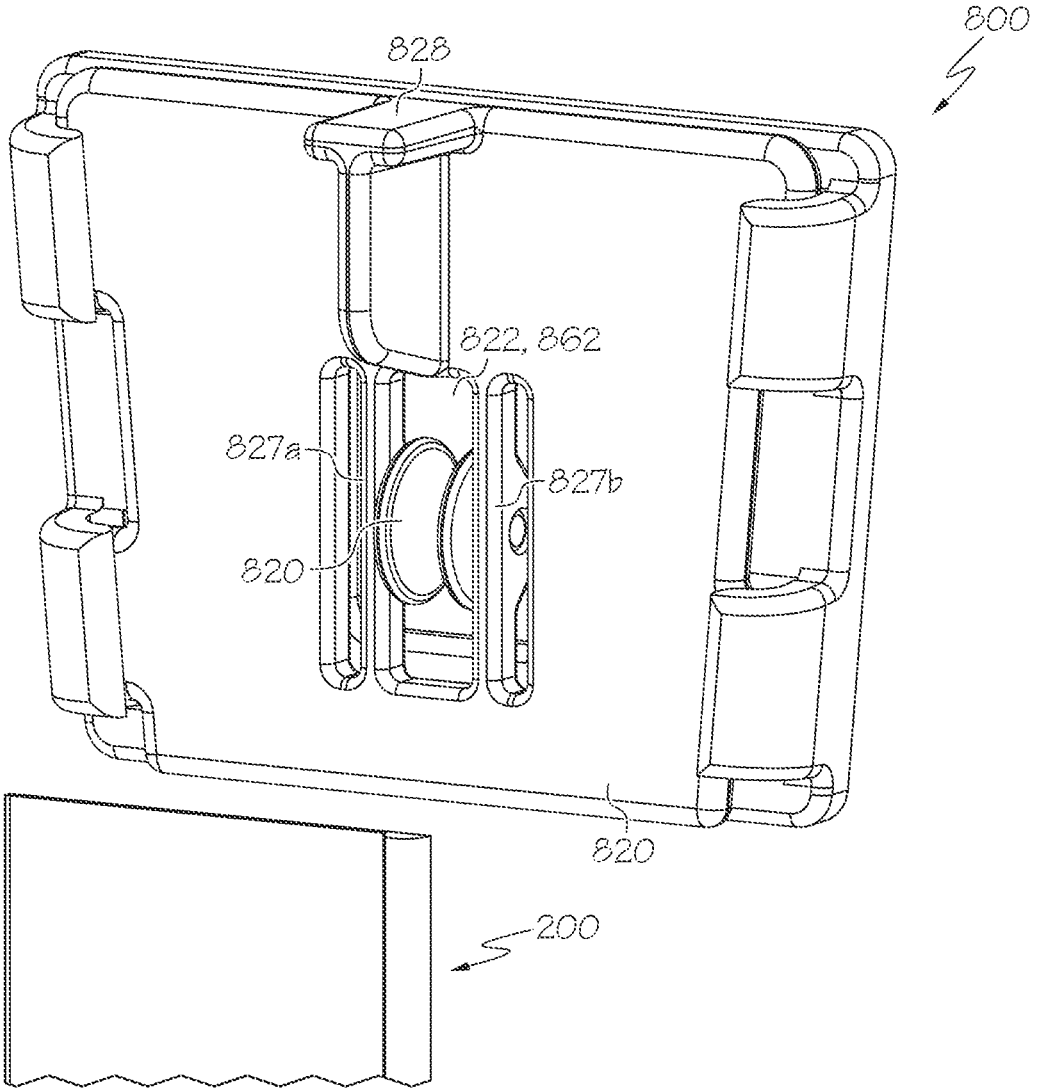
FIG. 9B is a perspective view of an embodiment of a tapered first pulley mount, in accordance with aspects of the present inventive concepts.

FIG. 9B is a perspective view of an embodiment of a tapered first pulley mount 800, in accordance with aspects of the present inventive concepts. In this embodiment, the tapered first portion 820 comprises an opening 822. In this embodiment, the tapered second portion 860 comprises an opening 862. In the embodiment shown in FIG. 9A the first pulley 400 is positioned in the opening 822 of the tapered first portion 820. In alternative embodiments, the first pulley 400 is positioned in the opening 862 of the tapered second portion 860. With the pulley 400 positioned in an opening 822 of the first portion 820, the pulley can be said to be positioned at an interior region of the first portion 820. In other words, the pulley 400 is not positioned at or beyond an outer perimeter of the first portion 820, but rather at an interior region thereof. In some embodiments, the pulley 400 is integral with the first and/or second portions 820, 860.

In this embodiment the first pulley 400 is coupled to two pulley posts 827*a, b*. In this embodiment, the two pulley posts 827*a, b* are coupled to tapered first portion 820. In alternative embodiments, the two pulley posts 827*a, b* are coupled to tapered second portion 820. In some embodiments, one or more of the pulley posts 827 comprises plastic. In alternative embodiments, one or more of the pulley posts 827 comprise metal, wood, composite, or any such suitable material.

In the embodiment shown in FIG. 9B, the tapered first portion 820 comprises a handle 828. In the embodiment shown in FIG. 9B, the handle 828 comprises a T-shape. In alternative embodiments, the handle 828 comprises different shapes suitable for gripping the tapered first portion 820. In the embodiment shown in FIG. 9B, the handle 828 is integrated with the tapered first portion 820. In alternative embodiments, the handle 828 is coupled to the tapered first portion 820 using tape, glue, magnets, or any such suitable attachment mechanism.

FIG. 9B1 is a perspective rear view of an embodiment of a tapered first portion 820, in accordance with aspects of the present inventive concepts. In this embodiment the tapered first portion 820 comprises two pulley posts 827*a, b*. In this embodiment, each pulley post 827 comprises a recessed region 829*a, b*. The presence of the recessed region 829 allows for easier insertion of the first pulley 400.

In some embodiments, the pulley posts 827 comprise a material that allows for some degree of movement. In the embodiment shown in FIG. 9B1 a slot 826*a, b* is located next to each pulley post 827*a, b*. The presence of the slot 826 provides each pulley post 827 with some space to move, in order to facilitate easier insertion of the first pulley 400.

In some embodiments, the tapered first portion does not comprise pulley posts 827 and does not comprises slots 826. In such embodiments, the pulley is coupled directly to the tapered first portion 820 near the opening 822.

Figure 9C:
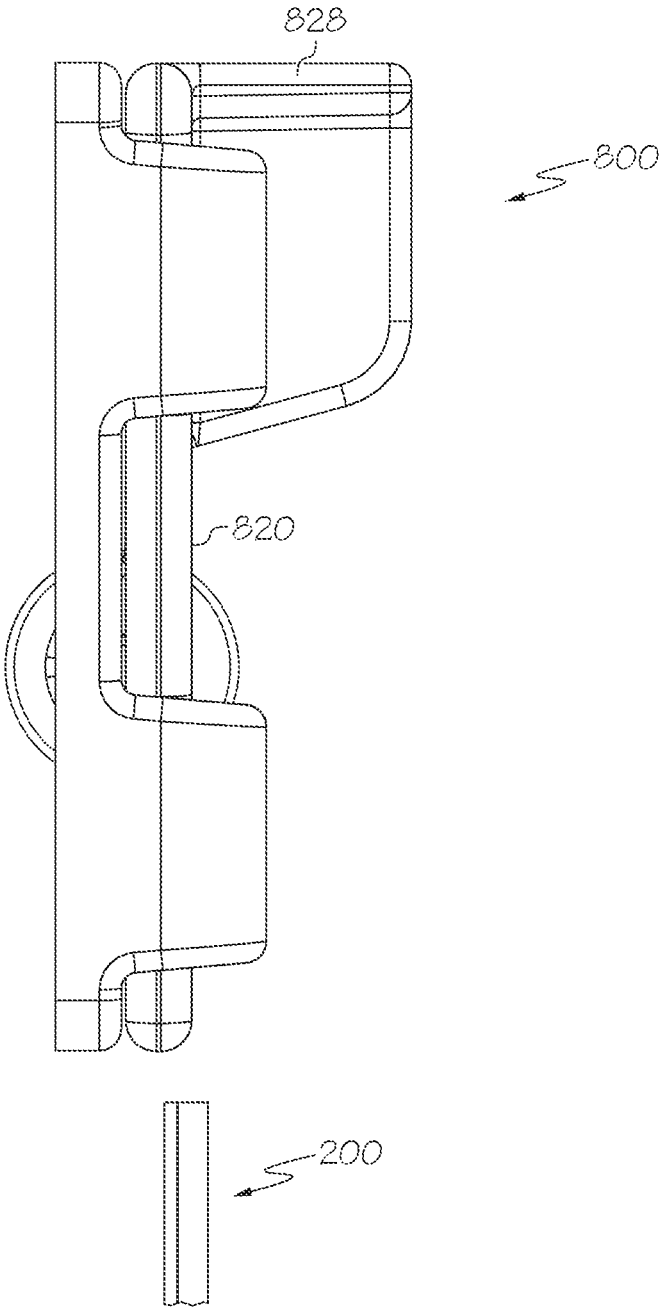
FIG. 9C is a side view of the embodiment of FIG. 9B, in accordance with aspects of the present inventive concepts.

FIG. 9C is a side view of the embodiment of FIG. 9B, in accordance with aspects of the present inventive concepts. In the view of FIG. 9B, the side dimensions of the handle 828, in this embodiment, are more clearly visible.

Figure 9D:
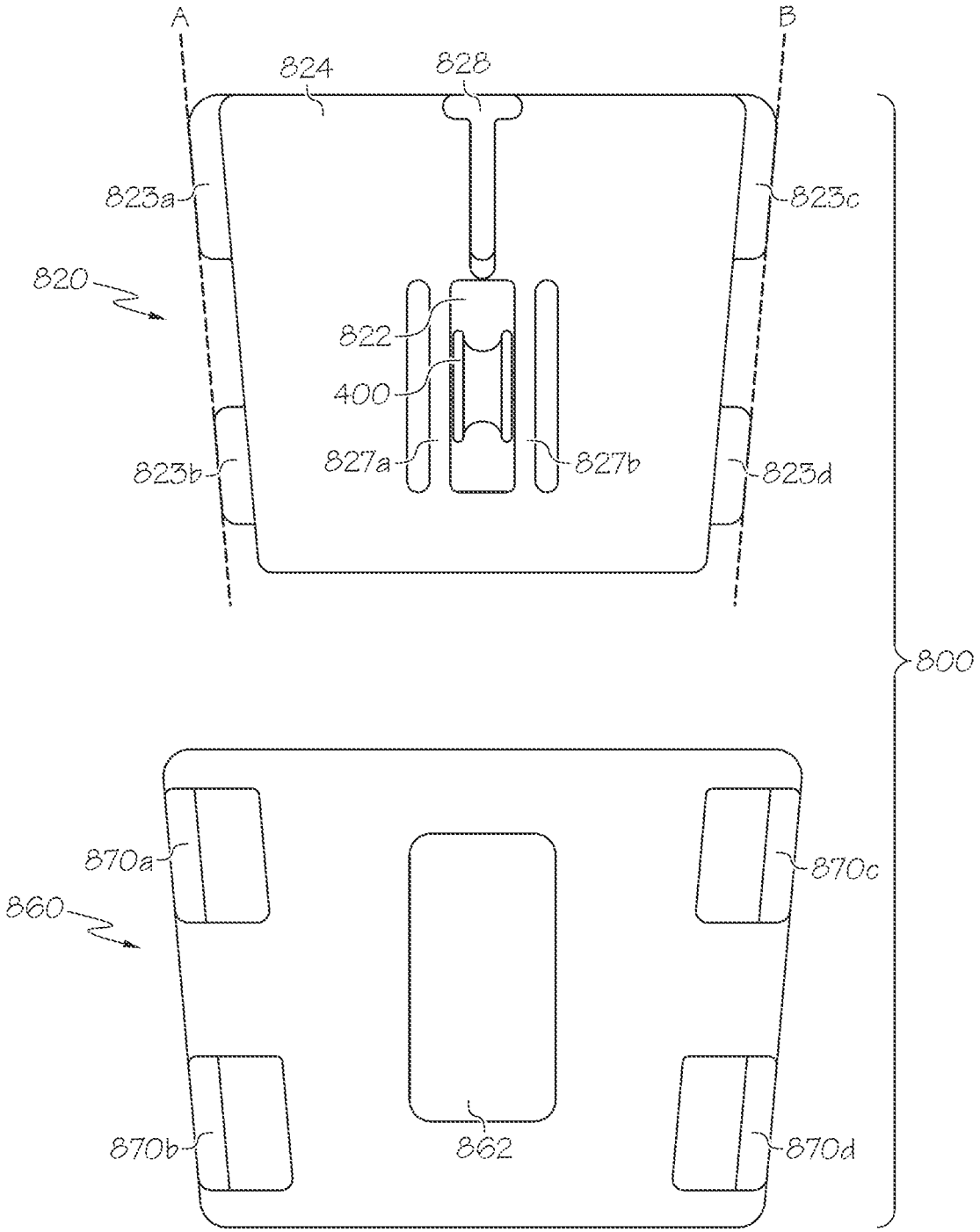
FIG. 9D is a front view of an embodiment of a tapered first pulley mount, in accordance with aspects of the present inventive concepts.

FIG. 9D is a front view of an embodiment of a tapered first pulley mount 800, in accordance with aspects of the present inventive concepts. In this embodiment, a tapered first portion 820 comprises an opening 822. In this embodiment, a tapered second portion 860 comprises an opening 862. In the embodiment shown in FIG. 9D the first pulley 400 is positioned in the opening 822 of the tapered first portion 820.

In this embodiment the first pulley 400 is coupled to two pulley posts 827*a, b*. In this embodiment, the two pulley posts 827*a, b* are coupled to the tapered first portion 820. In some embodiments, one or more of the pulley posts 827 comprises plastic. In alternative embodiments, one or more of the pulley posts 827 comprise metal, wood, composite, or any such suitable material.

In the embodiment shown in FIG. 9D, the tapered first portion 820 comprises a handle 828. In the embodiment shown in FIG. 9D, the handle 828 comprises a T-shape. In alternative embodiments, the handle 828 comprises different shapes suitable for gripping the tapered first portion 820. In the embodiment shown in FIG. 9D, the handle 828 is integrated with the tapered first portion 820. In alternative embodiments, the handle 828 is coupled to the tapered first portion 820 using tape, glue, magnets, or any such suitable attachment mechanism.

In the embodiment shown in FIG. 9D, the tapered first portion 820 comprises a central region 824 and four extensions 823*a-d*. In this embodiment, when the tapered first portion 820 is coupled to the tapered second portion 860, each extension 823 corresponds to a claw 870 at the tapered second portion 860. In the embodiment shown, the outer edge of two extensions 823*a, b* are parallel with line A. In the embodiment shown, the outer edge of two extensions 823*c, d* are parallel with line B. In this embodiment, one side of the central region 824 is parallel with line A and the other side is parallel with line B.

Figure 9E:
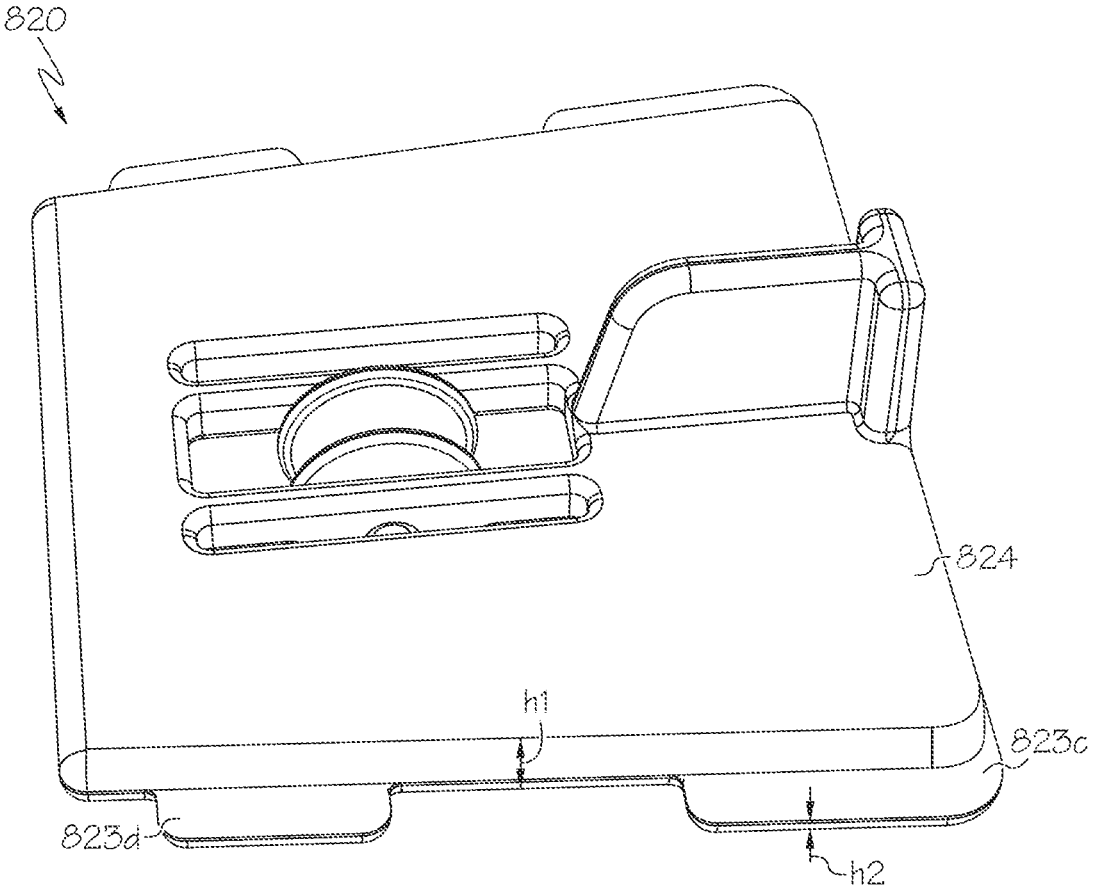
FIG. 9E is a side perspective view of an embodiment of the tapered first portion from FIG. 9D, in accordance with aspects of the present inventive concepts.

FIG. 9E is a side perspective view of an embodiment of the tapered first portion from FIG. 9D, in accordance with aspects of the present inventive concepts. In this embodiment, the central region of the tapered first portion 820 is at a first height h1 and the extensions 823 are at a second height h2.

Figure 9F:
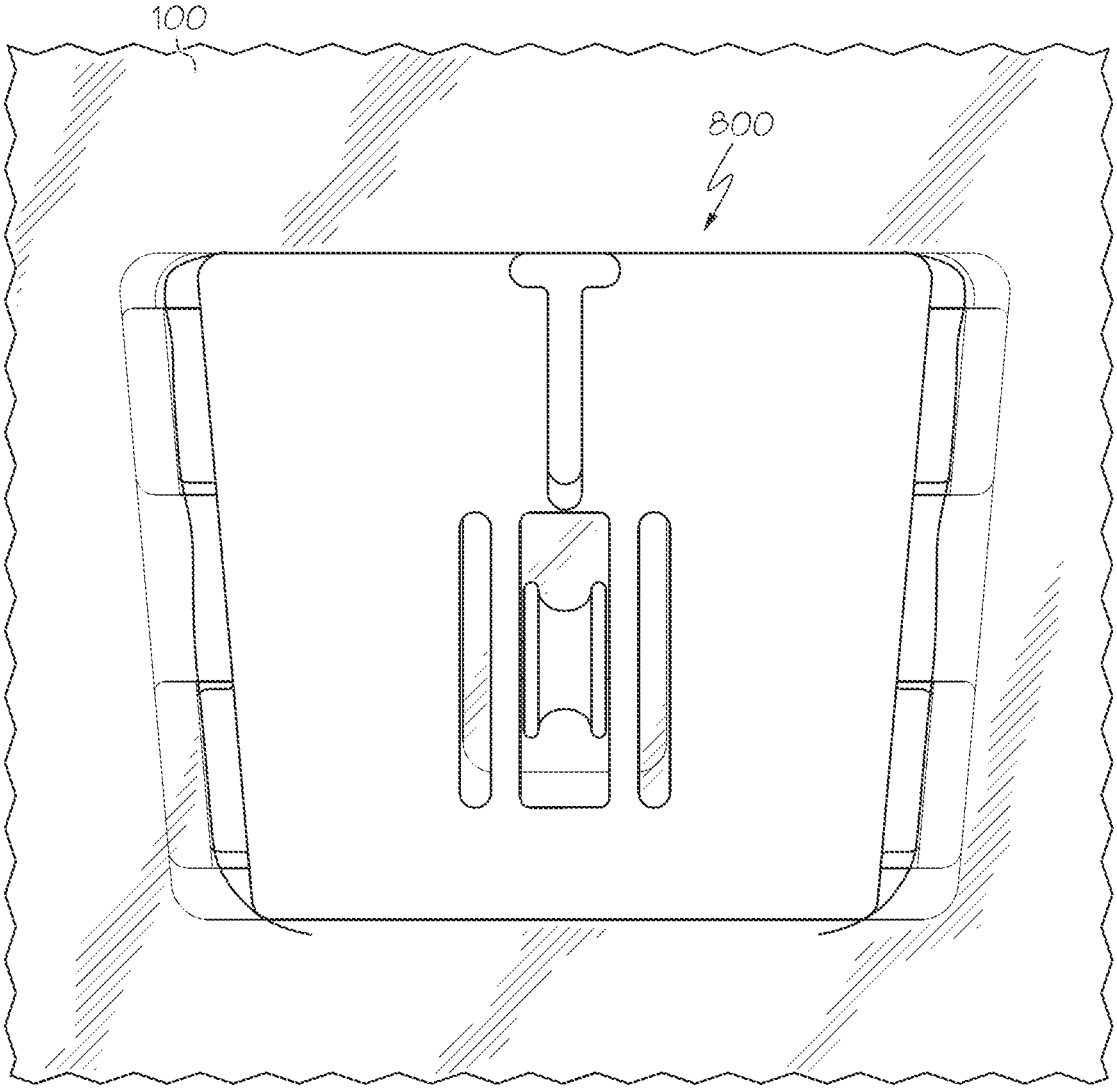
FIG. 9F is a front view of an embodiment of a tapered first pulley mount mounted to a curtain, in accordance with aspects of the present inventive concepts.

FIG. 9F is a perspective view of an embodiment of a tapered first pulley mount 800 mounted to a curtain 100, in accordance with aspects of the present inventive concepts. In this embodiment, the first pulley mount 800 is suspended by the curtain 100. In this embodiment, the tapered first portion 820 is coupled to the tapered second portion 860 and the curtain 100 is pinched between them. In this embodiment, the extensions 823 inserted beneath the claws 870 from the top and can only be removed from the top.

Figure 9G:
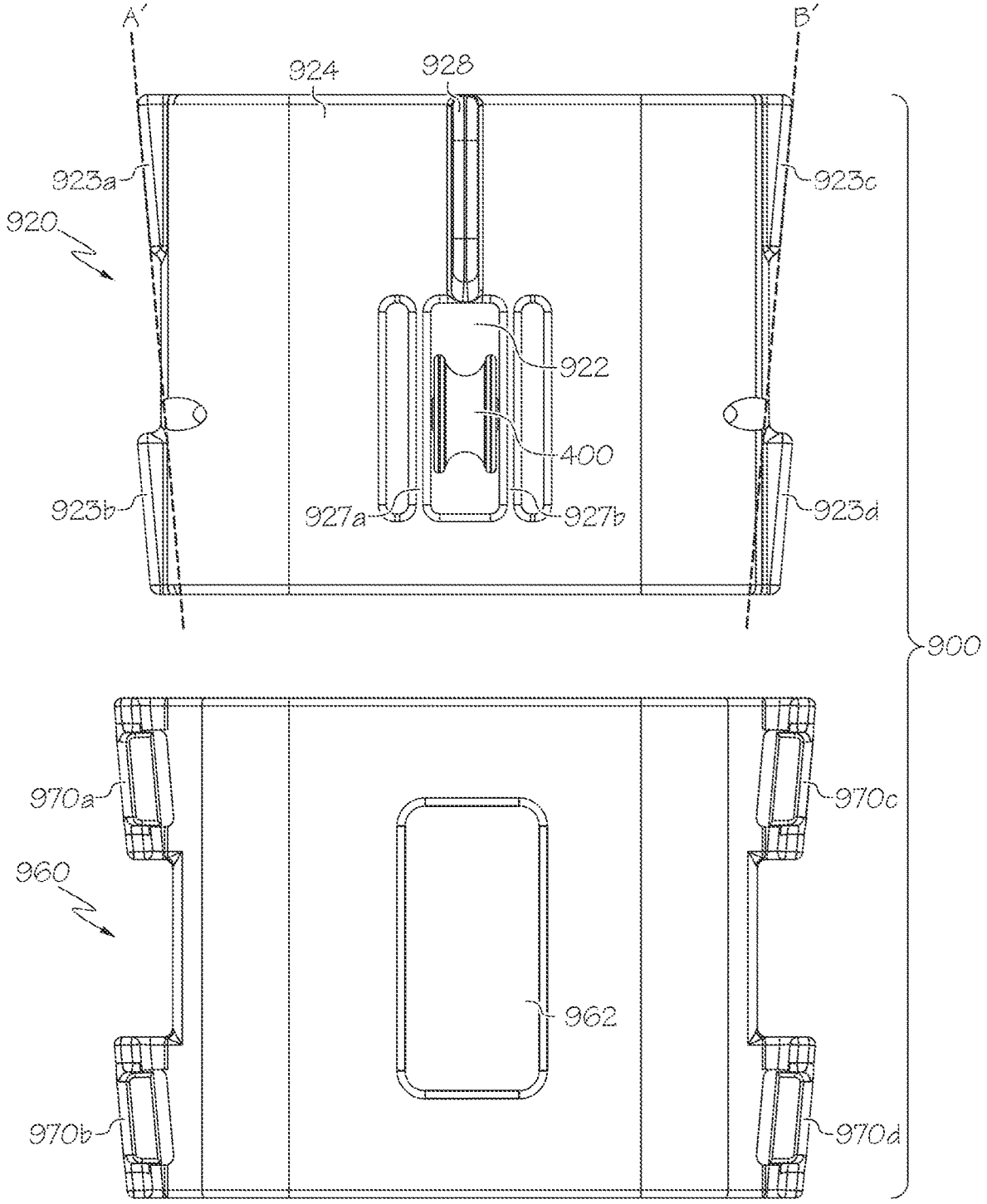
FIG. 9G is a front view of an embodiment of a curved first pulley mount, in accordance with aspects of the present inventive concepts.

FIG. 9G is a front view of an embodiment of a curved first pulley mount 900, in accordance with aspects of the present inventive concepts. The curved first pulley mount 900 comprises a first portion 920 and a second portion 960. In this embodiment, the first portion 920 comprises an opening 922. In this embodiment, the second portion 960 comprises an opening 962. In the embodiment shown in FIG. 9G the first pulley 400 is positioned in the opening 922 of the first portion 920. In alternative embodiments, the first pulley 400 is positioned in the opening 962 of the second portion 960. With the pulley 400 positioned in an opening 962 of the first portion 920, the pulley can be said to be positioned at an interior region of the first portion 920. In other words, the pulley 400 is not positioned at or beyond an outer perimeter of the first portion 920, but rather at an interior region thereof. In some embodiments, the pulley 400 is integral with the first and/or second portions 920, 960.

In this embodiment the first pulley 400 is coupled to two pulley posts 927*a, b*. In this embodiment, the two pulley posts 927*a, b* are coupled to first portion 920. In some embodiments, one or more of the pulley posts 927 comprises plastic. In alternative embodiments, one or more of the pulley posts 927 comprise metal, wood, composite, or any such suitable material.

In the embodiment shown in FIG. 9G, the first portion 920 comprises a handle 928. In the embodiment shown in FIG. 9G, the handle 928 comprises a T-shape. In alternative embodiments, the handle 928 comprises different shapes suitable for gripping the first portion 920. In the embodiment shown in FIG. 9G, the handle 928 is integrated with the first portion 920. In alternative embodiments, the handle 928 is coupled to the first portion 920 using tape, glue, magnets, or any such suitable attachment mechanism.

In the embodiment shown in FIG. 9G, the first portion 920 comprises a central region 924 and four extensions 923*a-d*. In this embodiment, when the first portion 920 is coupled to the tapered second portion 960, each extension 923 corresponds to a claw 970 at the second portion 960. In the embodiment shown, the outer edge of two extensions 923*a, b* are parallel with line A'. In the embodiment shown, the outer edge of two extensions 923*c, d* are parallel with line B'. In this embodiment, the edges of the central region 924 are transverse relative to line A'. In this embodiment, the edges of the central region 924 are transverse relative to line B'.

In the embodiment shown in FIG. 9G each claw 970 comprises an opening. In alternative embodiments, one or more of the claws does not comprise an opening. In alternative embodiments, the curved first pulley mount 900 comprises a different number of extensions and claws.

In the embodiment shown in FIG. 9G, the first portion 920 comprises two indentations, one on each side. In alternative embodiments, the first portion 920 does not comprise indentations.

Figure 9H:
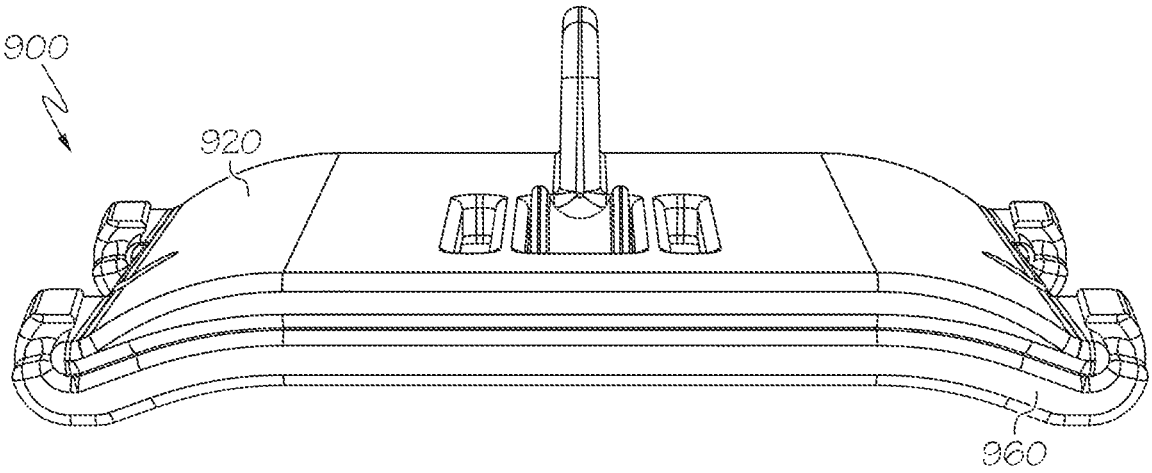
FIG. 9H is a bottom perspective view of an embodiment of a curved first pulley mount, in accordance with aspects of the present inventive concepts.
Figure 91:
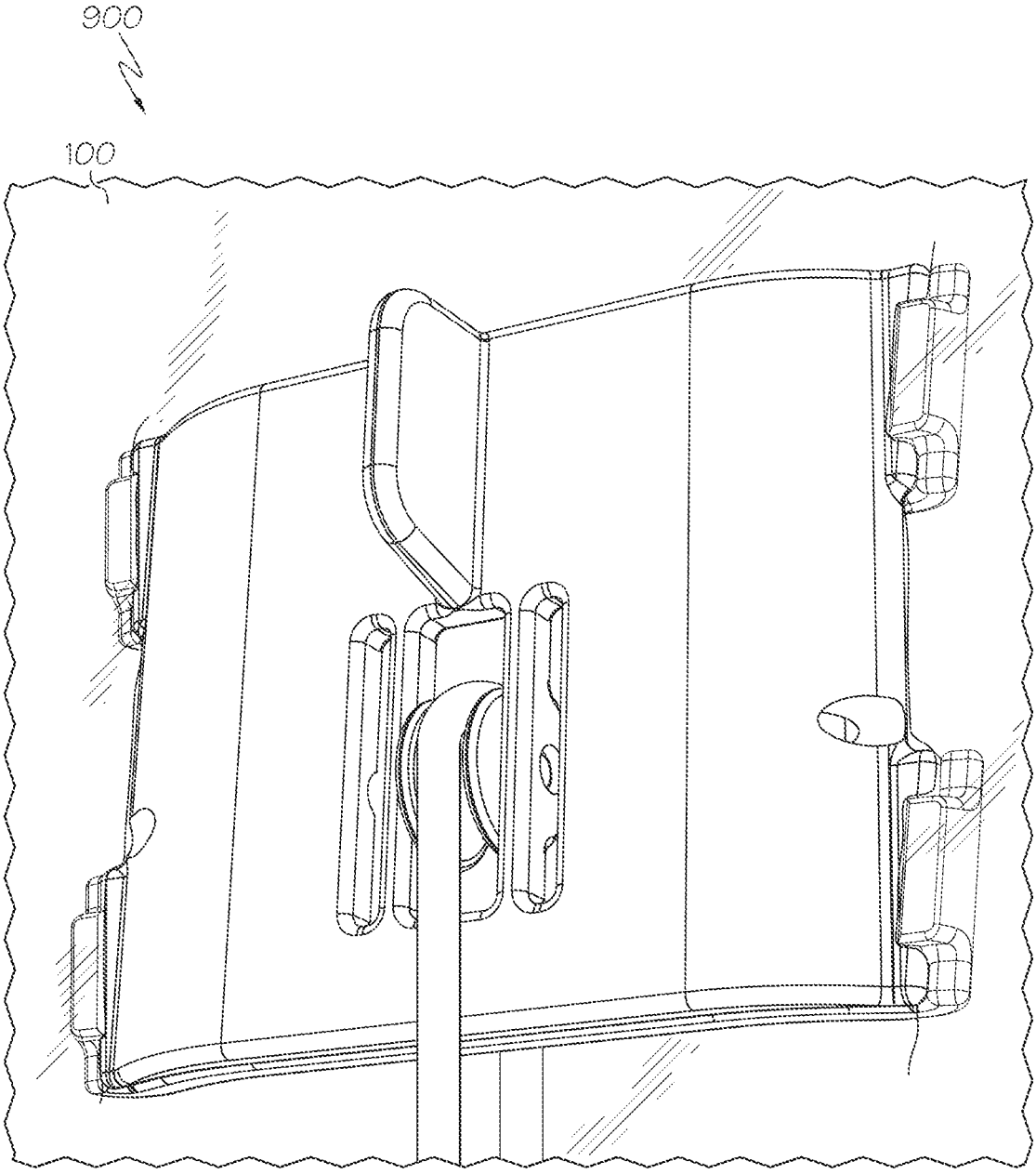

FIG. 9H is a bottom perspective view of an embodiment of a curved first pulley mount 900, in accordance with aspects of the present inventive concepts. In this embodiment, the first portion 920 is curved such that the regions near the extensions 923 are lower than the regions near the center. In this embodiment, the second portion 960 is curved such that the regions near the claws 970 are lower than the regions near the center. In some embodiments, the first tapered portion 920 is constructed and arranged to be slidably coupled to the second tapered portion 960. In this manner, the tapered portions can slide relative to each other with a portion of the curtain between them when being coupled to a curtain. In this manner, the tapered portions can slide relative to each other with a portion of the curtain between them when being coupled to a curtain. In this manner, the portions can be applied and removed manually, by an installer, without the need for tools or other mechanical means.

FIG. 9I is a front perspective view of an embodiment of a curved first pulley mount 900 mounted to a curtain 100, in accordance with aspects of the present inventive concepts. In this embodiment, the curved first pulley mount 900 is suspended by the curtain 100. In this embodiment, the first portion 920 is coupled to the second portion 960 and the curtain 100 is pinched between them. In this embodiment, one or more extensions 923 inserted beneath a corresponding one or more claws 970 from the top and can only be removed from the top. In some embodiments, when the curtain 100 is coupled between the extensions 923 and the claws 970, the curtain 100 is pulled toward the second portion 960. The curved first portion 920 and curved second portion 960 at least partially compensate for this pull, in an effort to keep the front of the first portion 920 approximately flush with the surface of the curtain 100 on the side of the first portion 920.

Figure 9J:
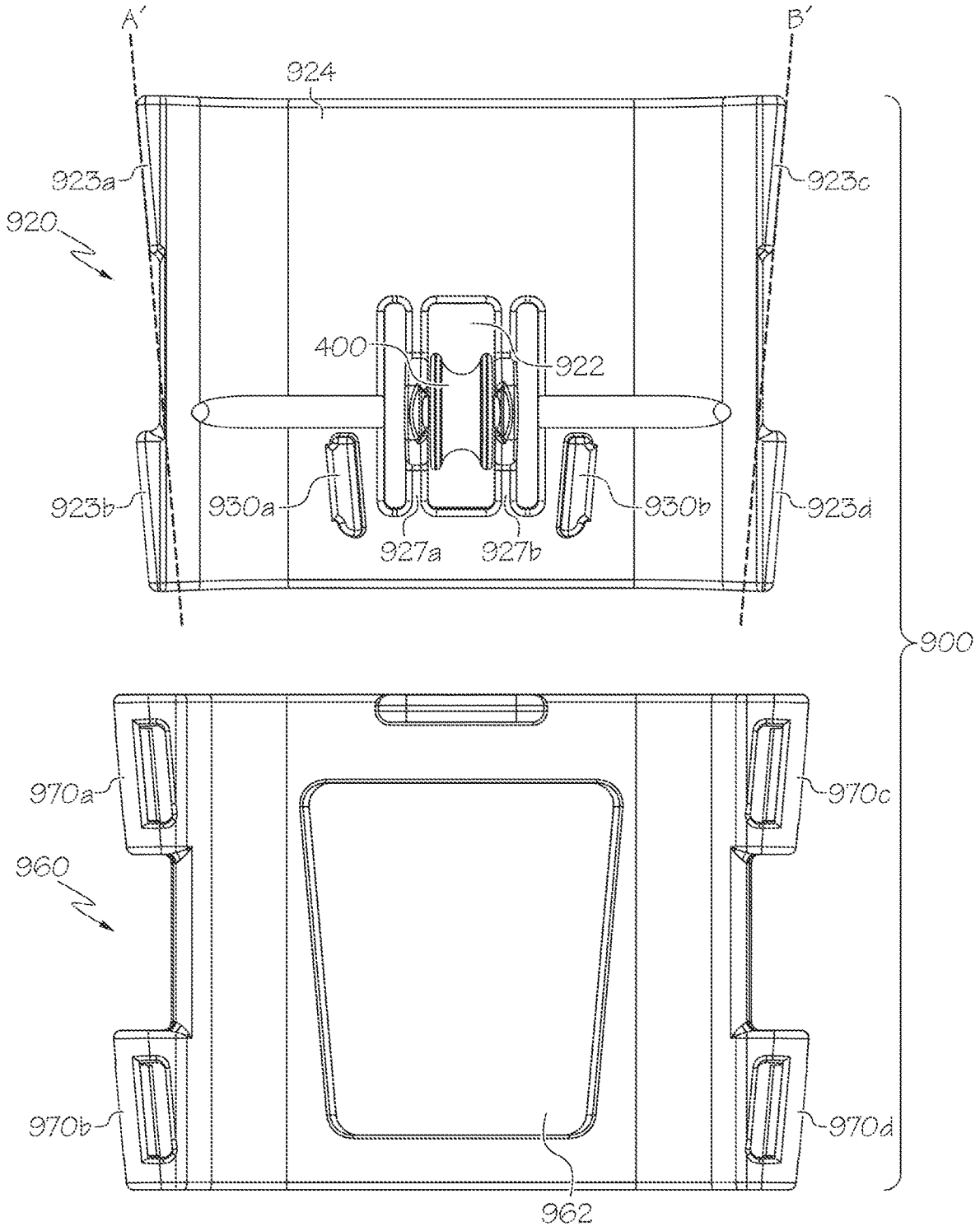
FIG. 9J is a rear view of an alternative embodiment of a curved first pulley mount, in accordance with aspects of the present inventive concepts.

FIG. 9J is a rear view of an alternative embodiment of a curved first pulley mount 900, in accordance with aspects of the present inventive concepts. The embodiment shown in FIG. 9J is similar to the embodiment shown in FIGS. 9G-9I, however there are a few differences. In the embodiment shown in FIG. 9J the first portion 920 comprises two alignment tabs 930*a*, 930*b*. The alignment tabs are constructed and arranged to facilitate easier alignment of the first portion 920 and the second portion 960. The one or more alignment tabs are constructed and arranged such that they mate with one or more edges of the opening 962 of the second portion 960.

In the embodiment shown in FIG. 9J the first portion 920 comprises two alignment tabs 930*a, b*. In alternative embodiments, the first portion 920 comprises one alignment tab. In alternative embodiments, the first portion 920 comprises more than two alignment tabs. In alternative embodiments, the first portion 920 does not comprise an alignment tab.

In the embodiment shown in FIG. 9J the alignment tabs are arranged to align with the lower side edges of the opening 962 of the second portion 960. In alternative embodiments, the one or more alignment tabs are arranged to align with one or more different regions of the edge of the opening 962 of the second portion 960.

In the embodiment shown in FIG. 9J the alignment tabs are elongated with rounded edges. In alternative embodiments, the one or more alignment tabs comprises a different shape such as a circle, a triangle, square, or any such polygon.

In the embodiment shown in FIG. 9J the alignment tabs 930*a, b* comprise an edge elongated along a direction transverse to the top edge of the first portion 920. In some embodiments, one or more alignment tabs comprise an edge elongated along a direction parallel to line A'. In some embodiments, one or more alignment tabs comprise an edge elongated along a direction parallel to line B'. In some embodiments, one or more alignment tabs comprise an edge aligned orthogonal to the top edge of the first portion 920.

In the embodiment shown in FIG. 9J the second portion 960 comprises a handle 980. In alternative embodiments, the second portion 960 comprises more than one handle. In alternative embodiments, the second portion 960 does not comprise a handle. In the embodiment shown in FIG. 9J, the handle 980 comprises a rectangular shape with rounded edges. In alternative embodiments, the one or more handle comprises a different shape such as a circle, a triangle, square, or any such polygon. In some embodiments, the handle does not comprise rounded edges. In the embodiment shown in FIG. 9J the handle 980 is located at the top region of the second portion 960. In alternative embodiments, the handle is located at a different location.

In the embodiment shown in FIG. 9J the opening 962 of the second portion 960 comprises edges in the shape of a trapezoid with rounded corners. In alternative embodiments, the second portion comprises edges in a different shape such as a circle, a triangle, rectangle, square, or any suitable polygon. In some embodiments, the opening 962 does not comprise rounded corners.

Figure 9K:
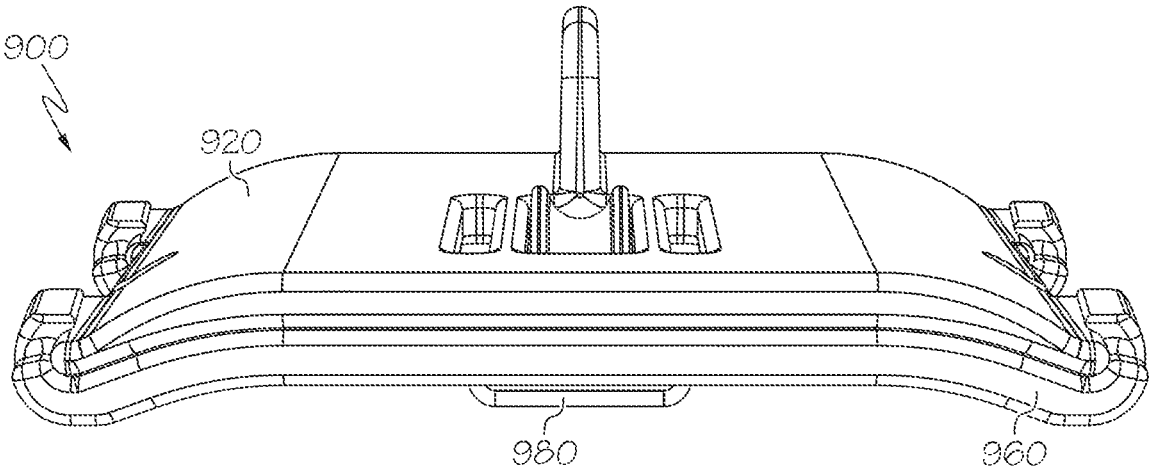
FIG. 9K is a bottom perspective view of an embodiment of a curved first pulley mount, in accordance with aspects of the present inventive concepts.

FIG. 9K is a bottom perspective view of an embodiment of a curved first pulley mount 900, in accordance with aspects of the present inventive concepts. In this embodiment, the first portion 920 is curved such that the regions near the extensions 923 are lower than the regions near the center. In this embodiment, the second portion 960 is curved such that the regions near the claws 970 are lower than the regions near the center.

Figure 9L:
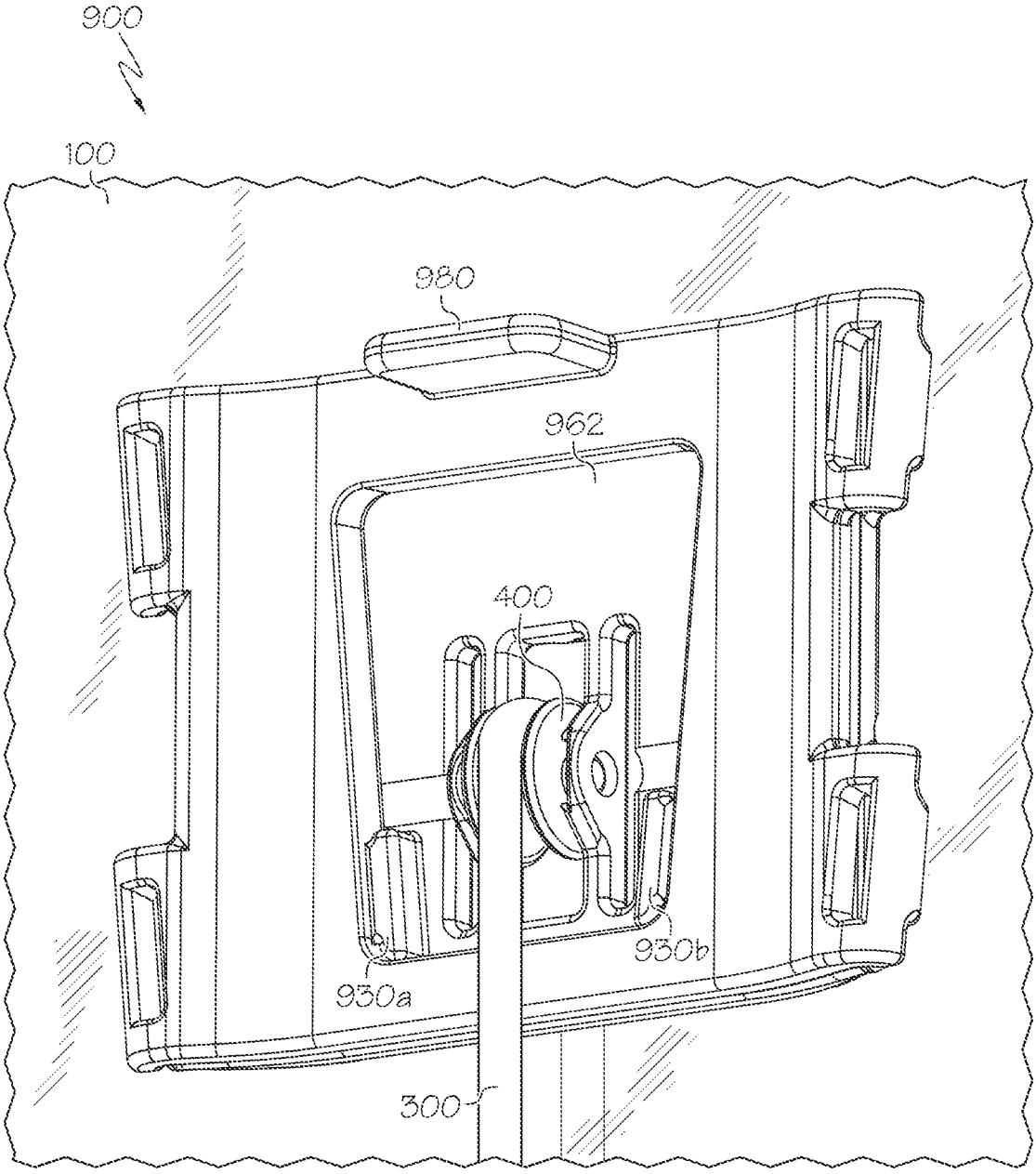
FIG. 9L is a rear perspective view of an embodiment of a curved first pulley mount mounted to a curtain, in accordance with aspects of the present inventive concepts.

FIG. 9L is a rear perspective view of an embodiment of a curved first pulley mount 900 mounted to a curtain 100, in accordance with aspects of the present inventive concepts. In this embodiment, the curved first pulley mount 900 is suspended by the curtain 100. In this embodiment, the first portion 920 is coupled to the second portion 960 and the curtain 100 is pinched between them. In this embodiment, one or more extensions 923 inserted beneath a corresponding one or more claws 970 from the top and can only be removed from the top. In some embodiments, when the curtain 100 is coupled between the extensions 923 and the claws 970, the curtain 100 is pulled toward the second portion 960. The curved first portion 920 and curved second portion 960 at least partially compensate for this pull, in an effort to keep the front of the first portion 920 approximately flush with the surface of the curtain 100 on the side of the first portion 920. The alignment tabs 930*a, b* are constructed and arranged to facilitate easier alignment of the first portion 920 and the second portion 960.

Figure 9M:
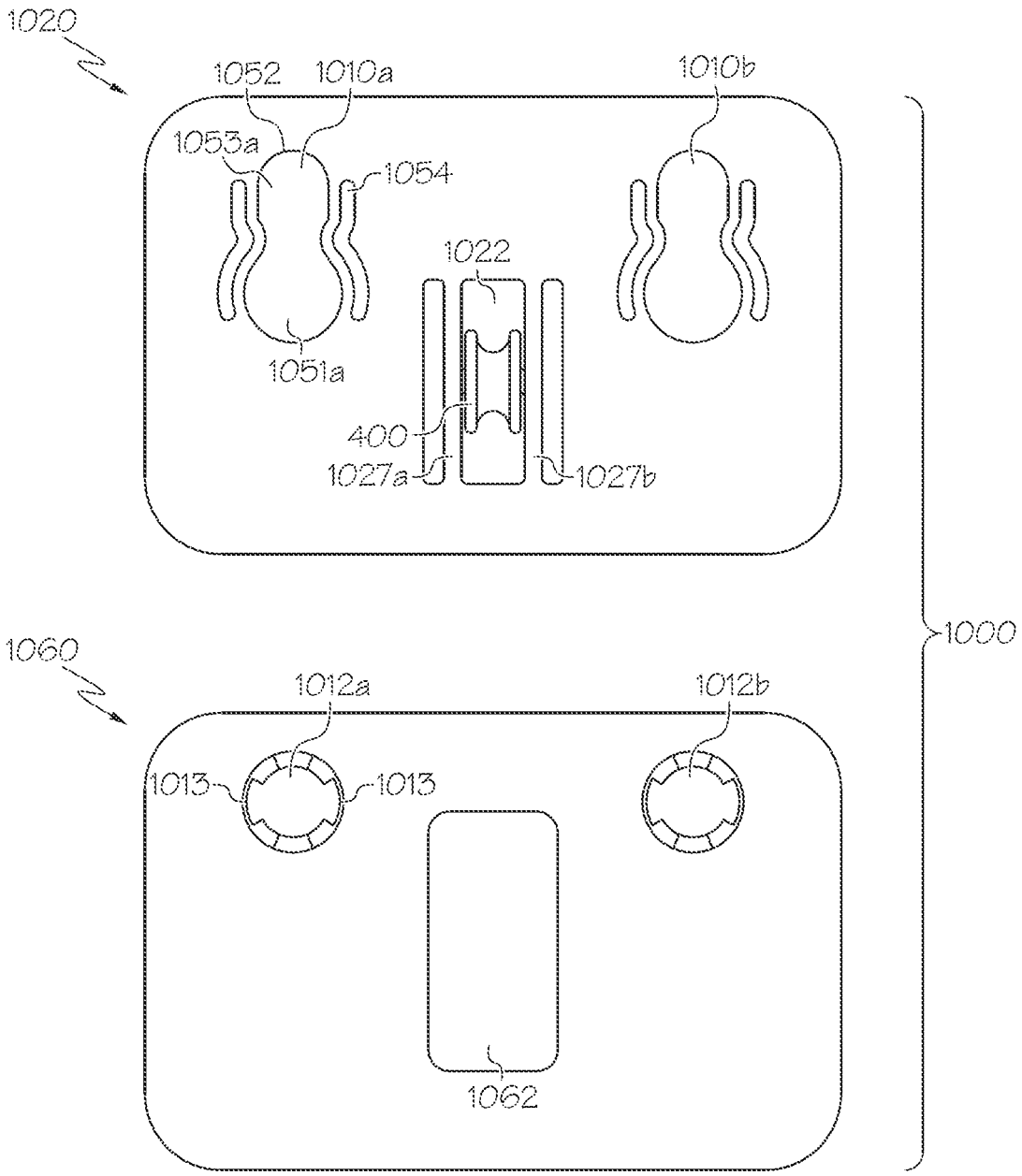
FIG. 9M is a front view of an embodiment of a pin-aperture first pulley mount, in accordance with aspects of the present inventive concepts.

FIG. 9M is a front view of an embodiment of a pin-aperture first pulley mount 1000, in accordance with aspects of the present inventive concepts. In this embodiment, a first portion 1020 comprises an opening 1022. In this embodiment, a second portion 1060 comprises an opening 1062. In the embodiment shown in FIG. 9M the first pulley 400 is positioned in the opening 1022 of the first portion 1020. In alternative embodiments, the first pulley 400 is positioned in the opening 1062 of the second portion 1060.

In this embodiment the first pulley 400 is coupled to two pulley posts 1027*a, b*. In this embodiment, the two pulley posts 1027*a, b* are coupled to first portion 1020. In some embodiments, one or more of the pulley posts 1027 comprises plastic. In alternative embodiments, one or more of the pulley posts 1027 comprise metal, wood, composite, or any such suitable material.

In the embodiment shown in FIG. 9M, the first portion 1020 does not comprise a handle. In some embodiments, the first portion 1020 comprises a handle. In some embodiments, the first portion 1020 comprises a T-shaped handle. In alternative embodiments, the handle comprises different shapes suitable for gripping the first portion 1020. In some embodiments, the handle is integrated with the first portion 1020. In alternative embodiments, the handle is coupled to the first portion 1020 using tape, glue, magnets, or any such suitable attachment mechanism.

In the embodiment shown in FIG. 9M, the first portion 1020 comprises two apertures 1010*a, b*. In alternative embodiments, the first portion 1020 comprises a different number of apertures 1010. In this embodiment, the apertures 1010*a*, 1010*b* are in the shape of a relatively large keyhole 1051 that extends into a relatively narrow slot 1053. In this embodiment, flex grooves 1054 are formed through the body of the first portion 1020 and spaced apart a suitable distance from sidewalls 1052 of the apertures 1010*a*, 1010*b*. The flex grooves 1054 provide the aperture sidewalls 1052 with a suitable degree of flexibility.

In this embodiment, the second portion comprises two pins 1012*a, b* that extend from its lower surface. The pins 1012 include retaining knobs or lobes 1013 at their distal ends. In some embodiments, the pins 1012 and retaining knobs 1013 are configured such that the second portion 1060 can be formed in a straight-pull molding process.

Figure 9N:
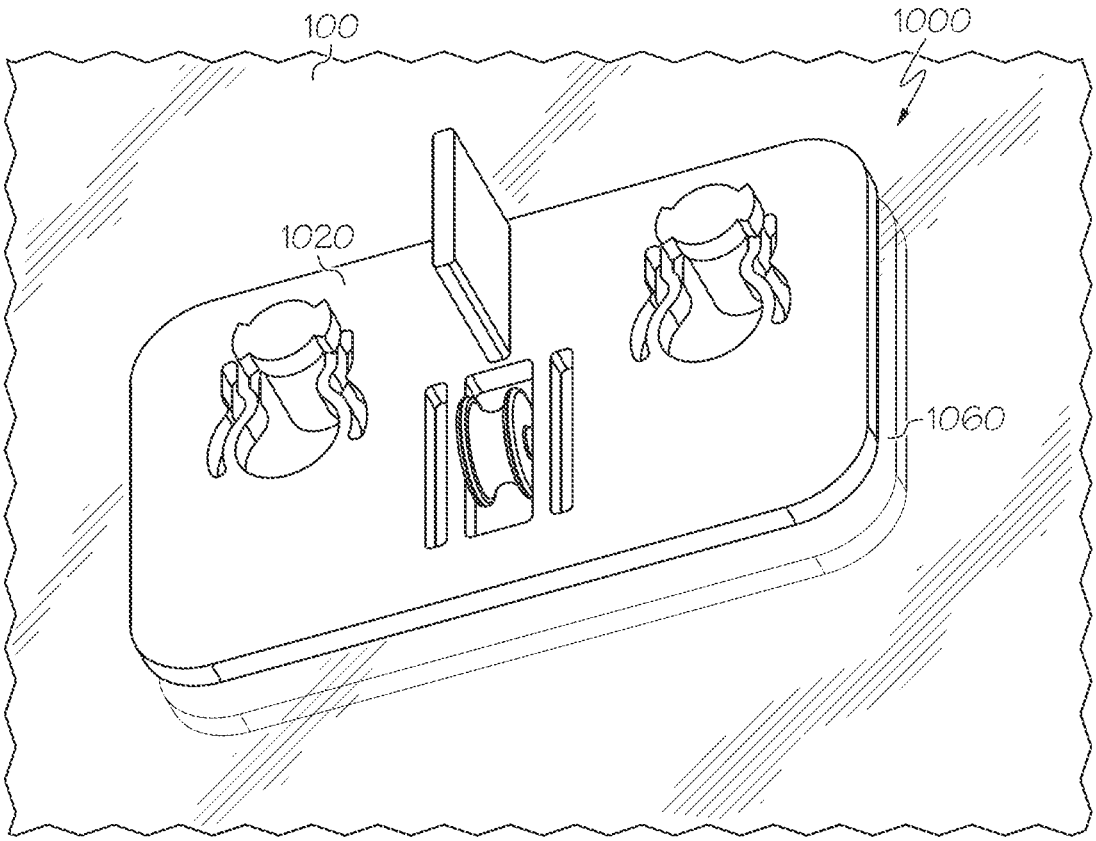
FIG. 9N is a perspective view of an embodiment of a pin-aperture first pulley mount mounted to a curtain, in accordance with aspects of the present inventive concepts.

FIG. 9N is a perspective view of an embodiment of a pin-aperture first pulley mount 1000 mounted to a curtain 100, in accordance with aspects of the present inventive concepts. In this embodiment, the pin-aperture first pulley mount 1000 is suspended by the curtain 100. In this embodiment, the apertures 1010*a*, 1010*b* of the first portion 1020 are constructed and arranged to receive the pins 1012 of the second portion 1060. In this embodiment, each pin 1012 at the second portion 1060 is coupled to a corresponding aperture 1010 at the first portion 1020 and the curtain 100 is pinched between them.

Figure 10:
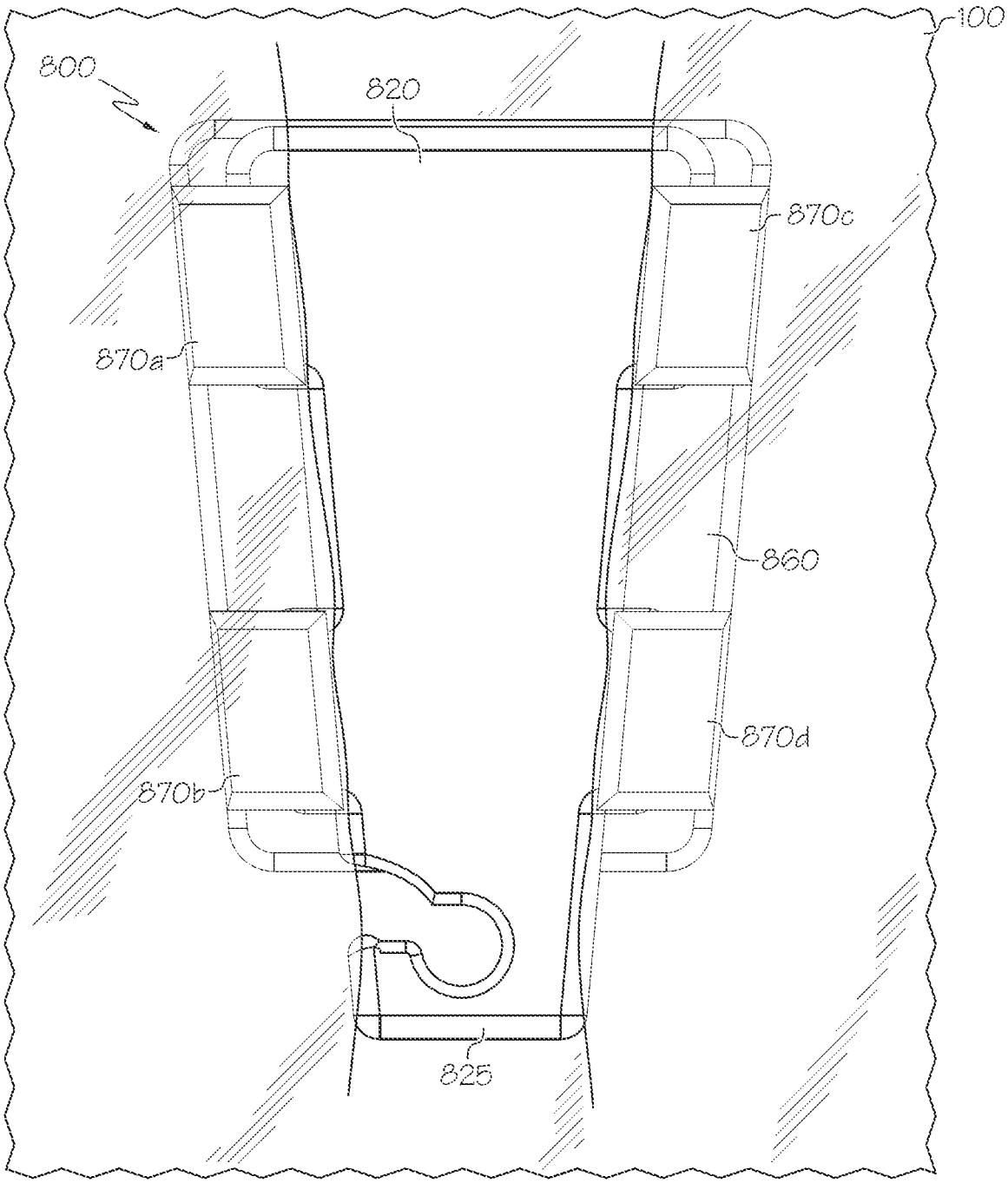
FIG. 10 is a front view of an embodiment of a tapered first pulley mount mounted to a curtain, in accordance with aspects of the present inventive concepts.
Figure 11:
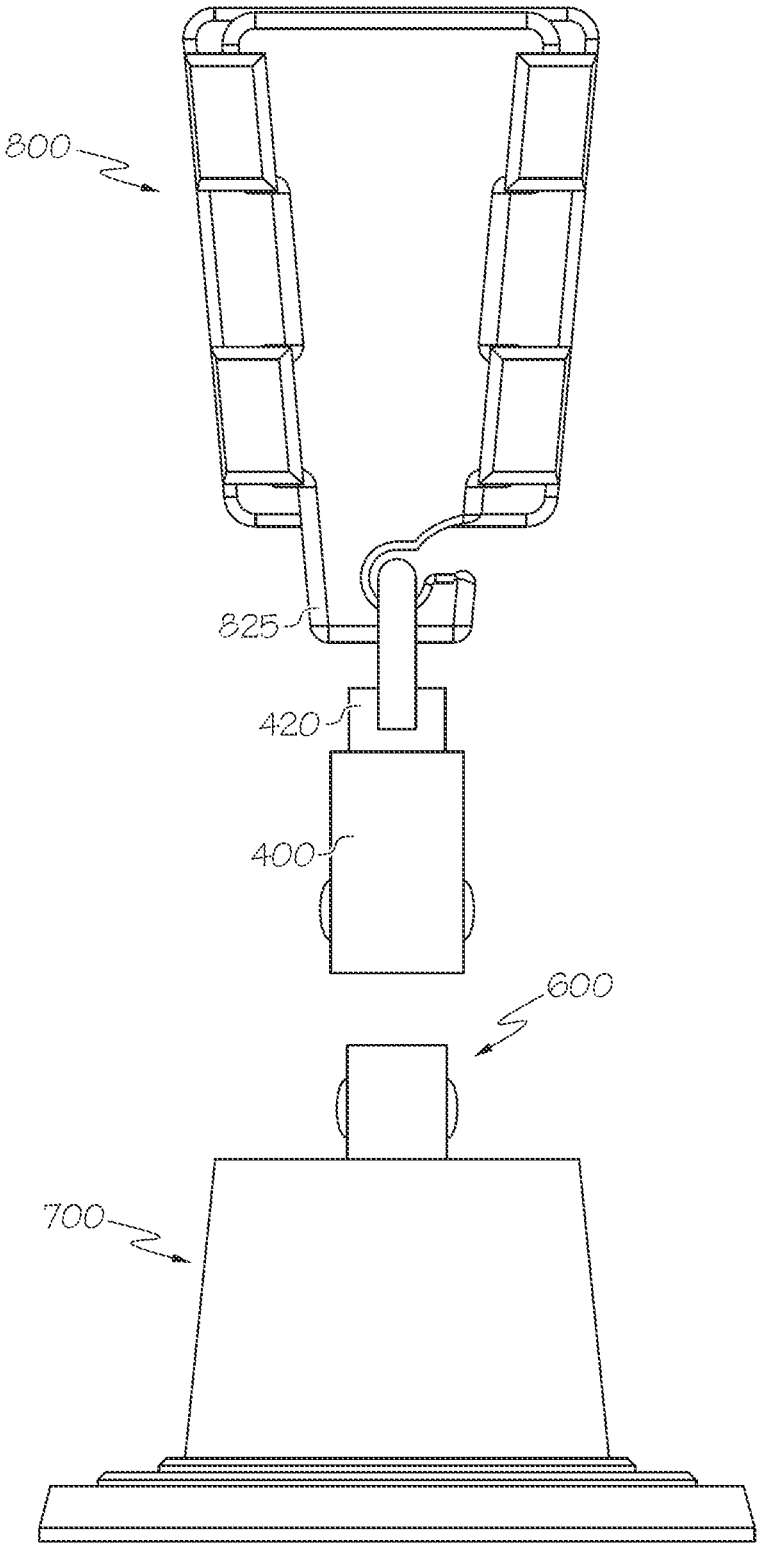

FIG. 10 is a front view of an embodiment of a tapered first pulley mount 800 mounted to a curtain 100, in accordance with aspects of the present inventive concepts. In this embodiment, the first pulley mount 800 is suspended by the curtain 100. In this embodiment, the tapered first portion 820 is coupled to the tapered second portion 860 and the curtain 100 is pinched between them. In this embodiment, the tapered first portion 820 is inserted beneath the claws 870 from the top and can only be removed from the top.

Figure 11:
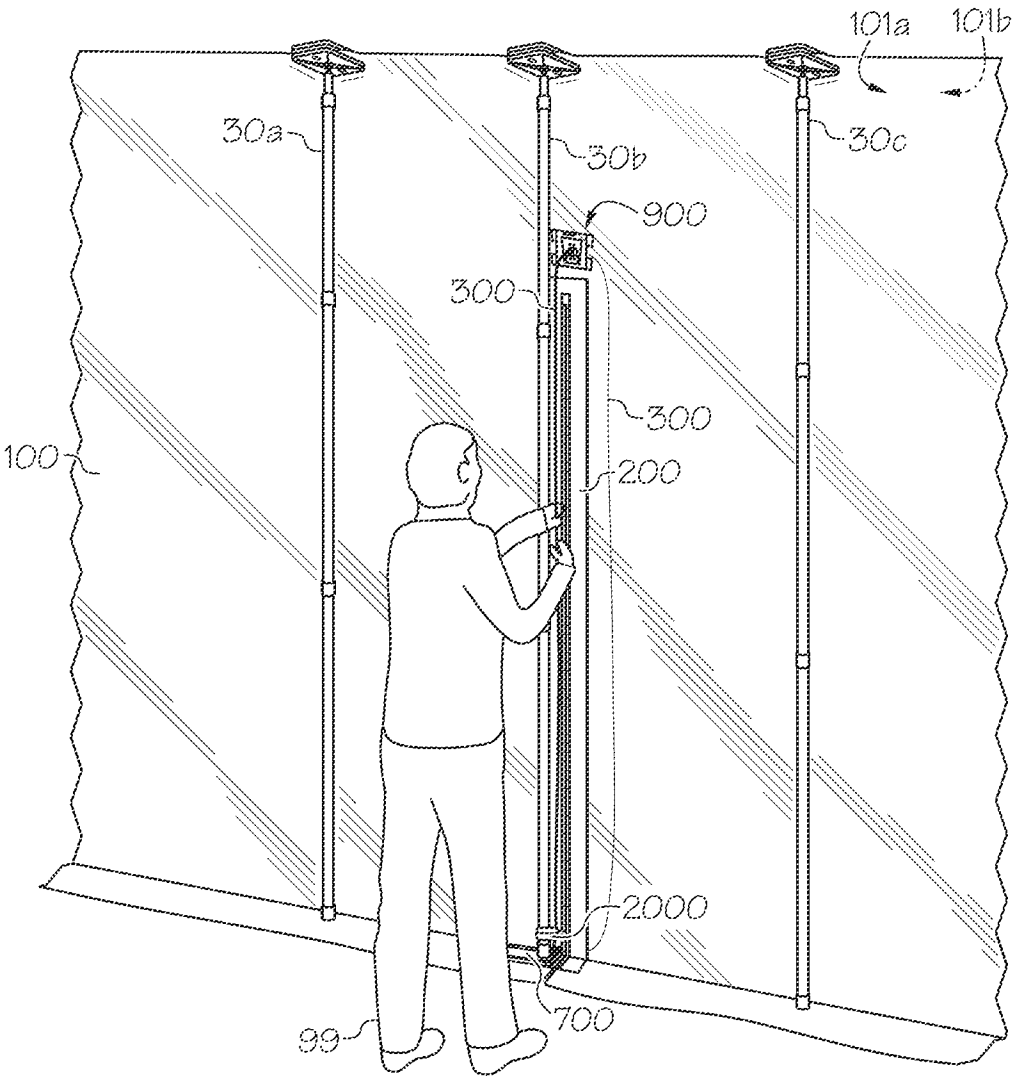
FIG. 11 is a front view of an embodiment of a first pulley, a tapered first pulley mount, a second pulley, and a second pulley mount, in accordance with aspects of the present inventive concepts.
Figure 111:
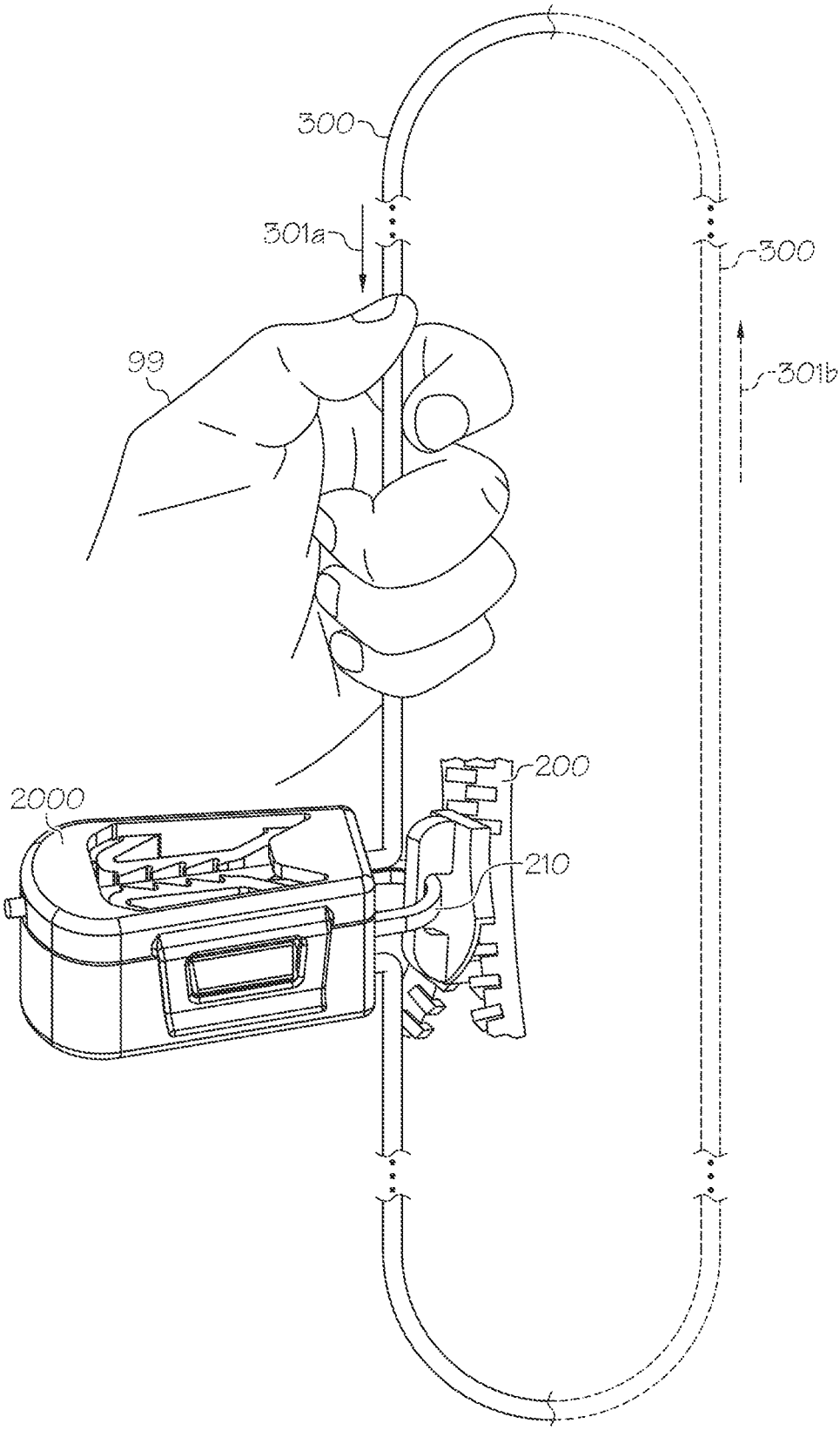

FIG. 11 is a front view of an embodiment of a first pulley 400, a tapered first pulley mount 800, a second pulley 600, and a second pulley mount 700, in accordance with aspects of the present inventive concepts. In this embodiment, the second pulley 600 is integral with the second pulley mount 700. In some embodiments, the second pulley mount 700 is an object with enough weight to maintain a relatively stable position, so that the second pulley 600 does not change position when a force or motion is applied to the system's elongated pull 300.

Figure 12:
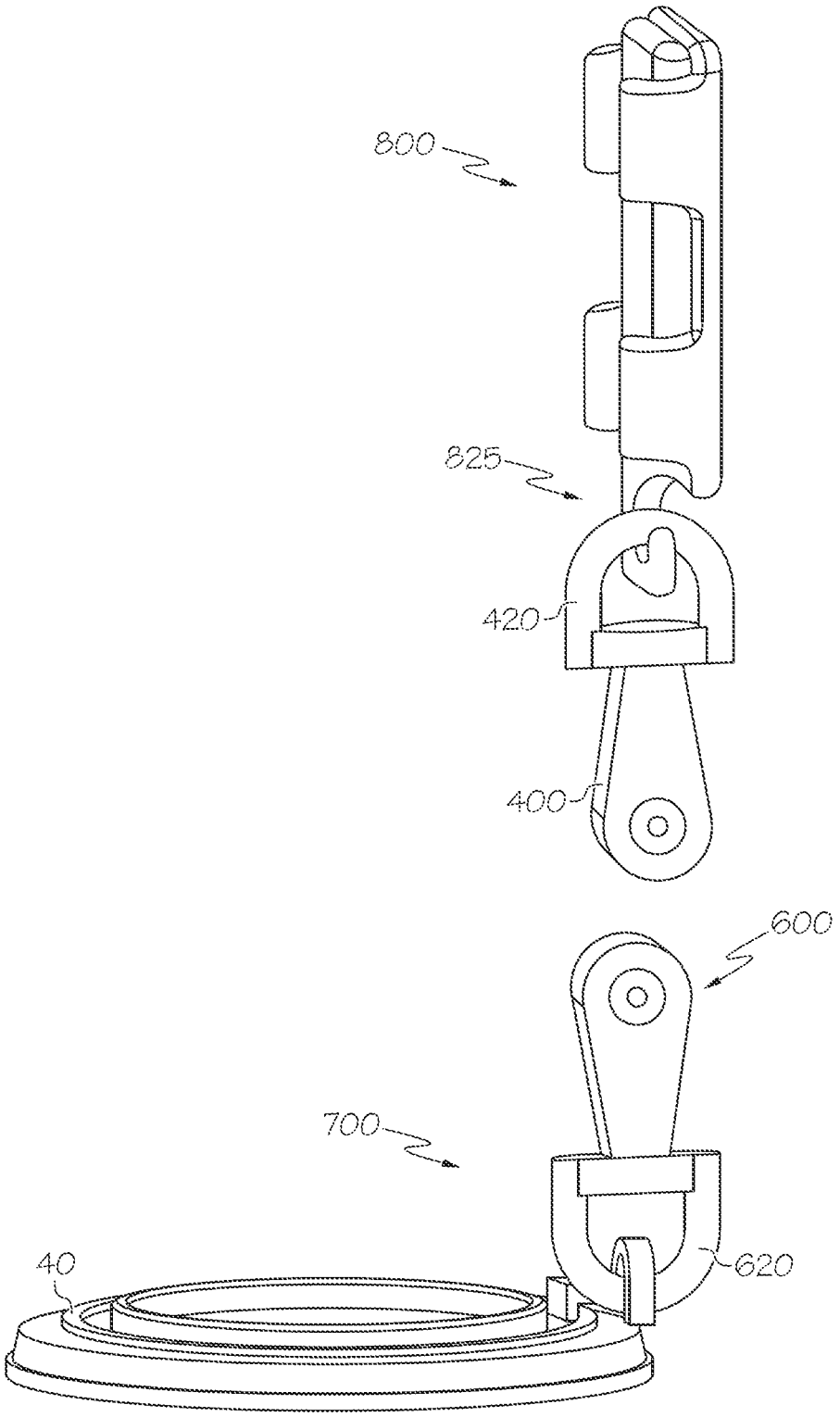
FIG. 12 is a side perspective view of an embodiment of a first pulley, a tapered first pulley mount, a second pulley, and a second pulley mount, in accordance with aspects of the present inventive concepts.

FIG. 12 is a perspective view of an embodiment of a first pulley 400, a tapered first pulley mount 800, a second pulley 600, and a second pulley mount 700, in accordance with aspects of the present inventive concepts. In this embodiment, the second pulley mount 700 comprises a flexible pole seat 40. In some embodiments, the second hook 620 at which the second pulley 600 is coupled to the flexible pole seat 40 is positioned at an outer edge of the flexible pole seat 40 as shown. In other embodiments the second hook 620 is positioned at an interior position of the flexible pole seat 40. In other embodiments the pole seat 40 can be rigid.

FIG. 13 is a perspective view of an embodiment of the second pulley 600 and the second pulley mount 700, in accordance with aspects of the present inventive concepts. This embodiment has features that are similar to those of the embodiment shown in FIG. 6. In this embodiment, however, the second pulley 600 is integral with the base plate 720. In this embodiment, the second pulley is positioned at the corner of the base plate 720. In some embodiments, the base plate 720 is also directly coupled with the zipper 200. Placement of the second pulley at a corner position of the base plate 720 allows for enhanced placement of the second pulley 600 directly underneath the position of the zipper as shown in the embodiment of FIG. 13. In some embodiments, the elongated pull is in contact with a surface of the first pulley and the elongated pull is in contact with a surface of the second pulley. As the user opens and/or closes the zipper, the elongated pull may move, causing the first and/or second pulley to rotate. If the first pulley is not in-line with the second pulley, the elongated pull may experience tension along the length of the elongated pull and in a direction orthogonal to the zipper. Such an orthogonal tension may cause the elongated pull to lose contact with the first and/or second pulley, or may misalign the system in some other way.

Figure 14:
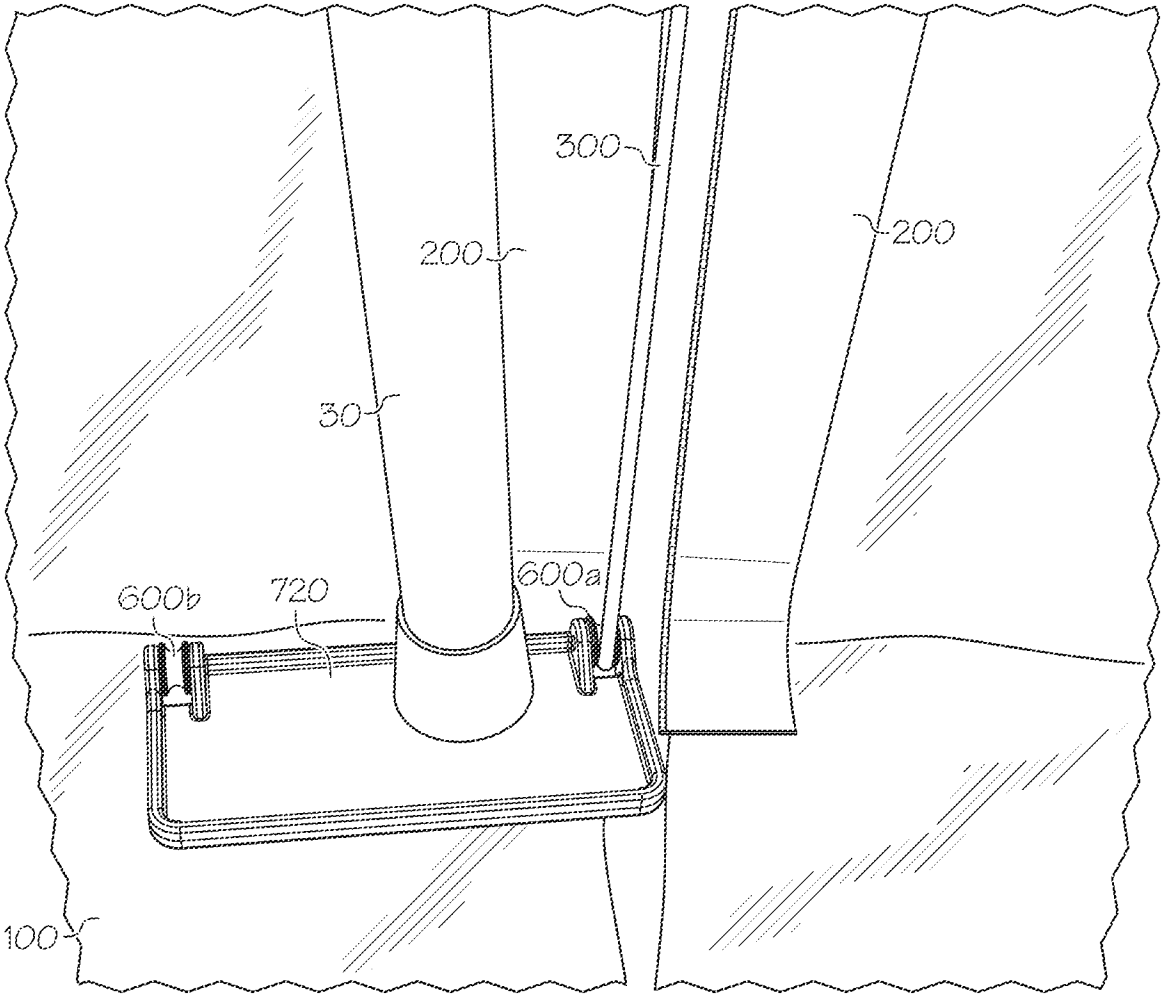
FIG. 14 is a perspective view of an embodiment of a first second pulley and a second second pulley, in accordance with aspects of the present inventive concepts.

FIG. 14 is a perspective view of an embodiment of a base plate 720 including multiple second pulleys, for example, a first second pulley 600*a* and a second second pulley 600*b*, in accordance with aspects of the present inventive concepts. In this embodiment, both the first second pulley 600*a* and the second second pulley 600*b* are located at corners of the base plate 720, for example rear corners of the base plate 720. In alternative embodiments, the second pulley is located at one or both of the front corners of the base plate 720. Placement of multiple second pulleys at multiple corner positions of the base plate 720 allows an installer even further options for enhanced placement of the second pulley 600 directly underneath the position of the zipper. For example, although the embodiment depicted in FIG. 13 illustrates the pole 30 and the corresponding base plate positioned at a left side of the zipper for tensioning the left portion of the zipper tape, in some embodiments, it may instead be preferred to instead tension the right portion of the zipper tape. In such a case, the second second pulley 600*b* can be employed with the elongated pull 300.

FIG. 14A1 is a perspective view of an embodiment of a base plate 720 including multiple second pulleys, for example, a first second pulley 600*a* and a second second pulley 600*b*, in accordance with aspects of the present inventive concepts. In this embodiment, both the first second pulley 600*a* and the second second pulley 600*b* are located at corners of the base plate 720. In alternative embodiments, the second pulley is located at one or both of the front corners of the base plate 720. In the embodiment shown in FIG. 14A1, one of the left or right portions of the zipper 200 or zipper tape is positioned below the base plate 720, between the base plate 720 and a neighboring surface, for example a floor.

FIG. 14A2 is a perspective view of an embodiment of a base plate 720 including multiple second pulleys, for example, a first second pulley 600*a* and a second second pulley 600*b*, in accordance with aspects of the present inventive concepts. In the embodiment shown in FIG. 14A2, the base plate 720 includes a lower platform 740. In such an embodiment, the lower portion of the curtain 100 can be positioned between the base plate 720 and the lower platform 740, with the lower platform 740 making direct contact with a neighboring surface, for example a floor. In alternative embodiments, the base plate 720 is unitary with the lower platform 740.

In some embodiments the lower platform 740 is fully or partially transparent. In alternative embodiments, the lower platform 740 is opaque. In some embodiments the lower platform 740 comprises a pad, mat, or cloth. In some embodiments the lower platform 740 is rigid. In some embodiments the lower platform 740 is flexible. In some embodiments, the lower platform 740 comprises a high-friction material configured to increase the friction with one or more neighboring surfaces.

In some embodiments, a portion of the curtain 100 is also positioned between the base plate 720 and the lower platform 740. In some embodiments, a pole 30 applies sufficient downward pressure to secure the position of the curtain 100, the base plate 720, and the lower platform 740.

In the embodiments shown in FIG. 14A1 and FIG. 14A2, a foot 31 of a pole is positioned at the base plate 720. In the embodiments shown in FIG. 14A1 and FIG. 14A2, the base plate 720 comprises an optional rim 750 at perimeter regions of the base plate. The rim 750 can operate as a seat for locating the base of a pole, for example a foot 31 of a pole. In alternative embodiments, such as the one shown in FIG. 6, the base plate 720 does not comprise a rim.

Figure 14B:
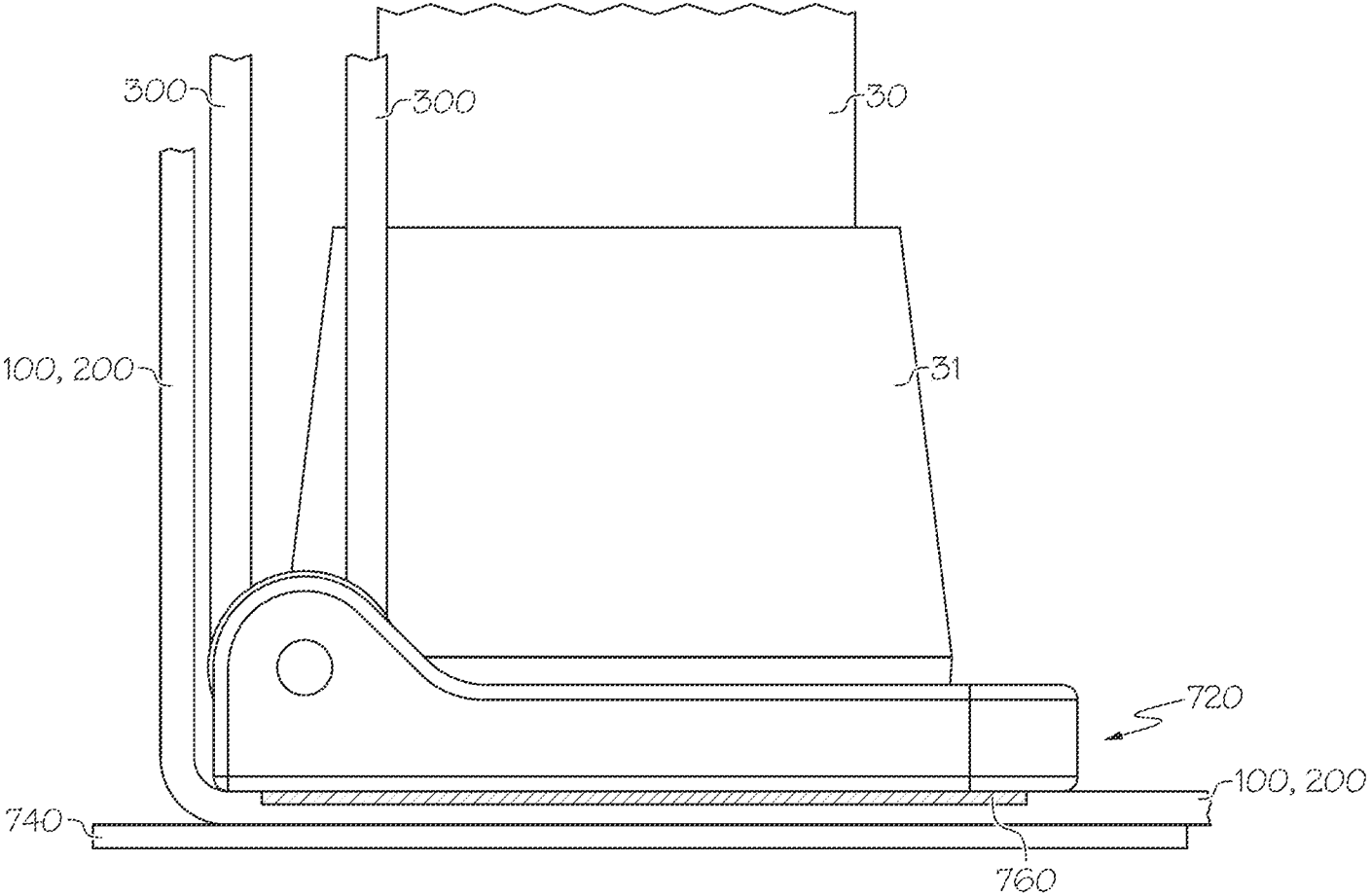
FIG. 14B is a side view of the embodiment of FIG. 14A, in accordance with aspects of the present inventive concepts.

FIG. 14B is a side view of the embodiment of FIG. 14A2, in accordance with aspects of the present inventive concepts. In this embodiment, the base plate 720 is coupled to an under platform 760. In some embodiments, the under platform 760 comprises a high-friction material configured to increase a friction interaction with one or more neighboring surfaces, for example the curtain 100. In some embodiments, the base plate 720 is unitary with the under platform 760. In some embodiments the under platform 760 is fully or partially transparent. In alternative embodiments, the under platform 760 is opaque. In some embodiments the under platform 760 comprises a pad, mat, or cloth. In some embodiments the under platform 760 is rigid. In some embodiments the under platform 760 is flexible.

Figure 15:
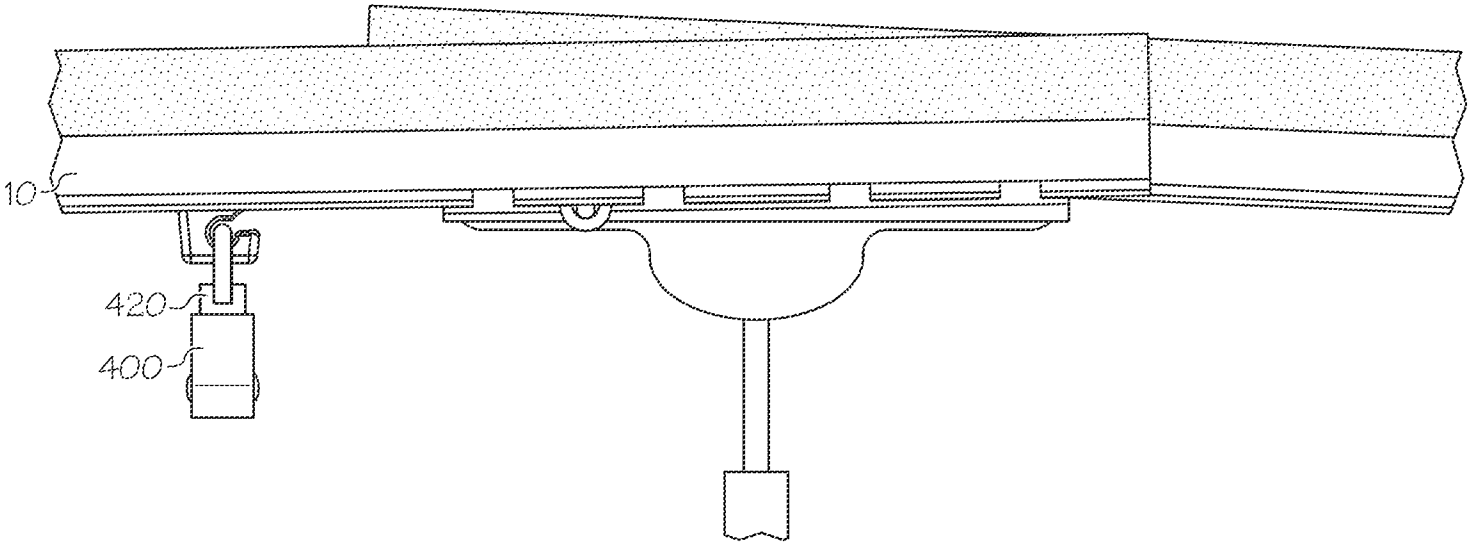
FIG. 15 is a front view of an embodiment of a first pulley coupled to a head, in accordance with aspects of the present inventive concepts.

FIG. 15 is a front view of an embodiment of a first pulley 400 coupled to a head 10, in accordance with aspects of the present inventive concepts. In some embodiments, the head 10 can comprise an elongated rail such as the elongated rail described in connection with U.S. Pat. No. 10,081,955, which is incorporated herein by reference in its entirety. In the embodiment illustrated, the first pulley 400 is coupled to the elongated rail 12 of the head 10 via the first hook 420. In other embodiments, the first pulley 400 can be integral with the elongated rail 12 of the head 10.

Figure 16:
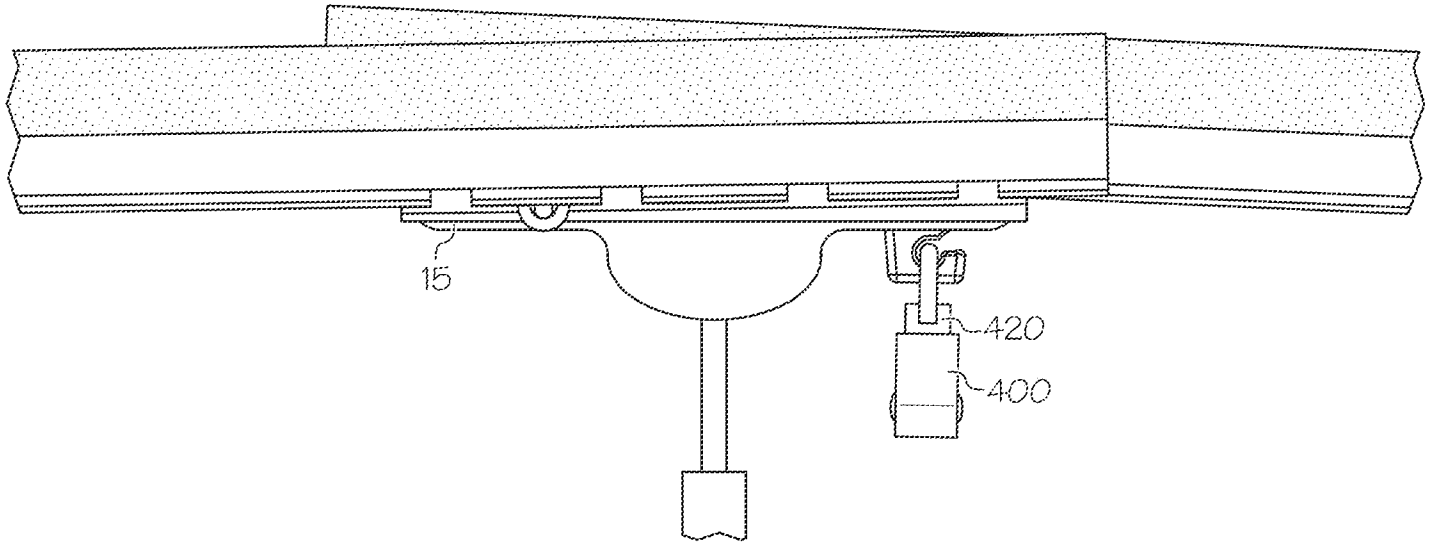
FIG. 16 is a front view of an embodiment of the first pulley coupled to a coupler, in accordance with aspects of the present inventive concepts.

FIG. 16 is a front view of an embodiment of the first pulley 400 coupled to a coupler 15 constructed and arranged to couple one or more heads 10, in accordance with aspects of the present inventive concepts. In some embodiments, the coupler 15 comprises a coupler such as the coupler 15 described in connection with U.S. Pat. No. 10,081,955, which is incorporated herein by reference in its entirety. In the embodiment illustrated, the first pulley 400 is coupled to the coupler 15 via the first hook 420. In other embodiments, the first pulley 400 can be integral with the coupler 15.

Figure 17A:
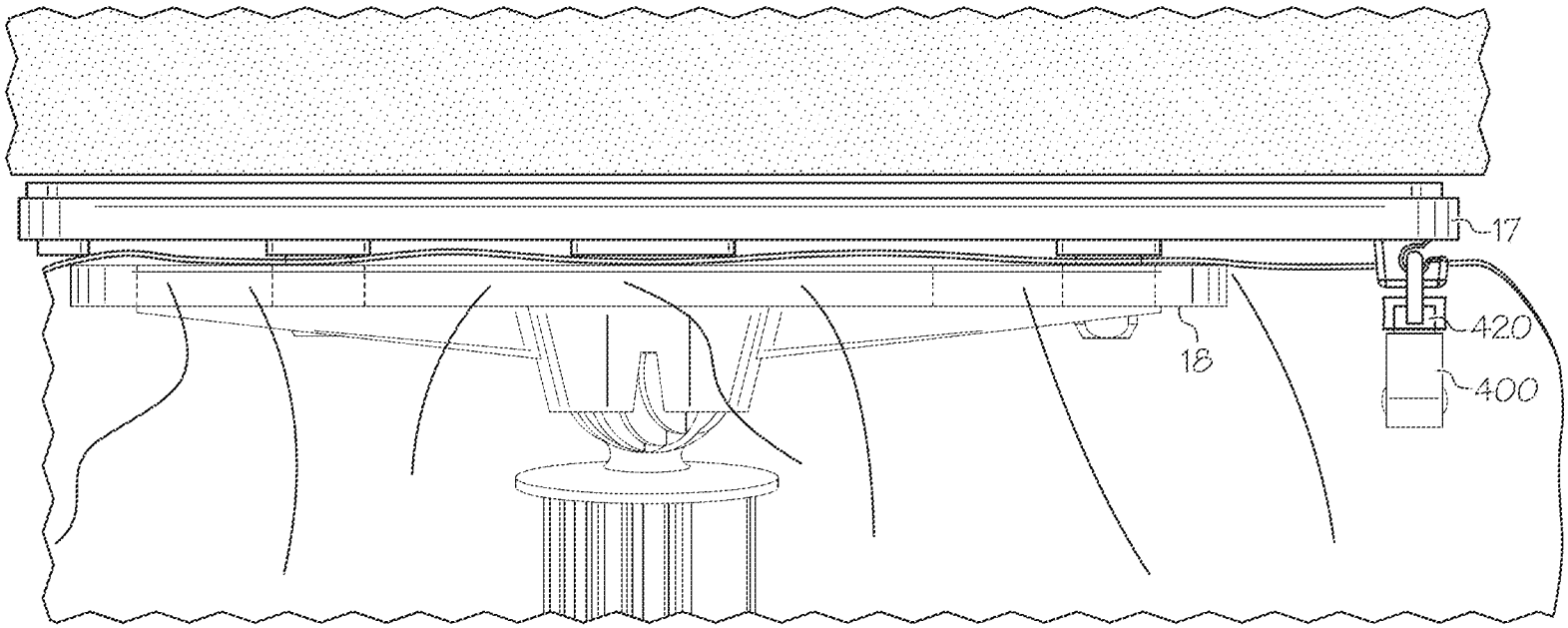
FIG. 17A is a front view of an embodiment of the first pulley coupled to a curtain clip, in accordance with aspects of the present inventive concepts.

FIG. 17A is a front view of an embodiment of the first pulley 400 coupled to a curtain clip 17, in accordance with aspects of the present inventive concepts. In some embodiments, the curtain clip 17 comprises a curtain clip 17 such as the clips described in connection with the various United States patents incorporated herein by reference. In the embodiment illustrated, the first pulley 400 is coupled to the curtain clip 17 via the first hook 420. In other embodiments, the first pulley 400 can be integral with the clip 17.

Figure 17B:
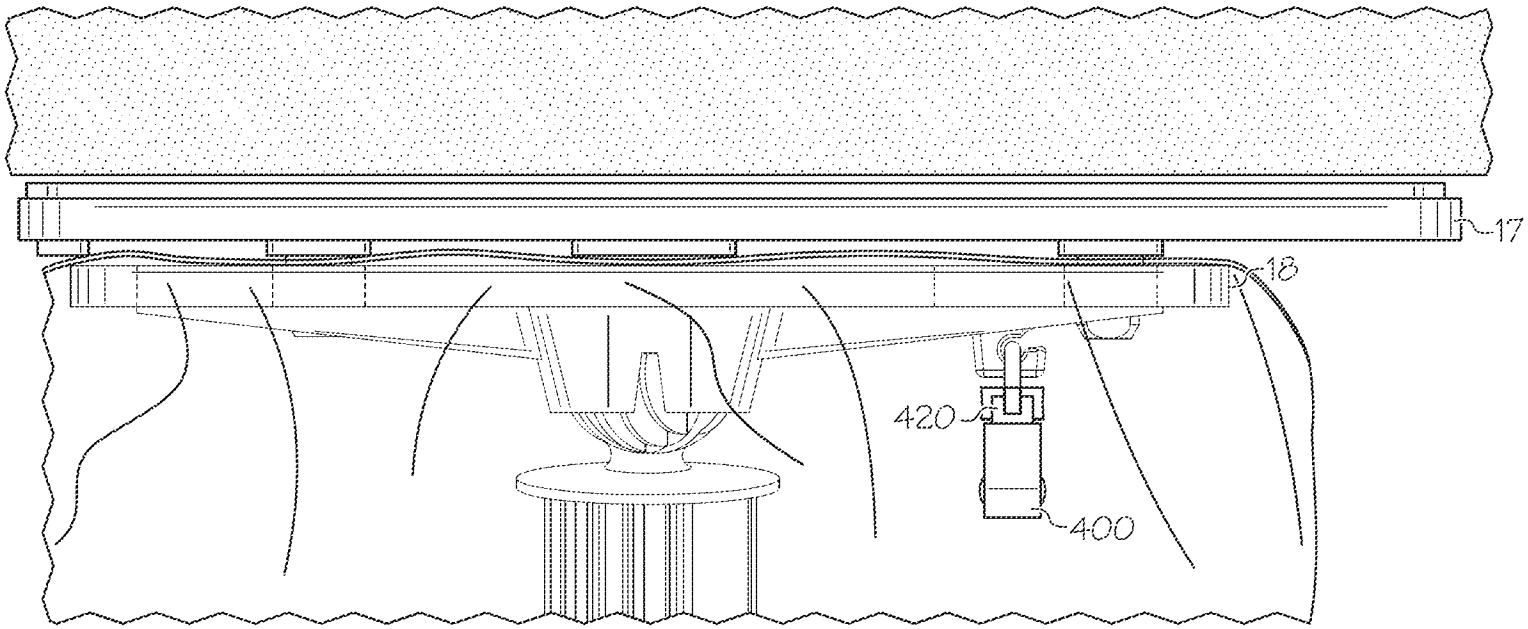
FIG. 17B is a front view of an embodiment of the first pulley coupled to a mounting head, in accordance with aspects of the present inventive concepts.

FIG. 17B is a front view of an embodiment of the first pulley 400 coupled to a mounting head 18, in accordance with aspects of the present inventive concepts. In some embodiments, the mounting head can comprise a mounting head 18 such as mounting heads described in connection with the various United States patents incorporated herein by reference. In the embodiment illustrated, the first pulley 400 is coupled to the mounting head 18 via the first hook 420. In other embodiments, the first pulley 400 can be integral with the mounting head 18.

Figure 18:
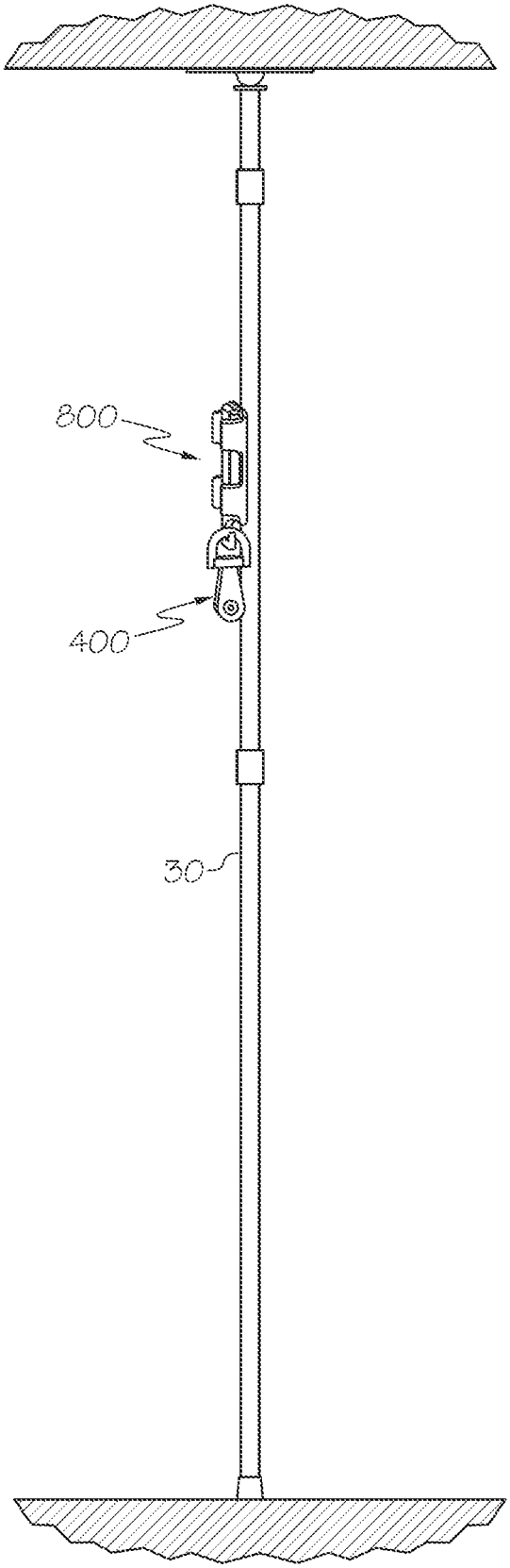
FIG. 18 is a side view of an embodiment of a first pulley mount coupled to a pole, in accordance with aspects of the present inventive concepts.

FIG. 18 is a side view of an embodiment of a first pulley mount 800 coupled to a side portion of a pole 30, in accordance with aspects of the present inventive concepts. In the embodiment illustrated, the first pulley 400 can be coupled to the first pulley mount 800 via a first hook 420. In other embodiments, the first pulley 400 can be integral with the first pulley mount.

Figure 19:
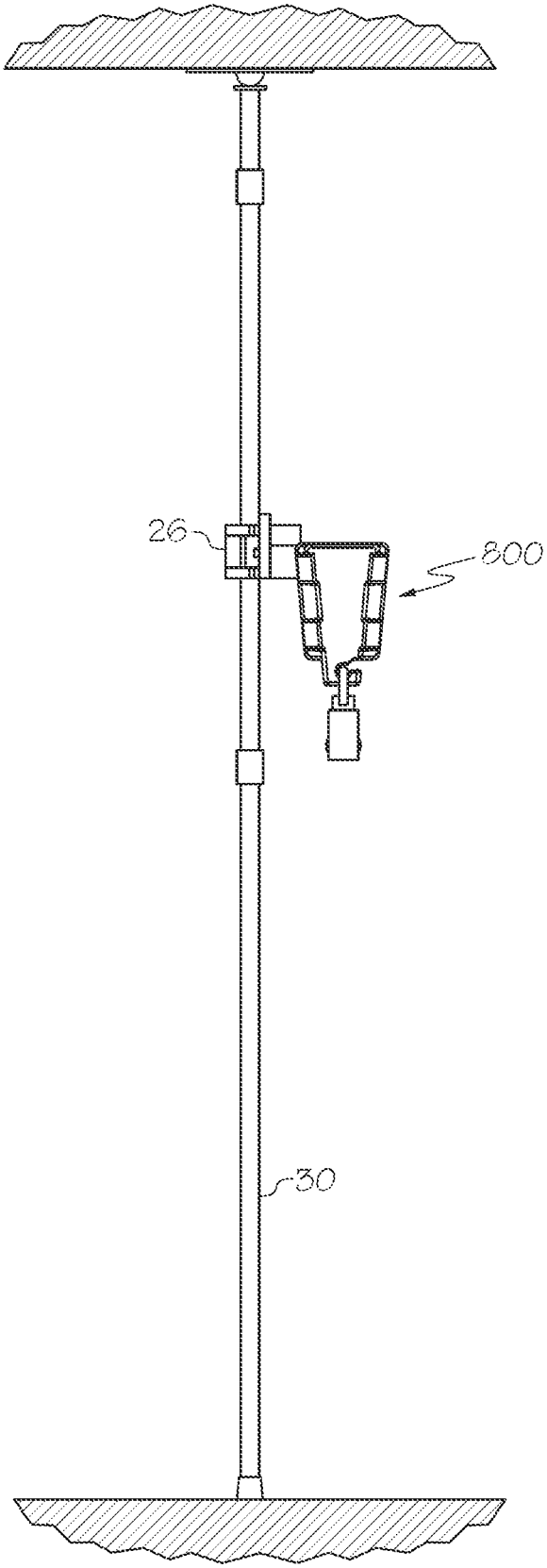
FIG. 19 is a front view of an embodiment of a first pulley mount coupled to a clamp, in accordance with aspects of the present inventive concepts.

FIG. 19 is a front view of an embodiment of a first pulley mount 800 coupled to a pole clamp 26, in accordance with aspects of the present inventive concepts. In this embodiment, the pole clamp 26 is mounted to the pole 30 and the first pulley mount 800 is coupled to the pole clamp 26. In some embodiments, the vertical position of the pole clamp 26 on the pole is adjustable by releasing and re-positioning the pole clamp 26. In some embodiments, the pole clamp 26 can comprise a pole clamp of the type described in connection with U.S. Pat. No. 8,113,475, which is incorporated herein by reference in its entirety.

Figure 20:
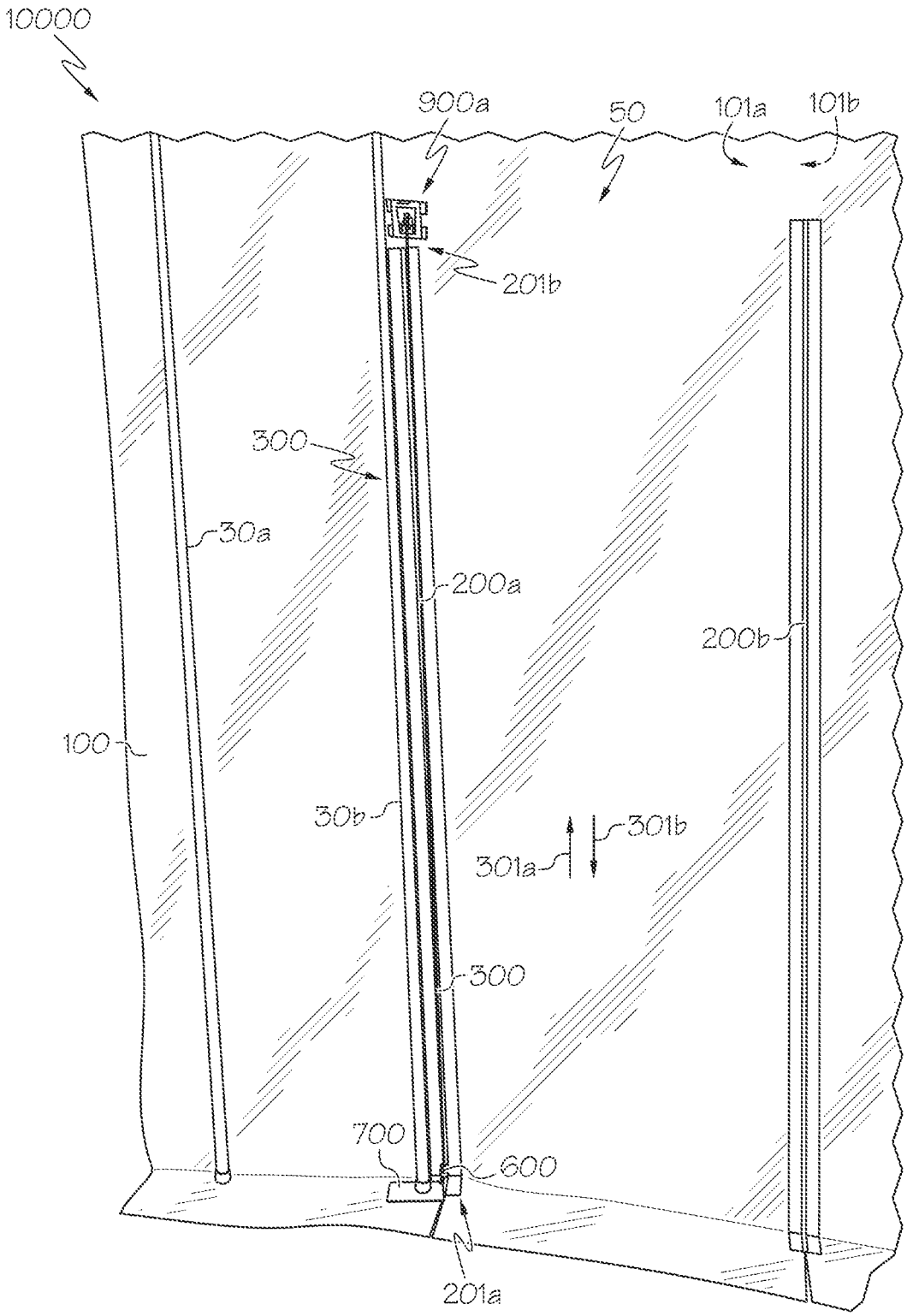
FIG. 20 is a perspective view of an embodiment of a zipper pull system with two zippers, in accordance with aspects of the present inventive concepts.

FIG. 20 is a perspective view of an embodiment of a zipper pull system 10000 with two zippers 200*a*, 200*b*, in accordance with aspects of the present inventive concepts.

Figure 20A:
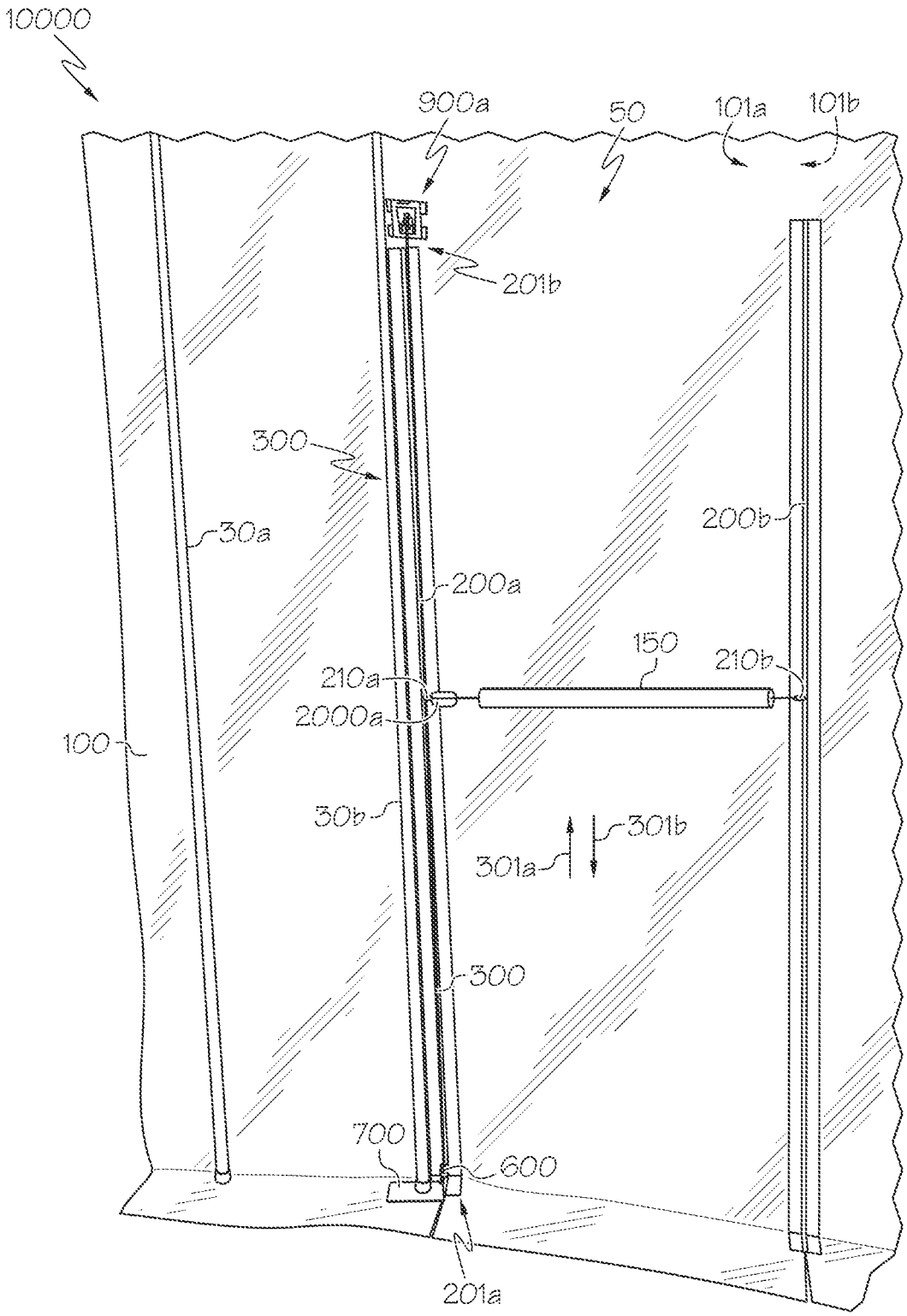
FIG. 20A is a perspective view of an embodiment of a zipper pull system with two zippers coupled together, in accordance with aspects of the present inventive concepts.

FIG. 20A is a perspective view of an embodiment of a zipper pull system 10000 with two zippers 200*a*, 200*b* coupled together, in accordance with aspects of the present inventive concepts. In the embodiment shown in FIG. 20A, the first pull coupler 2000*a* is coupled to the zipper pull 210*b* of the second zipper 200*b* with a rod 150. In this manner, a doorway between the first and second zippers 200*a*, 200*b* is provided. In alternative embodiments, the elongated pull 300 comprises a different elongated material that is constructed and arranged to transfer tension, including, but not limited to, rope, string, wire, cables, ribbon, belt, or any such suitable material. In such a configuration, the user may use the elongated pull 300 near the first zipper 200*a* to adjust the positions of both the first zipper 200*a* and the second zipper 200*b*. In alternative embodiments additional zippers are coupled to the pull coupler 2000*a*.

Figure 20B:
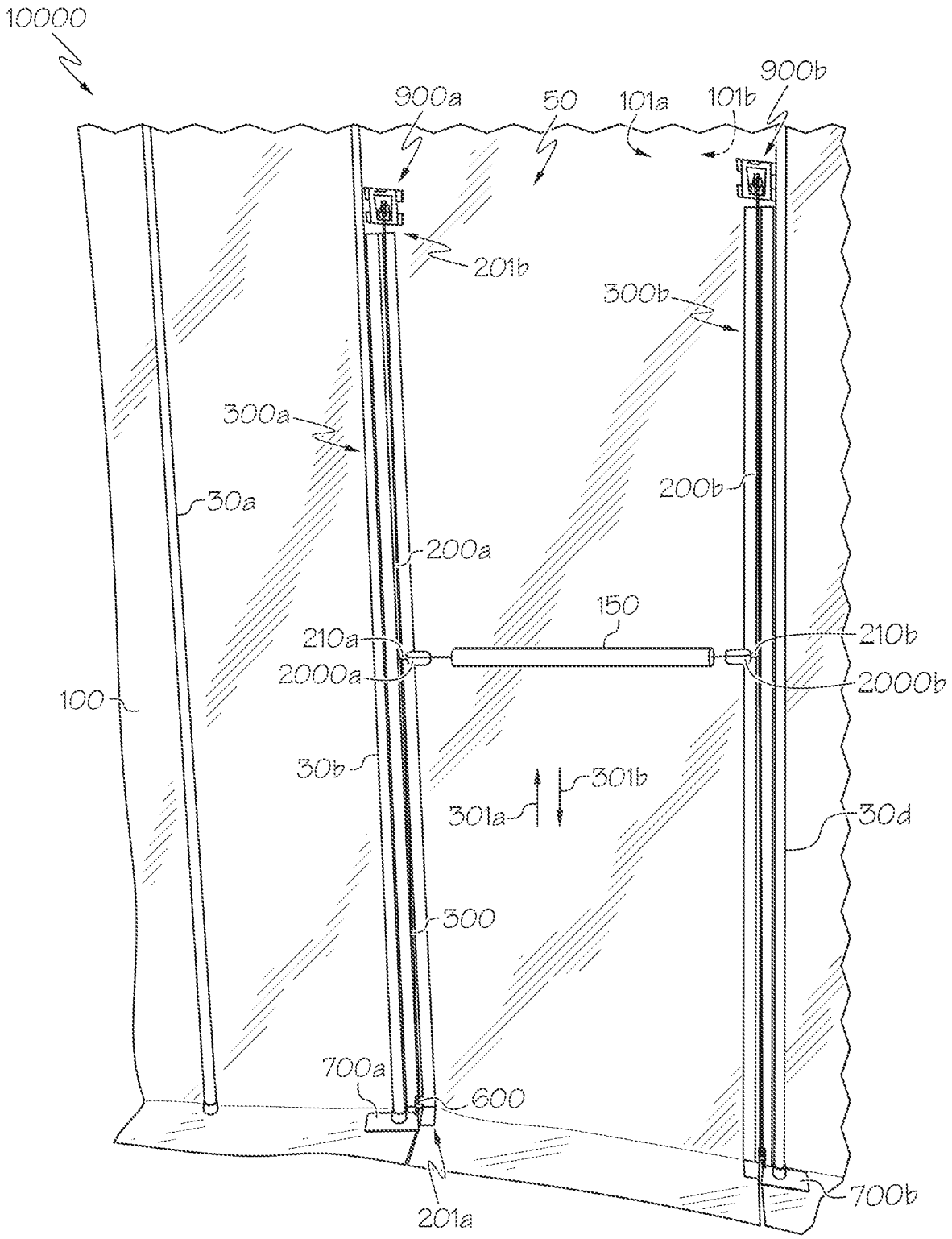
FIG. 20B is a perspective view of an embodiment of a zipper pull system with two zippers coupled together, in accordance with aspects of the present inventive concepts.
Figure 21:
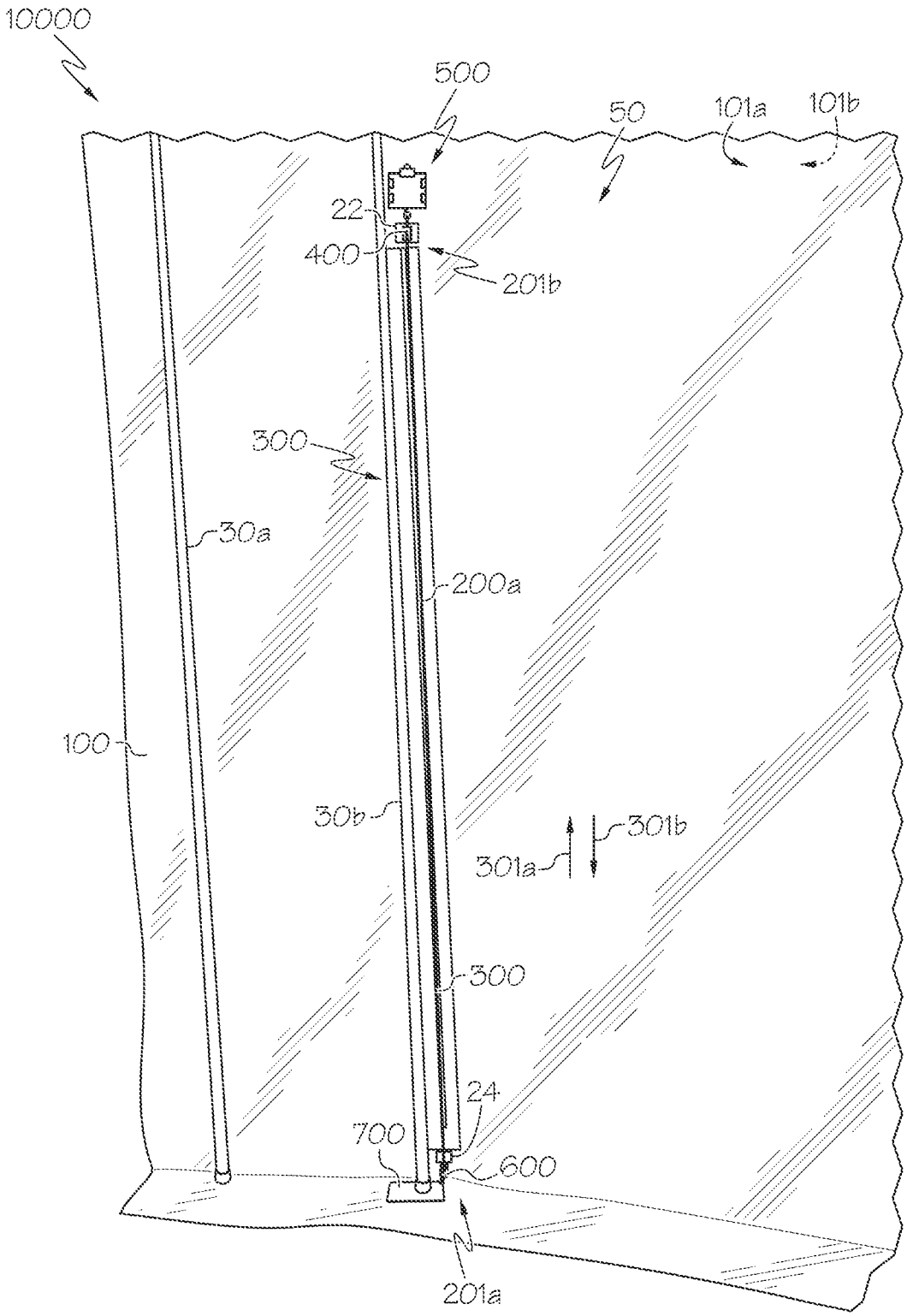

FIG. 20B is a perspective view of an embodiment of a zipper pull system 10000 with two zippers 200*a*, 200*b* coupled together, in accordance with aspects of the present inventive concepts. In some embodiments, the zipper pull system 10000 comprises one or more pull couplers 2000*a, b*. In some embodiments, one or more of the one or more pull couplers of neighboring zippers are coupled together. In the embodiment shown in FIG. 20B the pull coupler 2000*a* coupled to the first zipper 200*a* is coupled to the pull coupler 2000*b* coupled to the second zipper 200*b*. In the embodiment shown in FIG. 20B, the first pull coupler 2000*a* is coupled to the pull coupler 200*b* of the zipper pull 210*b* of the second zipper 200*b* with a rod 150. Pole 30*d* supports the operation of the second elongated pull 300 and corresponding second zipper 200*b* as described herein. Lower pulley 700*b* is positioned at a base of the pole 30*d* as described herein. In this manner, a doorway between the first and second zippers 200*a*, 200*b* is provided. In alternative embodiments, the elongated pull 300 comprises a different elongated material that is constructed and arranged to transfer tension, including, but not limited to, rope, string, wire, cables, ribbon, belt, or any such suitable material. In such a configuration, the user can use one elongated pull to adjust both zippers. Alternatively, the user can use the rod 150 to adjust both zippers. In alternative embodiments additional pull couplers are coupled to the first pull coupler 200*a*.

Figure 21:
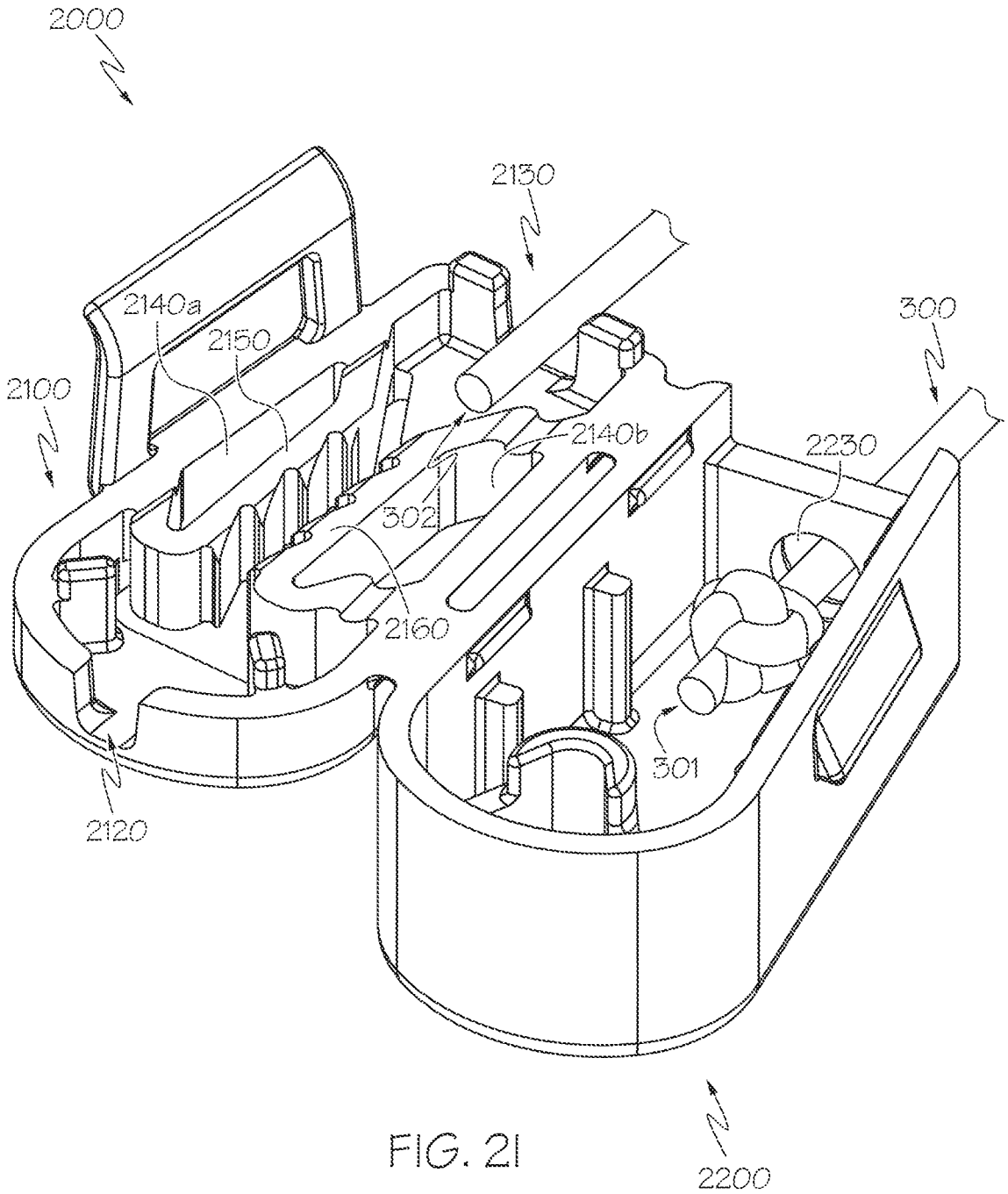
FIG. 21 is a perspective view of an embodiment of a zipper pull system, in accordance with aspects of the present inventive concepts.

FIG. 21 is a perspective view of an embodiment of a zipper pull system 10000, in accordance with aspects of the present inventive concepts. In the embodiment shown in FIG. 21 the zipper 200*a* does not extend to the bottom of the curtain 100. In such embodiments, the elongated pull 300 passes through a first hole 22 (see for example, FIG. 7) in the curtain 100 and extends at a second side 101*b*, for example near a rear surface, of the curtain 100 toward a second pulley 600 positioned near the bottom 201*a* of the zipper 200. In such embodiments, the elongated pull 300 passes through a second hole 24 at or near the second pulley and emerges back at the first side 101*a* of the curtain 100 at a position at, or near, a bottom 201*b* of the zipper 200.

Figure 22A:
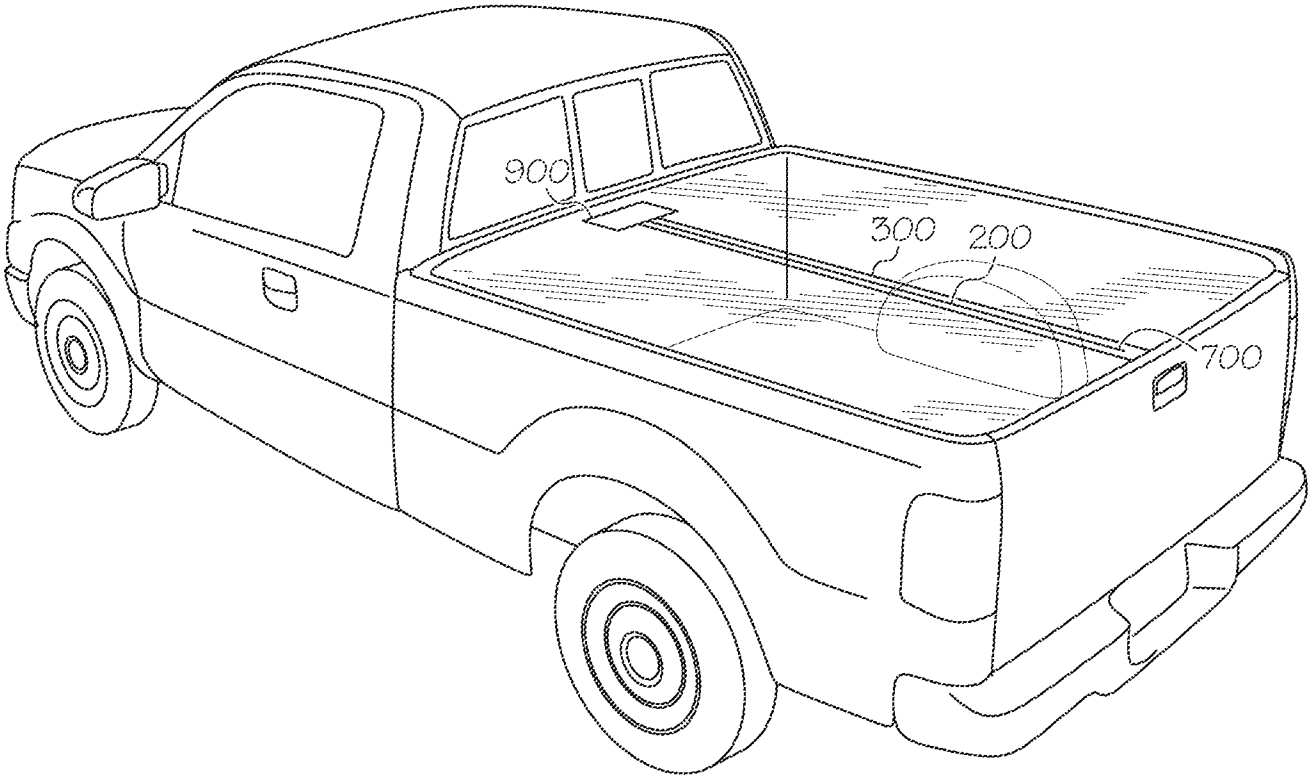
FIG. 22A is a perspective view of a zipper pull system coupled to a pickup truck, in accordance with aspects of the present inventive concepts.

FIG. 22A is a perspective view of a zipper pull system 10000 coupled to a pickup truck, in accordance with aspects of the present inventive concepts. In some embodiments, a user may store items in the flat bed of a car or truck and secure the contents using a curtain 100. In such embodiments, it is useful to provide a zipper for opening and closing the curtain 100. A zipper pull system 10000 assists the user when opening and closing the zipper 200. In some embodiments, such as the embodiment shown in FIG. 22A, the curtain 100 is arranged on top of the flat bed. In some embodiments, such as the embodiment shown in FIG. 22A, the zipper 200 is extended along the length of the flat bed. A user can be positioned at the rear of the truck, and using the elongated pull, open and close the zipper from the same position. In some embodiments, the first pulley and/or the second pulley is coupled to a nearby surface. In some embodiments the first pulley mount and/or the second pulley mount is coupled to a nearby surface. In some embodiments, the second pulley mount is constructed and arranged like one or more of the first pulley mounts described herein.

Figure 22B:
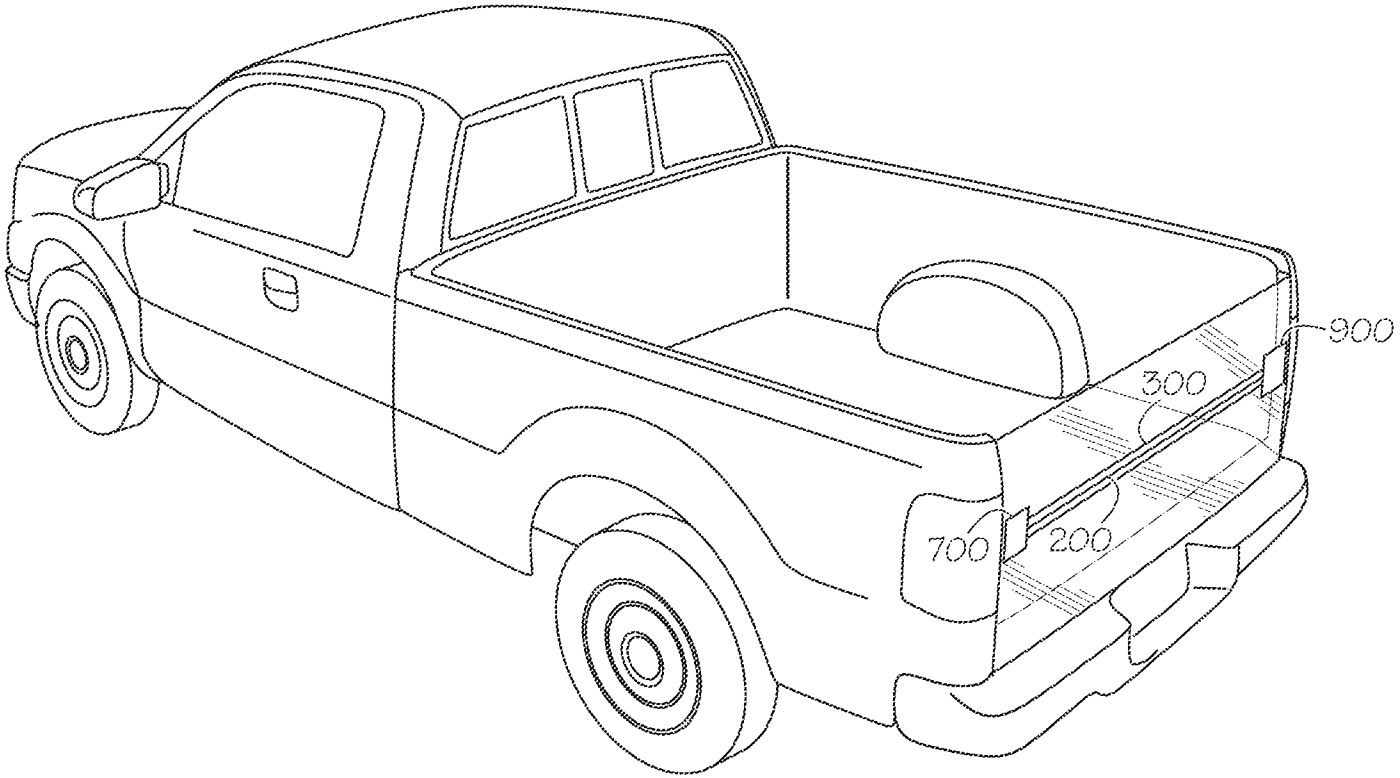
FIG. 22B is a perspective view of a zipper pull system coupled to a pickup truck, in accordance with aspects of the present inventive concepts.

FIG. 22B is a perspective view of a zipper pull system coupled to a pickup truck, in accordance with aspects of the present inventive concepts. In some embodiments, a user may store items in the flat bed of a car or truck and secure the contents using a curtain 100. In such embodiments, it is useful to provide a zipper for opening and closing the curtain 100. A zipper pull system 10000 assists the user when opening and closing the zipper 200. In some embodiments, such as the embodiment shown in FIG. 22B, the curtain 100 is arranged at the end of the flatbed. In some embodiments, such as the embodiment shown in FIG. 22B, the zipper 200 is extended along the width of the flat bed. In some embodiments, the first pulley and/or the second pulley is coupled to a nearby surface. In some embodiments the first pulley mount and/or the second pulley mount is coupled to a nearby surface. In some embodiments, the second pulley mount is constructed and arranged like one or more of the first pulley mounts described herein.

While inventive concepts have been particularly shown and described with references to embodiments thereof, it will be understood by those skilled in the art that various changes in form and detail may be made herein without departing from the spirit and scope of the inventive concepts as defined by the appended claims.

I claim:

1. A system, comprising:

a pole;

a curtain;

a first pulley;

a first pulley mount constructed and arranged to couple the first pulley to the curtain including a zipper, the first pulley mount comprising a first portion and a second portion that are removably coupled to each other with a portion of the curtain between them when mounted to the curtain;

a second pulley;

a second pulley mount constructed and arranged to couple the second pulley in position relative to the curtain; and an elongated pull coupled to the first pulley, the second pulley, and a zipper pull of the zipper, wherein the second pulley mount comprises a base plate, wherein the base plate is constructed and arranged to be held in position relative to the curtain by a base of the pole positioned on an upper surface of the base plate.

2. The system of claim 1, wherein the first pulley is positioned at an interior region of the first pulley mount.

3. The system of claim 1, wherein the first portion and the second portion are slidably coupled to each other with a portion of the curtain between them when mounted to the curtain.

4. The system of claim 1, further comprising a pull coupler that removably secures the elongated pull to the zipper pull.

5. The system of claim 1, wherein the first pulley is positioned at a vertical position that is above a vertical position of the second pulley.

6. The system of claim 5 wherein the first pulley is positioned at a vertical position at a top region of the zipper and wherein the second pulley is positioned at a vertical position at a bottom region of the zipper.

7. The system of claim 1, wherein the first pulley mount comprises a first pulley housing, wherein the first pulley is positioned at an interior region of the first pulley housing and wherein the first pulley housing comprises an aperture and wherein the first pulley is positioned in the aperture.

8. The system as claimed in claim 1, wherein at least one of the first pulley and the second pulley comprises a channel constructed and arranged to interface with the elongated pull.

9. The system as claimed in claim 1, wherein the first portion and the second portion of the first pulley mount are suspended on the curtain at a first vertical position and wherein the first portion is positioned at a first side of the curtain and the second portion is positioned at a second side of the curtain.

10. The system of claim 1, wherein the first portion is constructed and arranged to be coupled to and removed from the second portion and removed in a first direction along a first axis and prevented from being coupling to and removed from the second portion in a second direction along a second axis orthogonal to the first axis, wherein the second portion comprises one or more claws, wherein at least two of the one or more claws are positioned on opposing sides of the second portion, and wherein the first portion is constructed and arranged to be positioned between the at least two of the one or more claws that are positioned on opposing sides of the second portion.

11. The system of claim 1, wherein at least one of the first portion and second portion is tapered along its length.

12. The system of claim 1, wherein the first portion and second portion are magnetically coupled to each other through the curtain.

13. The system of claim 1, further comprising a second pulley housing, wherein the second pulley is positioned at an interior region of the second pulley housing.

14. The system of claim 1, wherein the second pulley is positioned at a corner region of the base plate.

15. The system of claim 1, wherein the second pulley comprises first and second pulleys integral with the second pulley mount.

16. The system of claim 15, wherein the first pulley of the second pulley is positioned at a first corner region of the base plate and the second pulley of the second pulley is positioned at a second corner region of the base plate.

17. The system of claim 1, wherein the elongated pull comprises a string.

18. The system of claim 1, wherein the elongated pull is at least one of bonded to the zipper pull, tied to the zipper pull, and magnetically coupled to the zipper pull.

19. They system of claim 1, wherein the first pulley is integral with the first pulley mount and the second pulley is integral with the second pulley mount.

20. The system of claim 1, wherein the first pulley is positioned on the first portion of the first pulley mount and the second portion of the first pulley mount comprises an aperture; wherein the first pulley is constructed and arranged to extend through the aperture.

* * * * *